US011433266B2

(12) United States Patent
Farzam et al.

(10) Patent No.: US 11,433,266 B2
(45) Date of Patent: Sep. 6, 2022

(54) APPARATUS FOR FIGHTING FIRES

(71) Applicant: AlazTech Inc., Toronto (CA)

(72) Inventors: Hussein Farzam, North York (CA); Mahboob Bolandi, Toronto (CA)

(73) Assignee: AlazTech Inc., Toronto (CA)

( * ) Notice: Subject to any disclaimer, the term of this patent is extended or adjusted under 35 U.S.C. 154(b) by 228 days.

(21) Appl. No.: 16/882,684

(22) Filed: May 25, 2020

(65) Prior Publication Data

US 2021/0361992 A1 Nov. 25, 2021

(51) Int. Cl.

| | |
|---|---|
| ***A62C 37/38*** | (2006.01) |
| ***A62C 35/68*** | (2006.01) |
| *A62D 1/00* | (2006.01) |

(52) U.S. Cl.

CPC ..... *A62C 37/38* (2013.01); *A62C 35/68* (2013.01); *A62D 1/0092* (2013.01)

(58) Field of Classification Search

CPC ..... A62C 37/38; A62C 35/68; A62D 1/0092
USPC ..... 169/54, 60, 61, 5
See application file for complete search history.

(56) References Cited

U.S. PATENT DOCUMENTS

| | | | | |
|---|---|---|---|---|
| 1,653,147 | A | 12/1927 | Burgess | |
| 1,973,734 | A | 9/1934 | Thomas et al. | |
| 4,223,739 | A | 9/1980 | Waters | |
| 2002/0020827 | A1 | 2/2002 | Munzenberger et al. | |
| 2021/0031939 | A1* | 2/2021 | Perry | B64D 37/32 |
| 2021/0361992 | A1* | 11/2021 | Farzam | A62C 35/68 |

FOREIGN PATENT DOCUMENTS

| | | | |
|---|---|---|---|
| EP | 0608140 | A2 | 7/1994 |
| EP | 1583588 | B1 | 7/2019 |
| GB | 216204 | A | 5/1924 |

* cited by examiner

*Primary Examiner* — Christopher S Kim
(74) *Attorney, Agent, or Firm* — Bereskin & Parr LLP/S.E.N.C.R.L., s.r.l.; Isis E. Caulder

(57) ABSTRACT

A firefighting apparatus includes a reaction chamber, a $CO_2$ tank fluidly connected to the reaction chamber, acid and carbonate tanks, acid and carbonate pumps, and a controller. The acid and carbonate pumps act to correspondingly regulate flow of acid from the acid tank and carbonate from the carbonate tank to the reaction chamber. Acid and carbonate react within the reaction chamber to produce $CO_2$ gas which flows into the $CO_2$ tank and liquid byproduct which is releasable through a reaction chamber outlet. A $CO_2$ gas delivery valve is fluidly connected to a delivery outlet of the $CO_2$ tank to regulate release of $CO_2$ therefrom. The $CO_2$ tank includes a pressure sensor for measuring a $CO_2$ tank pressure. The controller is configured to control operation of the acid and carbonate pumps, and the $CO_2$ gas delivery valve according to a user command signal, the $CO_2$ tank pressure, or both.

25 Claims, 15 Drawing Sheets

APPARATUS FOR FIGHTING FIRES

FIELD

This application relates generally to the field of firefighting, and in particular to an apparatus for fighting fires.

INTRODUCTION

Fires have devastating effects all around the world. Every year fires cause enormous amounts of property damage and sadly claim the lives of many people, including firefighters. Once a fire starts, it will continue burning only if heat, oxygen and fuel are present. Together, these three elements are known to make up the "fire triangle". To extinguish a fire requires eliminating one or more of the fire triangle's elements. There are three general methods in which any fire can be extinguished: (i) cooling, i.e. by applying water on the fire; (ii) suffocation, i.e. by applying carbon dioxide ($CO_2$) gas or chemical foam/agents on the fire, to deprive it from oxygen; and (iii) starvation, i.e. by cutting/cleaning the area around the fire to remove materials that may catch fire. Firefighters employ one, or a combination of these methods, while combating structural fires and wildfires.

Structural fires can release massive amounts of toxins and hazardous materials. Significant volumes of water and other fire suppressants (e.g. chemical foams) are often used in the extinguishing of structural fires. In some cases, after the fire has been extinguished, toxic debris as well as the water and other fire suppressants used to extinguish the fire are recovered to prevent environmental and groundwater contamination. A principle reason why such recovery is not undertaken after all structural fires is the extraordinary cost and difficulty of wastewater recovery. Ineffective or non-existent wastewater recovery after extinguishing even a modestly sized structural fire can lead to the contamination of the water table.

In general, wildfires are more problematic than structural fires. They emit huge amounts of greenhouse gas into the atmosphere, contributing to global climate change. Wildfires impair regional air quality and burn valuable timber to ash and charcoal. The chemicals ordinarily used in the suppression of wildfires are toxic and can cause detrimental long term effects on the surrounding environment. Rain water-runoffs may carry the hazardous chemicals into watersheds and marine habitats located in creeks, rivers and lakes. Smoke from a wildfire can be carried hundreds of miles away and the effects of smoke exposure can persist well after the wildfire is extinguished. For these reasons, a wildfire imposes an enormous environmental and financial cost long after it is extinguished. Studies have shown that direct and indirect costs associated with wildfires run into billions of dollars each year. For example, the annualized economic burden of wildfires in United States alone is estimated to be between $71.1 and $347.8 billion ($USD).

The most common types of firefighting equipment include: (i) firetrucks (also known as fire engines or water trucks), (ii) sprinkler systems installed in buildings and homes, (iii) pressurized $CO_2$ capsules or tanks, (iv) pressurized chemical foam/aerosol capsules or tanks, and (v) equipment for cutting/cleaning the area around the fire, e.g. bulldozers, chainsaws, etc. Each are discussed in turn below.

(i) Firetrucks

Firetrucks are primarily used to deliver large volumes of water to the fire by hose. Simply put, delivering such large volumes of water to the fire is very inefficient and time consuming. It can be especially ineffective at reducing/ controlling large structural fires. These types of fires typically burn themselves out, after which, they are brought under control with water. The applied water sinks underground or below the surface of the fire, thus leaving only a thin film of water that quickly evaporates. Therefore, firetrucks generally use massive volumes of water to put out a fire. Not only does this cost the city lots of money, the excess water carries harmful substances from the fire into the underground water system. This may pollute underground aquifers. Several substances produced by fires are so poisonous and hazardous to the environment that, after the fire is extinguished, the water delivered by the firetruck has to be recovered before it contaminates the underground water system. Such recovery is costly, difficult, and time consuming. Furthermore, the high volumes of water used to extinguish fires can damage the foundations of buildings. This causes additional financial strain and even has the potential to cause the structure to collapse.

(ii) Sprinkler Systems

Sprinkler systems are most useful for small kitchen fires or small area fires. Even with small fires, for the sprinkler system to be effective, the fire has to be detected early and located right below the sprinklers. In fact, many fires are a testament to the failure of the existing sprinkler system. With large fires, the heat generated often disables the sprinkler system, rendering it useless. Since hot air rises, heat generated by the fire accumulates below the ceilings and consequently disables the sprinkler system. Further, sprinkler systems are designed to direct water at the floor. However, in many cases, the fire may be burning above floor. In these cases, the water from the sprinklers is not directed to the appropriate location.

(iii) Pressurized $CO_2$ Capsules

Pressurized $CO_2$ capsules contain a limited quantity of $CO_2$ that is generally sufficient for single applications on small fires. For large fires, larger quantities of $CO_2$ are needed. It is simply not feasible to carry enough $CO_2$ in a pressurized capsule to extinguish a large fire. This would require a massive $CO_2$ tank and a trailer large enough to transport it. Since $CO_2$ is heavier than air, it sinks to the ground. This makes $CO_2$ an inappropriate fire suppressant for above ground fires, e.g. ceiling, beam and column fires. For the reasons provided above, a pressurized $CO_2$ capsule is only suitable for fighting a small fire where its user can stand above the fire to spray it with $CO_2$.

Pressurized $CO_2$ capsules typically have a shelf life of about 7 to 10 years. When this time is up, they have to be replaced whether they have been used or not. In addition, pressurized $CO_2$ capsules have a tendency to fail when not used for extended periods of time. This creates the need for regular checks and monitoring. Ironically, after so many repeated safety checks, the capsules eventually empty and need to be replaced anyway.

(iv) Pressurized Chemical Foam Capsules

Pressurized chemical foam capsules are similar to pressurized $CO_2$ capsules except that they contain chemical foam instead of $CO_2$. Many of the chemical foams selected for use are toxic to the environment. As a result, chemical foam is usually used only for special cases (e.g. liquid fires). Since the chemicals are so harmful to the environment, they have to be recovered from the site after use. Such recovery is costly, difficult, and time consuming. Furthermore, chemical foams are generally so light that even a light wind renders them useless (i.e. it cannot be applied to the fire since it blows away).

(v) Cutting and Cleaning Equipment

As its name implies, cutting and cleaning equipment can be used to cut and clean the area around the fire in order to starve it. Simply put, this type of equipment is not effective and practical for most structural fires. Cutting and cleaning equipment is used most regularly when fighting wildfires (often with limited success). This equipment is labour intensive, costly and time consuming (both from a use and transportation perspective). The operators of such equipment are at high risk while fighting wildfires and account for a high proportion of fatalities.

Recent developments in firefighting equipment include: (i) fire bombs, (ii) fire fans, (iii) steam delivery systems, (iv) adjustable sprinkler systems, and (v) infrared cameras. Each are discussed in turn below.

(i) Fire Bombs

Fire bombs release gas, or a mixture of gases, that can reduce fire temperatures within an enclosed area, e.g. for about 6 minutes. As a fire burns, it draws in air. Consequently, the fire draws in the gases released from the fire bomb which subsequently replace most of the air that the fire normally would breathe. It is important to note that fire bombs do not extinguish fires. They can reduce the temperature of the fire for a period of time, thus allowing the fire's spread to be controlled during this period. Fire bombs lack practicality and are ineffective for the uncontrolled environments of real world fires. For fire bombs to be effective, one needs to know the exact location of the fire source in to order locate the fire bomb close enough. For example, simply locating a fire bomb in a hallway adjacent to a room containing the fire source will not be effective. Plus, each fire bomb can cost upwards of $1,500 ($USD). This makes the use of fire bombs uneconomical, especially considering that many may be used for even a small fire.

(ii) Fire Fans

Fire fans blow high powered air toward a fire in an effort to clear away smoke so that a clearer view of the fire environment can be provided. Fire fans are not effective or practical for the majority of structural fires since these fires are usually enclosed by walls and other obstacles. Further, for fire fans to be effective they have to be placed very close to the fire and on the same level as the fire. This makes them impractical to fight fires in many locations, e.g. in an attic, on a rooftop, or a high floor in an apartment building. Use of fire fans also present the danger of blowing air onto hot surfaces and igniting further fires. For these reasons, fire fans are not widely used.

(iii) Steam Delivery Systems

Steam delivery systems boil water to produce steam that can be delivered to a fire within an enclosed area. The intention is that the steam will replace the air surrounding the fire, thereby suffocating it. A first drawback to steam delivery systems is that steam does nothing to reduce the temperature of the fire since it is hot itself. More importantly, attempting to replace the air surround the fire with steam is futile since steam is lighter than air molecules and easily escapes along with the hot fire gases. Steam delivery systems also present many logistical challenges, such as how fast to boil the water and how to deliver the steam to the fire. This is in addition to the enormous amounts of energy that are required to boil the water in order to produce the steam. For these reasons, steam delivery systems are not widely used and do not show much promise.

(iv) Adjustable Sprinkler Systems

Like traditional sprinkler systems discussed above, adjustable sprinkle systems are activated by fire sensors. However, adjustable sprinkler systems have sprinkler heads that can automatically turn toward the fire. This allows such sprinkler systems to better direct water at the fire. Adjustable sprinkler systems possess all the drawbacks of traditional sprinkler systems mentioned above. In addition, installation and maintenance of adjustable sprinkler systems can be quite costly. They can be effectively designed to suppress small kitchen fires that are detected by fire sensors. Any use beyond this for an adjustable sprinkler system generally fails a cost/benefit analysis.

(v) Infrared Cameras

Infrared cameras can be used to pinpoint a fire's hotspot(s) and/or locate people (including firefighters) within the structure on fire. They have shown an application in identifying flash fires before they occur. Flash fires injure and kill many firefighters every year. In order to be useful, the infrared cameras have to be held above the ground and close to the targeted area. This makes them dangerous and impractical in many situations. If the targeted area is itself very hot, infrared cameras are often unable to differentiate people within the targeted area.

DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

SUMMARY

Figure 1:
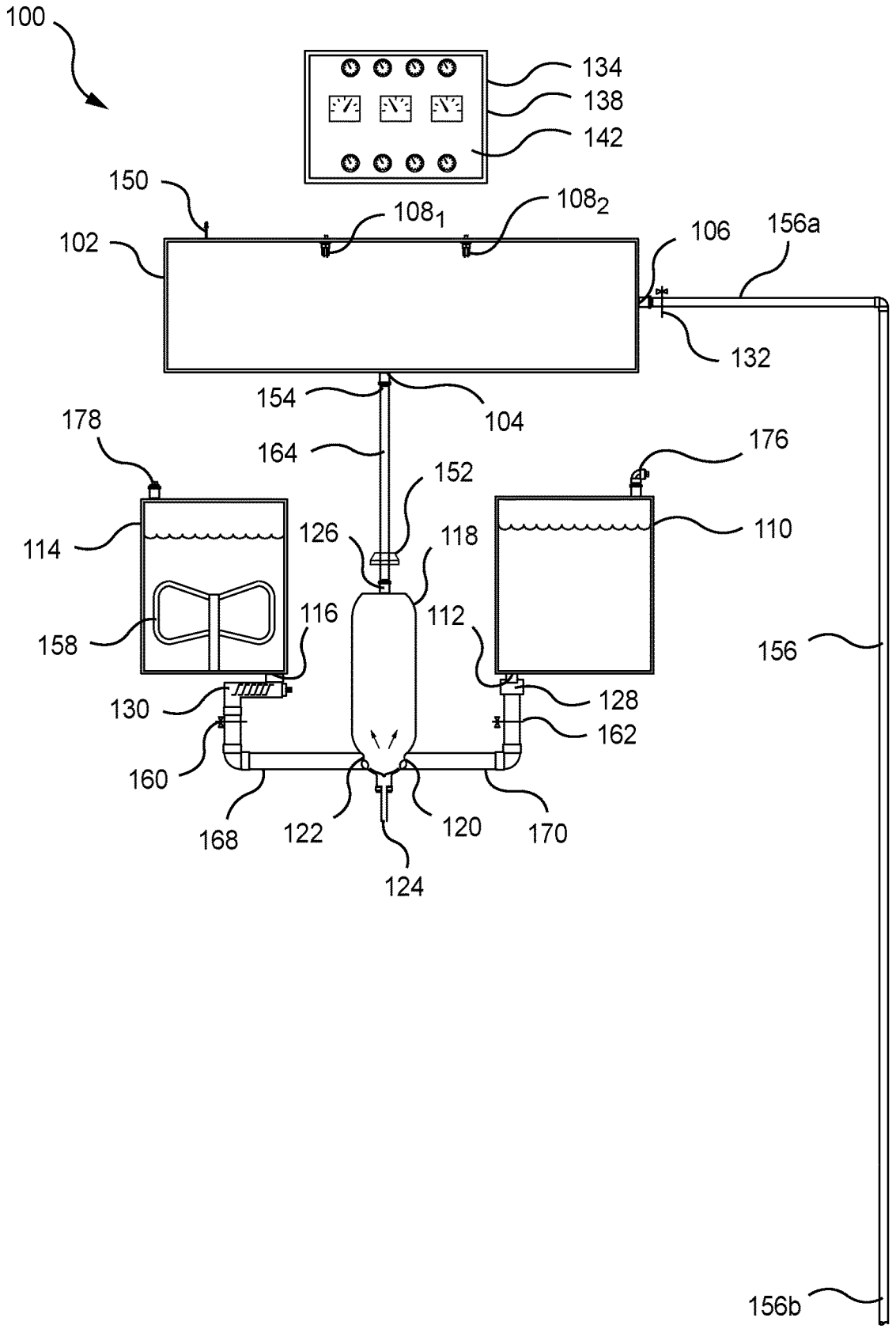
FIG. 1 is a schematic diagram illustrating a firefighting apparatus in accordance with an embodiment.

In a broad aspect, a firefighting apparatus is described herein. The firefighting apparatus may include: a carbon dioxide tank including at least one pressure sensor for measuring a carbon dioxide tank pressure; an acid tank; a carbonate tank; a reaction chamber fluidly connected to the acid tank, the carbonate tank, and the carbon dioxide tank, the reaction chamber including a liquid byproduct release outlet; an acid supply pump that acts to regulate flow of acid from the acid tank to the reaction chamber; a carbonate supply pump that acts to regulate flow of carbonate from the carbonate tank to the reaction chamber; and a controller including a processor, the controller being communicatively coupled to the at least one pressure sensor, the carbonate supply pump and the acid supply pump, wherein acid and carbonate react within the reaction chamber to produce carbon dioxide gas which flows into the carbon dioxide tank and liquid byproduct which is releasable through the liquid byproduct release outlet, and in response to receiving a user command signal, the processor is configured to: receive, from the at least one pressure sensor, an input signal including the carbon dioxide tank pressure; transmit a control signal to the carbonate supply pump instructing it to act according to at least one of the carbon dioxide tank pressure and the user command signal; and transmit a control signal to the acid supply pump instructing it to act according to at least one of the carbon dioxide tank pressure and the user command signal.

In some embodiments, the carbon dioxide tank includes a carbon dioxide gas outlet and a carbon dioxide gas delivery control valve that acts to regulate release of carbon dioxide gas from the carbon dioxide tank at the carbon dioxide gas outlet, the carbon dioxide gas delivery valve being communicatively coupled to the controller, the user command signal includes a carbon dioxide gas delivery pressure, and in response to receiving the user command signal, the processor is configured to transmit a control signal to the carbon dioxide gas delivery control valve instructing it to act according to the carbon dioxide gas delivery pressure.

In some embodiments, the firefighting apparatus includes a carbon dioxide gas delivery conduit for delivering carbon dioxide gas from the carbon dioxide tank to a fire, the carbon dioxide gas delivery conduit having a tank end fluidly connected to the carbon dioxide gas outlet so that carbon dioxide gas released from the carbon dioxide gas outlet flows through the carbon dioxide delivery conduit.

In another broad aspect, a firefighting apparatus is described herein. The firefighting apparatus may include: a carbon dioxide tank including at least one pressure sensor for measuring a carbon dioxide tank pressure; an acid tank; a carbonate tank; a reaction chamber fluidly connected to the acid tank, the carbonate tank, and the carbon dioxide tank, the reaction chamber including a liquid byproduct release outlet; an acid supply pump that acts to regulate flow of acid from the acid tank to the reaction chamber; a carbonate supply pump that acts to regulate flow of carbonate from the carbonate tank to the reaction chamber; and a controller including a processor, the controller being communicatively coupled to the at least one pressure sensor, the carbonate supply pump and the acid supply pump, wherein acid and carbonate react within the reaction chamber to produce carbon dioxide gas which flows into the carbon dioxide tank and liquid byproduct which is releasable through the liquid byproduct release outlet, and the processor is configured to: receive, from the at least one pressure sensor, an input signal including the carbon dioxide tank pressure; transmit a control signal to the carbonate supply pump instructing it to act according to the carbon dioxide tank pressure; and transmit a control signal to the acid supply pump instructing it to act according to the carbon dioxide tank pressure.

In some embodiments, the control signal transmitted to both the carbonate supply pump and the acid supply pump instructs each to operate while the carbon dioxide tank pressure is below a baseline carbon dioxide tank pressure.

In some embodiments, the carbon dioxide tank includes a carbon dioxide gas outlet and a carbon dioxide gas delivery control valve that acts to regulate release of carbon dioxide gas from the carbon dioxide tank at the carbon dioxide gas outlet, the carbon dioxide gas delivery valve being communicatively coupled to the controller, and in response to receiving a user command signal including a carbon dioxide gas delivery pressure, the processor is configured to transmit a control signal to the carbon dioxide gas delivery control valve instructing it to act according to the carbon dioxide delivery pressure.

In some embodiments, the firefighting apparatus includes a carbon dioxide gas delivery conduit for delivering carbon dioxide gas from the carbon dioxide tank to a fire, the carbon dioxide gas delivery conduit having a tank end fluidly connected to the carbon dioxide gas outlet so that carbon dioxide gas released from the carbon dioxide gas outlet flows through the carbon dioxide delivery conduit.

In some embodiments, the reaction chamber includes at least one level sensor for measuring a liquid byproduct level within the reaction chamber, the at least one level sensor being communicatively coupled to the controller, the apparatus includes a liquid byproduct pump that acts to regulate release of liquid byproduct from the reaction chamber at the liquid byproduct release outlet, the liquid byproduct pump being communicatively coupled to the controller, and the processor is configured to: receive, from the at least one level sensor of the reaction chamber, an input signal including the liquid byproduct level within the reaction chamber; and transmit a control signal to the liquid byproduct pump instructing it to act according to the liquid byproduct level within the reaction chamber.

In some embodiments, both the carbonate tank and the acid tank are fluidly connected to the carbon dioxide tank so that carbon dioxide gas from the carbon dioxide tank is conveyable to pressurize each of the carbonate tank and the acid tank, and the apparatus includes: a carbonate tank pressurization control valve that acts to regulate pressurization of the carbonate tank; and an acid tank pressurization control valve that acts to regulate pressurization of the acid tank.

In some embodiments, both the carbonate tank pressurization control valve and the acid tank pressurization control valve are communicatively coupled to the controller, the carbonate tank includes at least one pressure sensor for measuring a carbonate tank pressure, the acid tank includes at least one pressure sensor for measuring an acid tank pressure, the at least one pressure sensor of both the carbonate tank and acid tank being communicatively coupled to the controller, and the processor is configured to: receive, from the at least one pressure sensor of the carbonate tank, an input signal including the carbonate tank pressure; transmit a control signal to the carbonate tank pressurization control valve instructing it to act according to the carbonate tank pressure; receive, from the at least one pressure sensor of the acid tank, an input signal including the acid tank pressure; and transmit a control signal to the acid tank pressurization control valve instructing it to act according to the acid tank pressure.

In some embodiments, the reaction chamber and the carbonate tank are fluidly connected by the carbonate supply pump and a carbonate supply line, the apparatus includes: a water tank fluidly connected to the carbonate supply line so that water from the water tank is conveyable to the carbonate supply line to improve flow of carbonate therethrough; and a water supply pump that acts to regulate flow of water from the water tank to the carbonate supply line, the water supply pump being communicatively coupled to the controller, and the processor is configured to transmit a control signal to the water supply pump instructing it to act according to the carbonate supply pump.

In some embodiments, the water tank includes a water delivery outlet, the apparatus includes: a water delivery conduit for delivering water from the water tank to a fire, the water delivery conduit having a tank end fluidly connected to the water delivery outlet so that water released from the water delivery outlet flows through the water delivery conduit; and a water delivery pump that acts to regulate flow of water through the water delivery conduit, the water delivery pump being communicatively coupled to the controller, and in response to receiving a further user command signal including a water delivery pressure, the processor is configured to transmit a control signal to the water delivery pump instructing it to act according to the water delivery pressure.

In some embodiments, the water tank is fluidly connected to the carbon dioxide tank so that carbon dioxide gas from the carbon dioxide tank is conveyable to pressurize the water tank, and the apparatus includes a water tank pressurization control valve that acts to regulate pressurization of the water tank.

In some embodiments, the water tank pressurization control valve is communicatively coupled to the controller, the water tank includes at least one pressure sensor for measuring a water tank pressure, the at least one pressure sensor of the water tank being communicatively coupled to the controller, and the processor is configured to: receive, from the at least one pressure sensor of the water tank, an input signal including the water tank pressure; and transmit a control signal to the water tank pressurization control valve instructing it to act according to the water tank pressure.

In some embodiments, the water tank includes a pressure relief valve that acts to regulate release of carbon dioxide gas from the water tank, the pressure relief valve of the water tank being communicatively coupled to the controller, and the processor is configured to transmit a control signal to the pressure relief valve of the water tank instructing it to release carbon dioxide gas while the water tank pressure exceeds a water tank pressure threshold.

In some embodiments, the carbon dioxide gas delivery conduit includes an evaporated water inlet, the water tank includes an evaporated water outlet, and the apparatus includes: an evaporated water uptake conduit fluidly connecting the evaporated water outlet of the water tank to the evaporated water inlet of the carbon dioxide gas delivery conduit so that water vapor from the water tank is conveyable to the carbon dioxide gas delivery conduit to mix with carbon dioxide gas flowing therethrough; and an evaporation control valve that acts to regulate flow of water vapor through the evaporated water uptake line, the evaporation control valve being positioned along the evaporated water uptake line and communicatively coupled to the controller, the user command signal includes a saturation level and, in response to receiving the user command signal, the processor is configured to: transmit a control signal to the pressure relief valve of the water tank instructing it to release carbon dioxide gas until the water tank is depressurized; and transmit a control signal to the evaporation control valve instructing it to act according to the saturation level.

In some embodiments, the apparatus includes a thermal tank holding a heat exchange medium, and a portion of the carbon dioxide gas delivery conduit upstream of the evaporated water inlet passes through the thermal tank so that carbon dioxide gas flowing therethrough exchanges heat with the heat exchange medium.

In some embodiments, the apparatus includes: a mixing chamber having an inlet port, an outlet port, and an internal passage between the inlet port and the outlet port, the mixing chamber including at least one mixing element located within the internal passage, the inlet port of the mixing chamber being fluidly connected to the water tank, the carbonate tank and the carbon dioxide tank, each mixing element acts to mix carbonate and at least one of carbon dioxide gas and water into a carbonate solution as they flow through the internal passage; a mixing chamber delivery conduit for delivering the carbonate solution from the mixing chamber to a fire, the mixing chamber having a chamber end fluidly connected to the outlet port of the mixing chamber; a water transfer pump that acts to regulate flow of water from the water tank to the mixing chamber; a carbonate transfer pump that acts to regulate flow of carbonate from the carbonate tank to the mixing chamber; and a carbon dioxide gas transfer control valve that acts to regulate flow of carbon dioxide gas from the carbon dioxide tank to the mixing chamber, the water transfer pump, the carbonate transfer pump, the carbon dioxide gas transfer control valve and each mixing element being communicatively coupled to the controller, and in response to receiving an additional user command signal including a carbonate solution delivery pressure and a carbonate concentration, the processor is further configured to: transmit a control signal to the water transfer pump instructing it to act according to at least one of the carbonate solution delivery pressure and the carbonate concentration; transmit a control signal to the carbonate transfer pump instructing it to act according to at least one of the carbonate solution delivery pressure and the carbonate concentration; transmit a control signal to the carbon dioxide gas transfer control valve instructing it to act according to at least one of the carbonate solution delivery pressure and the carbonate concentration; and transmit a control signal to each mixing element instructing that mixing element to act according to at least one of the carbonate solution delivery pressure and the carbonate concentration.

In some embodiments, the acid tank includes an acid delivery outlet, the apparatus includes: an acid delivery conduit for delivering acid from the acid tank to a fire, the acid delivery conduit having a tank end fluidly connected to the acid delivery outlet so that acid released from the acid delivery outlet flows through the acid delivery conduit; and an acid delivery pump that acts to regulate flow of acid through the acid delivery conduit, the acid delivery pump being communicatively coupled to the controller, and in response to receiving a further additional user command signal including an acid delivery pressure, the processor is configured to transmit a control signal to the acid delivery pump instructing it to act according to the acid delivery pressure.

In some embodiments, the water tank is fluidly connected to the acid delivery conduit, the apparatus includes an acid dilution pump that acts to regulate flow of water from the water tank to the acid delivery conduit, the acid dilution pump being communicatively coupled to the controller, the further additional user command signal includes an acid concentration, and in response to receiving the further additional user command signal, the processor is configured to transmit a control signal to the acid dilution pump instructing it to act according to the acid concentration.

In some embodiments, the water tank includes at least one level sensor for measuring a water level within the water tank, the at least one level sensor of the water tank being communicatively coupled to the controller, the apparatus includes: a liquid byproduct tank including a liquid byproduct inlet fluidly connected to the liquid byproduct release outlet of the reaction chamber so that liquid byproduct released from the reaction chamber collects within the liquid byproduct tank, the liquid byproduct tank being fluidly connected to the water tank; and an exchange pump that acts to regulate flow of liquid byproduct from the liquid byproduct tank to the water tank, the exchange pump being communicatively coupled to the controller, and the processor is configured to: receive, from the at least one level sensor of the water tank, an input signal including the water level; and transmit a control signal to the exchange pump instructing it to operate while the water level is below a water level threshold.

In some embodiments, the apparatus includes: an additional tank for holding a fire suppressant, the additional tank including a fire suppressant outlet; a fire suppressant delivery conduit for delivering fire suppressant from the additional tank to a fire, the fire suppressant delivery conduit having a tank end fluidly connected to the fire suppressant outlet so that fire suppressant released from the fire suppressant outlet flows through the fire suppressant delivery conduit, the fire suppressant delivery conduit being fluidly connected to the carbon dioxide tank so that carbon dioxide gas from the carbon dioxide tank is able to propel fire suppressing material through the fire suppressant delivery conduit; a fire suppressant pump that acts to regulate release of fire suppressant from the fire suppressant outlet, the fire suppressant pump being communicatively coupled to the controller; and a propulsion control valve that acts to regulate propulsion of fire suppressant through the fire suppressant delivery conduit, the propulsion control valve being communicatively coupled to the controller, and in response to receiving a user command signal including a fire suppressant delivery pressure, the processor is configured to: transmit a control signal to the fire suppressant pump instructing it to act according to the fire suppressant delivery pressure; and transmit a control signal to the propulsion control valve instructing it to act according to the fire suppressant delivery pressure.

In some embodiments, the additional tank is fluidly connected to the carbon dioxide tank so that carbon dioxide gas from the carbon dioxide tank is conveyable to pressurize the additional tank, and the apparatus includes an additional tank pressurization control valve that acts to regulate pressurization of the additional tank.

In some embodiments, the additional tank pressurization control valve is communicatively coupled to the controller, the additional tank includes at least one pressure sensor for measuring an additional tank pressure, the at least one pressure sensor of the additional tank being communicatively coupled to the controller, and the processor is configured to: receive, from the at least one pressure sensor of the additional tank, an input signal including the additional tank pressure; and transmit a control signal to the additional tank pressurization control valve instructing it to act according to the additional tank pressure.

In some embodiments, the apparatus includes: a supplemental tank for holding a fire suppressant; a mixing chamber having an inlet port, an outlet port, and an internal passage extending between the inlet and the outlet port, the mixing chamber including at least one mixing element located in the internal passage, the inlet port of the mixing chamber being fluidly connected to the water tank, the supplemental tank, and the carbon dioxide tank, each mixing element acts to mix fire suppressant and at least one of liquid byproduct and carbon dioxide gas into a fire suppressing solution as they flow through the internal passage; a mixing chamber delivery conduit for delivering the fire suppressing solution from the mixing chamber to a fire, the mixing chamber delivery conduit having a chamber end fluidly connected to the outlet port of the mixing chamber; a liquid byproduct supply pump that acts to regulate flow of liquid byproduct from the liquid byproduct tank to the mixing chamber; a fire suppressant supply pump that acts to regulate flow of fire suppressant from the supplemental tank to the mixing chamber; and a carbon dioxide gas supply control valve that acts to regulate flow of carbon dioxide gas from the carbon dioxide tank to the mixing chamber, the liquid byproduct supply pump, the fire suppressant supply pump, the carbon dioxide gas supply control valve, and each mixing element being communicatively coupled to the controller, and in response to receiving an additional user command signal including at least a fire suppressing solution delivery pressure and a fire suppressing material concentration, the processor is configured to: transmit a control signal to the liquid byproduct supply pump instructing it to act according to at least one of the fire suppressing solution delivery pressure and the fire suppressant concentration; transmit a control signal to the fire suppressant supply pump instructing it to act according to at least one of the fire suppressing solution delivery pressure and the fire suppressant concentration, transmit a control signal to the carbon dioxide gas supply control valve instructing it to act according to at least one of the fire suppressing solution delivery pressure and the fire suppressant concentration; and transmit a control signal to each mixing element instructing that mixing element to act according to at least one of the fire suppressing solution delivery pressure and the fire suppressant concentration.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms “an embodiment”, “embodiment”, “embodiments”, “the embodiment”, “the embodiments”, “one or more embodiments”, “some embodiments” and “one embodiment" mean "one or more (but not all) embodiments of the present invention(s)", unless expressly specified otherwise.

The terms "including", "comprising" and variations thereof mean "including but not limited to", unless expressly specified otherwise. A listing of items does not imply that any or all of the items are mutually exclusive, unless expressly specified otherwise. The terms "a", "an" and "the" mean "one or more", unless expressly specified otherwise.

As used herein and in the claims, two or more parts are said to be "coupled", "connected", "attached", "joined", "affixed", or "fastened" where the parts are joined or operate together either directly or indirectly (i.e. through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies. For example, the expression "about 300 nanometers" means 300 nanometers+/−10% (between 270 and 330 nanometers).

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

As used herein and in the claims, a first element is said to be 'communicatively coupled to' or 'communicatively connected to' or 'connected in communication with' a second element where the first element is configured to send or receive electronic signals (e.g. data) to or from the second element, and the second element is configured to receive or send the electronic signals from or to the first element. The communication may be wired (e.g. the first and second elements are connected by one or more data cables), or wireless (e.g. at least one of the first and second elements has a wireless transmitter, and at least the other of the first and second elements has a wireless receiver). The electronic signals may be analog or digital. The communication may be one-way or two-way. In some cases, the communication may conform to one or more standard protocols (e.g. SPI, $I^2C$, Bluetooth®, or IEEE™ 802.11).

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

In addition, some elements herein may be identified by a part number, which is composed of a base number followed by an alphabetical or subscript-numerical suffix (e.g. 108*a*, or $\mathbf{108}_1$). Multiple elements herein may be identified by part numbers that share a base number in common and that differ by their suffixes (e.g. $\mathbf{108}_1$ and $\mathbf{108}_2$). All elements with a common base number may be referred to collectively or generically using the base number without a suffix (e.g. 108).

Fires may be classified based on the type of material that is on fire. Each class of fire is fought or suppressed in a preferred way. For example, the application of water may be an effective way to suppress Class A fires. However, the application of water is an ineffective, and potentially dangerous way, to suppress electrical fires (i.e. Class C fires in the U.S.). Table 1 below lists the preferred method of fire suppression for different designated fire classes. In some cases, a fire may fit into more than one class. For example, a fire may originate as a Class B fire before expanding to become a Class B and Class A fire.

Table 1: Preferred method of fire suppression by designated fire class

TABLE 1

Preferred method of fire suppression by designated fire class

| | Designated class | | | |
|---|---|---|---|---|
| Description | Europe | United States | Australia | Preferred method of fire suppression |
| Combustible materials (wood, paper, fabric, refuse) | Class A | Class A | Class A | Majority of known suppression methods may be used (application of water or monoammonium phosphate most common) |
| Flammable liquids | Class B | Class B | Class B | Inhibit chemical reaction, e.g. smothering by application of dry chemical |
| Flammable gases | Class C | Class B | Class C | Inhibit chemical reaction, e.g. smothering by application of dry chemical |
| Flammable metals | Class D | Class D | Class D | Smothering the fire, e.g. by application of dry chemical powder |
| Electrical fire | Not classified (formerly Class E) | Class C | Class E | Cut power and apply non-conductive chemicals (cannot use water) |

TABLE 1-continued

| Preferred method of fire suppression by designated fire class | | | | |
|---|---|---|---|---|
| | Designated class | | | |
| Description | Europe | United States | Australia | Preferred method of fire suppression |
| Cooking oils and fats | Class F | Class K | Class F | Removal of oxygen or water mist, e.g. application of wet chemicals |

Known firefighting equipment is generally designed for a specific class of fire and lacks the ability to adapt to changing fire conditions. A firefighter is generally forced to select the appropriate firefighting equipment based on the class of fire. However, in some cases, the class of fire is not known until arriving on the scene. Once firefighters are actively fighting the fire, time constraints generally do not allow firefighter(s) to switch their equipment. This lost time can have devastating consequences. Firefighting is a race against time. However, equally or even more devastating can be using firefighting equipment that is poorly suited for the class of fire being fought.

Various embodiments disclosed herein are directed at firefighting apparatuses that address the limited applications and other shortcomings of known firefighting equipment. In particular, the firefighting apparatuses disclosed herein may allow its operator(s) to select one of many firefighting outputs that are most suited to suppressing the type/class of fire at hand. At least one embodiment disclosed herein provides more than five distinct firefighting outputs, which may be used simultaneously or sequentially by a firefighter to suppress a fire.

Various embodiments disclosed herein are directed at a firefighting apparatus that provides firefighters with an enhanced ability to fight both structural and wildfires relative to known firefighting equipment. In particular, the embodiments disclosed herein use controlled chemical reactions between raw materials, along with physical properties of gases and the mechanical properties of fluid dynamics, to offer a range of integrated, safe, reliable and effective firefighting outputs. More particularly, the embodiments disclosed herein use carbon dioxide gas produced within its reaction chamber, through a controlled reaction of carbonate and acid, to offer a range of firefighting outputs. Thus, use of the embodiments of the apparatus disclosed herein may lead to a reduction in fire damage and/or fire related fatalities by speeding up fire suppression through effective use of the firefighting outputs.

As will be described below, another aspect of the teachings described herein is to limit the use of water in fighting fires. The various embodiments of the firefighting apparatus disclosed use minimal amounts of water. This may lead to a reduction in structural damage caused by excessive use of water as well as a reduction in the cost of fire site cleanups and/or the recovery of wastewater. Another aspect of the teachings described herein is to limit use of carcinogenic and toxic materials in fighting fires. The various embodiments of the firefighting apparatus disclosed do not make use of toxic or hazardous chemicals. This may protect the environment from fire related hazards and toxic pollution emitted by fires.

Reference is now made to FIG. 1, which illustrates an apparatus 100 for fighting fires. Apparatus 100 includes a carbon dioxide tank 102, a carbon dioxide gas delivery control valve 132, an acid tank 110, a carbonate tank 114, a reaction chamber 118, an acid supply pump 128, a carbonate supply pump 130 and a controller 134. For example, apparatus 100 may be mounted on a firetruck. Alternatively, apparatus 100 may be mounted on a trailer (i.e. truck bed) that is towable by a truck.

Carbon dioxide tank 102 holds pressurized carbon dioxide gas. As will be described below, the carbon dioxide gas held within carbon dioxide tank 102 is received from reaction chamber 118 where it is produced through the reaction of an acid and carbonate. Carbon dioxide tank 102 is preferably constructed from high-strength materials (e.g. titanium, stainless steel, etc.) that can withstand high internal pressure and other operational stress.

Carbon dioxide tank 102 includes a carbon dioxide gas inlet 104, a carbon dioxide gas outlet 106, and at least one pressure sensor 108 for measuring a carbon dioxide tank pressure. In the illustrated example, carbon dioxide tank 102 includes two pressure sensors $\mathbf{108}_1$ and $\mathbf{108}_2$. In alternative embodiments, carbon dioxide tank 102 may include additional pressure sensors 108, e.g. 3 to 6, or more. The inclusion of multiple pressure sensors 108 within carbon dioxide tank 102 may provide one or more advantages. For example, if one or more malfunction, the remaining pressure sensor(s) 108 may still operate to measure the carbon dioxide tank pressure. Each pressure sensor 108 may be one of many currently available pressure sensors. As an example, pressure sensor(s) 108 may be a MEP 2000 series electronic pressure switch manufactured by Danfoss Engineering.

Acid tank 110 holds acid. As will be described below, the acid is preferably a carboxylic acid, e.g. acetic acid, propionic acid, butyric acid, etc. Acid tank 110 is preferably constructed from high-strength, non-corrosive materials (e.g. stainless steel, aluminum alloy etc.) so that it can withstand acid corrosion and other operational stress. Acid tank 110 includes an acid supply outlet 112 that fluidly connects acid tank 110 to reaction chamber 118, thereby allowing acid from acid tank 110 to be supplied to reaction chamber 118. In the illustrated example, acid tank 110 includes a loading port 176 that may be used to refill acid tank 110 with acid. For example, loading port 176 may be connected to a loading device (not shown) in order to refill acid tank 110 with acid.

Acid tank 110 preferably holds acetic acid. Acetic acid is the weakest (and thereby least dangerous) of the carboxylic acids. Acetic acid (also referred to as ethanoic acid) is a colourless liquid organic compound with the chemical formula $CH_3COOH$ (also written as $CH_3CO_2H$ or $C_2H_4O_2$). Acetic acid is classified as a weak acid since it only partially dissociates in solution.

Carbonate tank 114 holds carbonate. Many kinds of carbonate may be held in carbonate tank 114. For example, the carbonate may be sodium bicarbonate, sodium carbonate, potassium bicarbonate, ammonium bicarbonate, calcium carbonate, or a combination thereof. Carbonates react with acids, releasing carbon dioxide (CO2) gas in the process. Carbonate tank 114 is preferably constructed from high-strength materials (e.g. titanium, stainless steel, etc.) so that it has the durability to withstand operational stress.

Carbonate tank 114 preferably holds sodium bicarbonate (also referred to as baking soda). Sodium bicarbonate is a compound with the chemical formula $NaHCO_3$. It is a salt composed of a sodium cation ($Na^+$) and a bicarbonate anion ($HCO_3^-$). Sodium bicarbonate is generally safe to use and handle. Sodium bicarbonate reacts spontaneously with acids, releasing carbon dioxide ($CO_2$) gas in the process.

Carbonate tank 114 includes a carbonate supply outlet 116 that fluidly connects carbonate tank 114 to reaction chamber 118, thereby allowing carbonate from carbonate tank 114 to be supplied to reaction chamber 118. In the illustrated example, carbonate tank 114 includes a loading port 178 that may be used to refill carbonate tank 114 with carbonate. For example, loading port 178 may be connected to a loading device (not shown) in order to refill carbonate tank 114 with carbonate.

In the illustrated example, carbonate tank 114 includes a stirring element 158. Stirring element 158 acts to mix carbonate within carbonate tank 114 so that the likelihood of carbonate solidification may be reduced or even eliminated. For example, stirring element 158 may operate (i.e. rotate) continuously or periodically at a regular interval. Stirring element 158 may be communicatively coupled to controller 134 so that its operation is controllable by controller 134 in an automated fashion.

With reference to FIG. 1, stirring element 158 is illustrated as a multi-arm mixer that turns to stir the carbonate. It will be appreciated that stirring element 158 may be configured differently in alternative embodiments. In one or more alternative embodiments, carbonate tank 114 may include additional stirring elements 158, e.g. located in different positions to improve mixing distribution. Alternatively, carbonate tank 114 may not include a stirring element 158.

Reaction chamber 118 may be supplied with acid from acid tank 110 and carbonate tank 114. As will be discussed in more detail below, the acid and the carbonate react within reaction chamber 118 to produce both liquid and gas byproducts. Reaction chamber 118 includes a liquid byproduct release outlet 124. Liquid byproduct produced in reaction chamber 118 may be released through liquid byproduct release outlet 124. Reaction chamber 118 is preferably constructed of high-strength, non-corrosive material(s) so that is can withstand acid corrosion, elevated pressure, and other operational stress.

Reaction chamber 118 also includes a reaction chamber outlet 126. Reaction chamber outlet 126 is fluidly connected to carbon dioxide gas inlet 104 of carbon dioxide tank 102 so that carbon dioxide gas produced within reaction chamber 118 may flow into carbon dioxide tank 102. In the illustrated example, reaction chamber outlet 126 and carbon dioxide gas inlet 104 are fluidly connected by a transfer line 164. Accordingly, carbon dioxide gas produced in reaction chamber 118 may exit at reaction chamber outlet 126, flow through transfer line 164, and enter carbon dioxide tank 102 at carbon dioxide gas inlet 104. Transfer line 164 may be any suitable conduit, pipe, or the like. In some embodiments, transfer line 164 may include two or more interconnected conduits (not shown). The one or more conduits, pipes, or the like included in transfer line 164 are preferably constructed of high-strength material(s) that can withstand elevated gas pressure and other operational stress.

In some embodiments, apparatus 100 may include a moisture filter to impede or prevent moisture from entering carbon dioxide tank 102 along with carbon dioxide gas received from reaction chamber 118. Moisture filter may be fluidly connected to carbon dioxide gas inlet 104 of carbon dioxide tank 102 so that it can filter (i.e. remove) moisture from the carbon dioxide gas before it has a chance to enter carbon dioxide tank 102. In the illustrated example, a moisture filter 152 is located along transfer line 164 (proximate to reaction chamber outlet 126). It will be appreciated that one or more moisture filters may be differently located in alternative embodiments, e.g. proximate to carbon dioxide gas inlet 104). Carbon dioxide gas produced in reaction chamber 118 passes through moisture filter 152 as it flows through transfer line 164 toward carbon dioxide gas inlet 104 of carbon dioxide tank 102. In alternative embodiments, apparatus 100 may not include a moisture filter 152.

In the illustrated embodiment, apparatus 100 includes a restriction valve 154 fluidly connected to carbon dioxide gas inlet 104. Restriction valve 154 may act to restrict escape of carbon dioxide gas from carbon dioxide tank 102 at the carbon dioxide gas inlet 104. After carbon dioxide gas has entered carbon dioxide tank 102 at carbon dioxide gas inlet 104, restriction valve 154 may prevent it from escaping carbon dioxide tank 102 at carbon dioxide gas inlet 104. In this context, restriction valve 154 may permit flow of carbon dioxide gas in one direction (i.e. into carbon dioxide tank through carbon dioxide gas inlet 104) while preventing flow of carbon dioxide gas in the opposite direction. As shown, restriction valve 154 is preferably located adjacent to carbon dioxide gas inlet 104. However, in alternative embodiments, it may be located elsewhere along transfer line 164, e.g. proximate to reaction chamber outlet 126. In alternative embodiments, apparatus 100 may not include a restriction valve 154.

Referring still to FIG. 1, reaction chamber 118 includes an acid inlet 120 and a carbonate inlet 122. Acid inlet 120 is fluidly connected to acid supply outlet 112 of acid tank 110. Carbonate inlet 122 is fluidly connected to carbonate supply outlet 116 of carbonate tank 114.

In the illustrated example, acid supply outlet 112 of acid tank 110 and acid inlet 120 of reaction chamber 118 are fluidly connected through acid supply pump 128 and an acid supply line 170. Accordingly, acid may exit acid tank 110 at acid supply outlet 112, flow through acid supply pump 128 and acid supply line 170, and then enter reaction chamber 118 at acid inlet 120. Acid supply pump 128 may act to regulate this flow. Acid supply line 170 may include one or more interconnected conduits, pipes, or the like. As shown, acid supply line 170 includes two interconnected conduits arranged at a right angle. It will be appreciated that many alternative configurations of acid supply line 170 are possible. The one or more conduit, pipes, or the like included in acid supply line 170 are preferably made of non-corrosive material.

As described above, acid supply pump 128 may act to regulate flow of acid from acid tank 110 to reaction chamber 118. For example, acid supply pump 128 may vary speeds in order to control the flow of acid supplied to reaction chamber 118. When acid supply pump 128 is inactive (i.e. off), no acid may be supplied to reaction chamber 118. Acid supply pump 128 may be one of many currently available pumps that are suited for pumping corrosive liquids. As an example, a Hydra-Cell® T200M Series manufactured by Wanner Engineering, Inc. may be used.

In the illustrated example, carbonate supply outlet 116 of carbonate tank 114 and carbonate inlet 122 of reaction chamber 118 are fluidly connected through carbonate supply pump 130 and a carbonate supply line 168. Accordingly, carbonate may exit carbonate tank 114 at carbonate supply outlet 116, flow through carbonate supply pump 130 and carbonate supply line 168, and enter reaction chamber 118 at carbonate inlet 122. Carbonate supply pump 130 may act to regulate this flow. Carbonate supply line 168 may include one or more interconnected conduits, pipes, or the like. As shown, carbonate supply line 168 includes two interconnected conduits arranged at a right angle. It will be appreciated that many alternative configurations of carbonate supply line 168 are possible.

As described above, carbonate supply pump 130 may act to regulate flow of carbonate from carbonate tank 114 to reaction chamber 118. For example, carbonate supply pump 130 may vary speeds in order to control the flow of carbonate supplied to reaction chamber 118. When carbonate supply pump 130 is inactive (i.e. off), no carbonate may be supplied to reaction chamber 118. Carbonate supply pump 130 may be one of many currently available pumps that are designed to pump solids. As an example, a NOTOS®: 4 NS—Geared Twin Screw Pump manufactured by Netzsch Pumps & Systems may be used.

As described above, acid tank 110 holds acid and carbonate tank 114 hold carbonate. As an example, the acid may be acetic acid and the carbonate may be sodium bicarbonate. As another example, the acid may be propionic acid ($CH_3CH_2CO_2H$) and the carbonate may be potassium bicarbonate ($KHCO_3$). As yet another example, the acid may be butyric acid ($CH_3CH_2CH_2CO_2H$) and the carbonate may be sodium carbonate ($Na_2CO_3$). As still yet another example, the acid may be hydrochloric acid (HCl) and the carbonate may be ammonium bicarbonate ($NH_4HCO_3$). It will be appreciated that more combinations of acid and carbonate are possible. For illustrative purposes, the reaction of sodium bicarbonate and acetic acid is described below.

The reaction of sodium bicarbonate ($NaHCO_3$) and acetic acid ($CH_3COOH$ or $HC_2H_3O_2$) may be written as:

$$NaHCO_3(s)+CH_3COOH(l)\rightarrow CO_2(g)+H_2O(l)+Na^+(aq.)+CH_3COO^-(aq.)$$

Where s=solid, l=liquid, g=gas, aq.=aqueous $Na^+$ (aq.) and $CH_3COO^-$ (aq.) readily combine to form sodium acetate which is commonly written as $NaC_2H_3O_2$ (aq.). Consequently, the reaction of sodium bicarbonate and acetic acid may also be written as:

$$NaHCO_3+HC_2H_3O_2\rightarrow NaC_2H_3O_2+H_2O+CO_2$$

This chemical reaction occurs in two steps. First, there is a double displacement reaction in which acetic acid reacts with sodium bicarbonate to form sodium acetate ($NaC_2H_3O_2$) and carbonic acid ($H_2CO_3$):

$$NaHCO_3+HC_2H_3O_2\rightarrow NaC_2H_3O_2+H_2CO_3 \quad (1)$$

Second, carbonic acid ($H_2CO_3$) is unstable and undergoes a decomposition reaction to produce the carbon dioxide gas:

$$H_2CO_3\rightarrow H_2O+CO_2 \quad (2)$$

Accordingly, the reaction of acetic acid and sodium bicarbonate within reaction chamber 118 produces carbon dioxide gas, water and sodium acetate. Water and sodium acetate may be collectively referred to herein as liquid byproducts.

In the illustrated example, apparatus 100 includes a carbon dioxide gas delivery conduit 156 for delivering carbon dioxide gas from carbon dioxide tank 102 to a fire. Carbon dioxide gas delivery conduit 156 extends from a tank end **156*a* to a delivery end 156*b*. Tank end 156*a* is fluidly connected to carbon dioxide gas outlet 106 so that carbon dioxide gas released from carbon dioxide gas outlet 106 of carbon dioxide tank 102 flows through carbon dioxide delivery conduit 156 toward delivery end 156*b*. Delivery end 156*b* may be positioned/oriented (e.g. by a firefighter) so that carbon dioxide gas flowing through carbon dioxide delivery conduit 156 is delivered to a targeted area of the fire. Carbon dioxide gas delivery conduit 156** is preferably constructed of high-strength material(s) that can withstand elevated gas pressure and other operational stress.

Carbon dioxide gas delivery control valve 132 is fluidly connected to carbon dioxide gas outlet 106 so that it may act to regulate release of carbon dioxide gas from carbon dioxide tank 102. For example, carbon dioxide gas delivery control valve 132 may operate between an open position in which carbon dioxide gas exits carbon dioxide gas outlet 106 and a closed position in which carbon dioxide gas is prevented from exiting carbon dioxide gas outlet 106.

Carbon dioxide gas delivery control valve 132 may be located at any suitable point along carbon dioxide gas delivery conduit 156. In the illustrated example, carbon dioxide gas delivery control valve 132 is located proximate to carbon dioxide gas outlet 106. It may be differently located in alternative embodiments. For example, carbon dioxide gas delivery control valve 132 may be located at delivery end **156*b* of carbon dioxide gas delivery conduit 156. Alternatively, carbon dioxide gas delivery control valve 132 may be directly connected to carbon dioxide gas outlet 106**.

Figure 2:
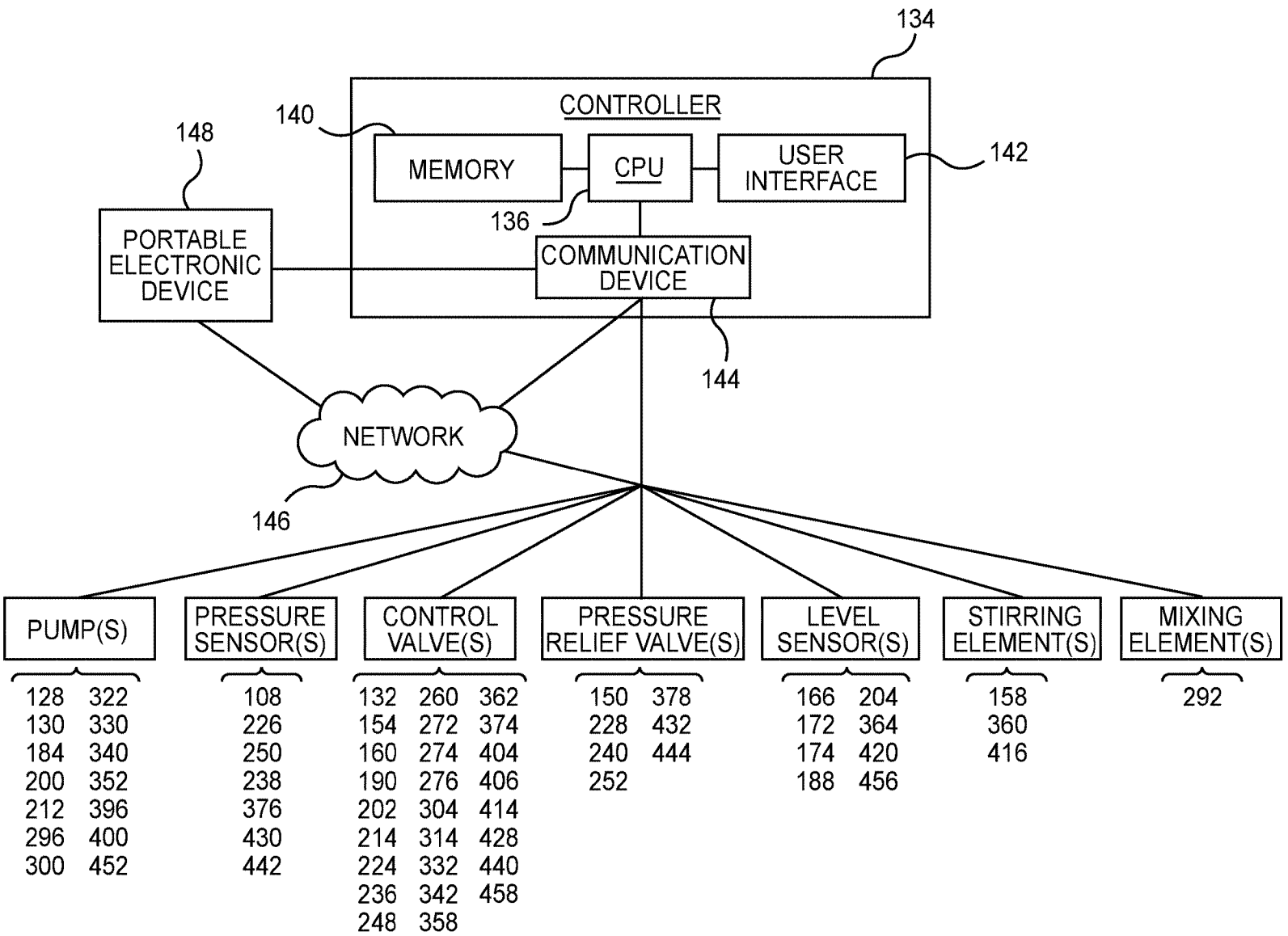
FIG. 2 is a schematic diagram of a controller of a firefighting apparatus communicatively coupled to a number of other components of the firefighting apparatus and a portable electronic device.

Reference is now made to FIG. 2, which shows controller 134 communicatively coupled to pressure sensor(s) 108, acid supply pump 128, carbonate supply pump 130 and carbon dioxide gas delivery control valve 132. Controller 134 may be communicatively connected to one or more of pressure sensor(s) 108, acid supply pump 128, carbonate supply pump 130 and carbon dioxide gas delivery control valve 132 through a physical connection (i.e. wired connection). Alternatively, or in addition, controller 134 may be communicatively connected to one or more of pressure sensor(s) 108, acid supply pump 128, carbonate supply pump 130 and carbon dioxide gas delivery control valve 132 through a wireless connection (e.g. over wireless network 146). As will be described below, controller 134 may regulate production of carbon dioxide gas within reaction chamber 118 by controlling operation of acid supply pump 128 and carbonate supply pump 130. Controller 134 may also regulate release of carbon dioxide gas from carbon dioxide tank 102 at carbon dioxide gas outlet 106 by controlling operation of carbon dioxide gas delivery control valve 132.

In the illustrated example, controller 134 includes a processor 136, memory 140, user interface 142 and communication device 144. In some embodiments, controller 134 includes multiple of any one or more (or all) of processor 136, memory 140, user interface 142 and communication device 144. In some embodiments, controller 134 does not include one or more of memory 140, user interface 142 and communication device 144. For example, controller 134 may not include a user interface 142, and/or may not include a communication device 144. Each of memory 140, user interface 142 and communication device 144 are communicatively coupled to processor 136, directly or indirectly. Preferably, controller 134 is a single, unitary device having a housing 138 (FIG. 1) that houses all of its subcomponents (processor 136, memory 140, etc.). However, in alternative embodiments, controller 134 may be composed of two or more discrete devices that are communicatively coupled to each other, that collectively include all of the subcomponents of controller 134 (processor 136, memory 140, etc.), and that collectively provide the functionality described herein.

Referring still to FIG. 2, memory 140 can include volatile memory (e.g. random access memory (RAM)) or non-volatile storage (e.g. ROM, flash memory, hard disk drive, solid state drive, or other types of non-volatile data storage). In some embodiments, memory 140 stores one or more applications for execution by processor 136. The applications correspond with software modules including computer executable instructions to perform processing for the functions and methods described below. In some embodiments, some or all of memory 140 may be integrated with processor 136. For example, processor 136 may be a microcontroller (e.g. Microchip™ AVR, Microchip™ PIC, or ARM™ microcontroller) with onboard volatile and/or non-volatile memory.

Generally, processor 136 can execute applications, computer readable instructions or programs. The applications, computer readable instructions or programs can be stored in memory 140 or can be received from a remote storage device (not shown) across wireless network 146 or another suitable IP network (e.g. local access network LAN). When executed, the applications, computer readable instructions or programs can configure the processor 136 (or multiple processors 136, collectively) to perform the acts described herein with reference to pumps (e.g. acid supply pump 128), control valves (e.g. carbon dioxide gas delivery control valve 132, and other components of apparatus 100.

User interface 142 can include any type of device for presenting visual information and/or entering user commands. For example, user interface 142 may include user operable controls (e.g. directional buttons, dials, keypads, and the like) that a firefighter can press to signal controller 134 to activate one or more pumps and/or control valves of apparatus 100. That is, user interface 142 may send control signals to controller 134, and in response, controller 134 may activate carbon dioxide gas delivery control valve 132, acid supply pump 128 and/or carbonate supply pump 130 in accordance with the control signals. In the illustrated example, user interface 142 includes multiple gauges (e.g. to display pressure readings and dials (e.g. to control pumps and valves of apparatus 100). Alternatively, user interface 142 can be a touchscreen display panel.

In some embodiments, user interface 142 may include a microphone through which one or more firefighters may issue voice commands to processor 136. In these embodiments, processor 136 may execute voice recognition software (e.g. stored in memory 140) that allows it to interpret the received voice commands.

Referring still to FIG. 2, communication device 144 may include one or more of output ports, wireless radios and network adapters (e.g. Bluetooth®, RFID, NFC, 802.11x, etc.) for making wired and wireless connections to portable electronic device 148 as well as acid and carbonate supply pumps 128 and 130, pressure sensor(s) 108, and carbon dioxide gas delivery control valve 132. Portable electronic device 148 may include a smart phone, tablet or notebook computer, for example. At any given time, multiple portable electronic devices 148 may be communicatively connected to controller 134. For example, each firefighter may have their own portable electronic device 148 that is communicatively coupled to the controller 134.

In at least one embodiment, communication device 144 is connectable to portable electronic device 148 across a network, such as wireless network 146, for example. In these embodiments, portable electronic device 148 is portable in a sense that its user may be located remotely from controller 134. For example, portable electronic device 148 may be attached to the forearm of a firefighter (e.g. with a strap) for convenient hands-free use. Alternatively, or in addition, communication device 144 may be connectable to portable electronic device 148 through a wired connection (e.g. USB cable).

Controller 134 may exchange signals and data with portable electronic device 148. Similar to user interface 142, portable electronic device 148 may include user operable controls (e.g. a touchscreen) that a firefighter can press to signal controller 134 to activate one or more pumps and/or control valves of apparatus 100. That is, portable electronic device 148 may send control signals to controller 134, and in response, controller 134 may activate carbon dioxide gas delivery control valve 132, acid supply pump 128 and/or carbonate delivery pump 130 in accordance with the control signals.

In some embodiments, a firefighter may be able to issue voice commands to processor 136 through a microphone that is communicatively connected to user electronic device 148 (e.g. by Bluetooth protocol). The microphone may be attached to the firefighter's helmet, for example. In these embodiments, the firefighter may not need to use either hand to enter commands, thereby freeing up their hands to focus on other tasks. As described above, processor 136 may execute voice recognition software (e.g. stored in memory 140) that allows it to interpret the received voice commands.

In response to receiving a user command signal, processor 136 may be configured to:

(i) receive, from pressure sensor(s) 108, an input signal including the carbon dioxide tank pressure, (ii) transmit a control signal to acid supply pump 128 instructing it to act according to at least one of the carbon dioxide tank pressure and the user command signal, (iii) transmit a control signal to carbonate supply pump 130 instructing it to act according to at least one of the carbon dioxide tank pressure and the user command signal, and/or (iv) transmit a control signal to carbon dioxide gas delivery control valve instructing it to act according to at least one of the carbon dioxide tank pressure and the user command signal.

Processor 136 may be able to receive multiple user command signals simultaneously and/or in quick succession. The user command signal may include a carbon dioxide gas delivery pressure. For example, with user interface 142 and/or portable electronic device 148, a firefighter may request that carbon dioxide gas at a carbon dioxide delivery pressure of 10 bars be released from delivery end **156*b* of carbon dioxide gas delivery conduit 156. Subsequently, processor 136 may receive a user command signal from user interface 142 that includes that carbon dioxide gas delivery pressure. If carbon dioxide tank 102 has sufficient carbon dioxide gas pressure to meet the requested carbon dioxide delivery pressure (e.g. 10 bars), controller 134 may instruct carbon dioxide gas delivery valve to act (i.e. open) so that carbon dioxide gas at a delivery pressure of 10 bars is released from delivery end 156*b* of carbon dioxide gas delivery conduit 156. As the pressure in carbon dioxide tank 102 drops while carbon dioxide gas is released, controller 134 may instruct acid supply pump 128 and carbonate supply pump 130 to supply reaction chamber 118 with acid and carbonate, respectively. A precise supply of acid and carbonate to reaction chamber 118 may be controlled by controller 134 so that carbon dioxide gas is produced in sufficient quantity for carbon dioxide tank 102** to continue delivering carbon dioxide gas at the requested delivery pressure.

Alternatively, if carbon dioxide tank 102 has insufficient carbon dioxide gas pressure to deliver carbon dioxide gas at the requested carbon dioxide delivery pressure (e.g. 10 bars), controller 134 may instruct acid supply pump 128 and carbonate supply pump 130 to correspondingly supply reaction chamber 118 with acid and carbonate. A precise supply of acid and carbonate to reaction chamber 118 may be controlled by controller 134 so that carbon dioxide gas is produced in sufficient quantity for carbon dioxide tank 102 to deliver (and keep delivering) carbon dioxide gas at the requested carbon dioxide gas delivery pressure.

Carbon dioxide gas may be used to suppress Class B and/or Class C fires. As described above, carbon dioxide gas from carbon dioxide tank 102 may be directed at a fire by orienting delivery end 156*b* of carbon dioxide gas delivery conduit 156 toward the fire. The carbon dioxide gas may replace the fire's oxygen and thereby suffocate the fire. Since the carbon dioxide gas is stored in carbon dioxide tank 102 under pressure, it may be well below room temperature upon its release. Accordingly, when delivered to the fire, the "cold" carbon dioxide may absorb heat and thereby further suppress the fire.

In some embodiments, memory 140 of controller 134 may store a baseline carbon dioxide tank pressure. The baseline carbon dioxide tank pressure may be a pressure level that controller 134 seeks to continuously maintain within carbon dioxide tank 102. For example, if the baseline carbon dioxide tank pressure is 15 bars, controller 134 may control operation (i.e. the speed) of acid supply pump 128 and carbonate supply pump 130 so as to supply reaction chamber 118 with the necessary quantity of acid and carbonate to maintain the baseline carbon dioxide tank pressure of 15 bars. The baseline carbon dioxide tank pressure may be adjusted as desired (e.g. with user interface 142 and/or portable electronic device 148).

Processor 136 may be configured to transmit a control signal to both carbonate supply pump 130 and the acid supply pump 128 that instructs each to act according to a comparison between the baseline carbon dioxide tank pressure and carbon dioxide tank pressure. As an example, the control signal may instruct acid supply pump 128 and carbonate supply pump 130 to operate while the carbon dioxide tank pressure is below the baseline carbon dioxide tank pressure. Accordingly, while the carbon dioxide tank pressure is below the baseline carbon dioxide tank pressure, acid supply pump 128 and carbonate supply pump 130 may be instructed to correspondingly supply the reaction chamber 118 with acid and carbonate to return the carbon dioxide tank pressure to the baseline.

In some embodiment, controller 134 may instruct acid supply pump 128 and carbonate supply pump 130 to operate according to a difference between the baseline carbon dioxide tank pressure and the carbon dioxide tank pressure. For example, the control signal transmitted by processor 136 may instruct acid supply pump 128 and carbonate supply pump 130 to operate at a faster speed when the difference between the baseline carbon dioxide tank pressure and the carbon dioxide tank pressure is greater compared to when it is smaller. As yet another example, the control signal transmitted by processor 136 may instruct acid supply pump 128 and carbonate supply pump 130 to turn off (or remain off) while the carbon dioxide tank pressure is at or above the baseline carbon dioxide tank pressure.

Returning to FIG. 1, carbon dioxide tank 102 includes a pressure relief valve 150 that may act to regulate release of pressure from carbon dioxide tank 102. For example, pressure relief valve 150 may operate between (i) an open position that allows carbon dioxide gas to escape and (ii) a closed position that blocks escape of carbon dioxide gas. Pressure relief valve 150 may be communicatively coupled to controller 134 (FIG. 2) so that its operation is controllable by controller 134. Controller 134 may control operation of pressure relief valve 150 in an automated fashion. Processor 136 may be further configured to:

transmit a control signal to pressure relief valve 150 instructing it to act according to the carbon dioxide tank pressure.

The control signal transmitted to pressure relief valve 150 may instruct it to operate in the open position (i.e. to release carbon dioxide gas) while the carbon dioxide tank pressure exceeds a carbon dioxide tank pressure threshold. For example, the carbon dioxide tank pressure threshold may be the pressure rating of carbon dioxide tank 102 or another safety limit. Accordingly, as a safety measure, pressure relief valve 150 may act (i.e. open and close) to keep the carbon dioxide tank pressure below the carbon dioxide tank pressure threshold. In at least one embodiment, the carbon dioxide tank pressure threshold may be stored in memory 140 of controller 134. In these embodiments, the carbon dioxide tank pressure threshold may be adjusted as desired (e.g. with user interface 142 and/or portable electronic device 148). In the event pressure sensor(s) 108 malfunction (or become inoperable for any reason), pressure relief valve 150 may automatically open when the pressure inside carbon dioxide tank 102 surpasses an upper pressure limit (i.e. by shear mechanical force of the gas pressure).

In the illustrated example, apparatus 100 also includes a carbonate supply control valve 160 that may act to further regulate flow of carbonate from carbonate tank 114 to reaction chamber 118. In this way, carbonate supply control valve 160 and carbonate supply pump 130 may work together to regulate flow of carbonate from carbonate tank 114 to reaction chamber 118. Carbonate supply control valve 160 may be communicatively coupled to controller 134 (FIG. 2) so that its operation is controllable by controller 134. Controller 134 may control operation of carbonate supply control valve 160 in an automated fashion. Alternatively, apparatus 100 may not include a carbonate supply control valve 160.

Referring still to FIG. 1, carbonate supply control valve 160 may be located at any point along carbonate supply line 168. In the illustrated example, carbonate supply control valve 160 is located downstream of carbonate supply pump 130. In this location, carbonate supply control valve 160 may act to "fine-tune" the flow of carbonate between carbonate supply pump 130 and reaction chamber 118. Alternatively, carbonate supply control valve 160 may be located proximate to carbonate inlet 122 of reaction chamber 118. Carbonate supply control valve 160 may operate between an open position that allows passage of carbonate from carbonate supply pump 130 to reaction chamber 118 and a closed position that blocks passage of carbonate from carbonate supply pump 130 to reaction chamber 118.

In response to receiving the user command signal, processor 136 may be further configured to:

transmit a control signal to carbonate supply control valve 160 instructing it to act according to at least one of the carbon dioxide tank pressure and the user command signal.

As an example, the control signal transmitted to carbonate supply control valve 160 may instruct it to operate in the closed position while carbonate supply pump 130 is not operating (i.e. off). Accordingly, while carbonate supply pump 130 is off, carbonate supply control valve 160 may operate in the closed position to block passage of carbonate through carbonate supply line 168. Such an arrangement may effectively seal carbonate supply line 168 downstream of carbonate supply control valve 160. This may provide one or more advantages. For example, while carbonate supply control valve 160 operates in the closed position, it may limit or block carbonate that leaks from carbonate supply pump 130 from pooling in carbonate supply line 168 and/or entering reaction chamber 118 inadvertently.

In the illustrated example, apparatus 100 also includes an acid supply control valve 162 that may act to further regulate flow of acid from acid tank 110 to reaction chamber 118. In this way, acid supply control valve 162 and acid supply pump 128 may work together to regulate flow of acid from acid tank 110 to reaction chamber 118. Acid supply control valve 162 may be communicatively coupled to controller 134 (FIG. 2) so that its operation is controllable by controller 134. Controller 134 may control operation of acid supply control valve 162 in an automated fashion. Alternatively, apparatus 100 may not include an acid supply control valve 162.

Referring still to FIG. 1, acid supply control valve 162 may be located at any point along acid supply line 170. In the illustrated example, acid supply control valve 162 is located downstream of acid supply pump 128. In this location, acid supply control valve 162 may act to "fine-tune" the flow of acid between acid supply pump 128 and reaction chamber 118. Alternatively, acid supply control valve 162 may be located proximate to acid inlet 120 of reaction chamber 118. Acid supply control valve 162 may operate between an open position that allows passage of acid from acid supply pump 128 to reaction chamber 118 and a closed position that blocks passage of acid from acid supply pump 128 to reaction chamber 118.

In response to receiving the user command signal, processor 136 may be further configured to:

transmit a control signal to acid supply control valve 162 instructing it to act according to at least one of the carbon dioxide tank pressure and the user command signal.

As an example, the control signal transmitted to acid supply control valve 162 may instruct it to operate in the closed position while acid supply pump 128 is not operating (i.e. off). Accordingly, while acid supply pump 128 is off, acid supply control valve 162 may operate in the closed position to block passage of acid through acid supply line 170. Such an arrangement may effectively seal acid supply line 170 downstream of acid supply control valve 162. This may provide one or more advantages. For example, while acid supply control valve 162 operates in the closed position, it may limit or block acid that leaks from acid supply pump 128 from pooling in acid supply line 170 and/or entering reaction chamber 118 inadvertently.

Figure 3:
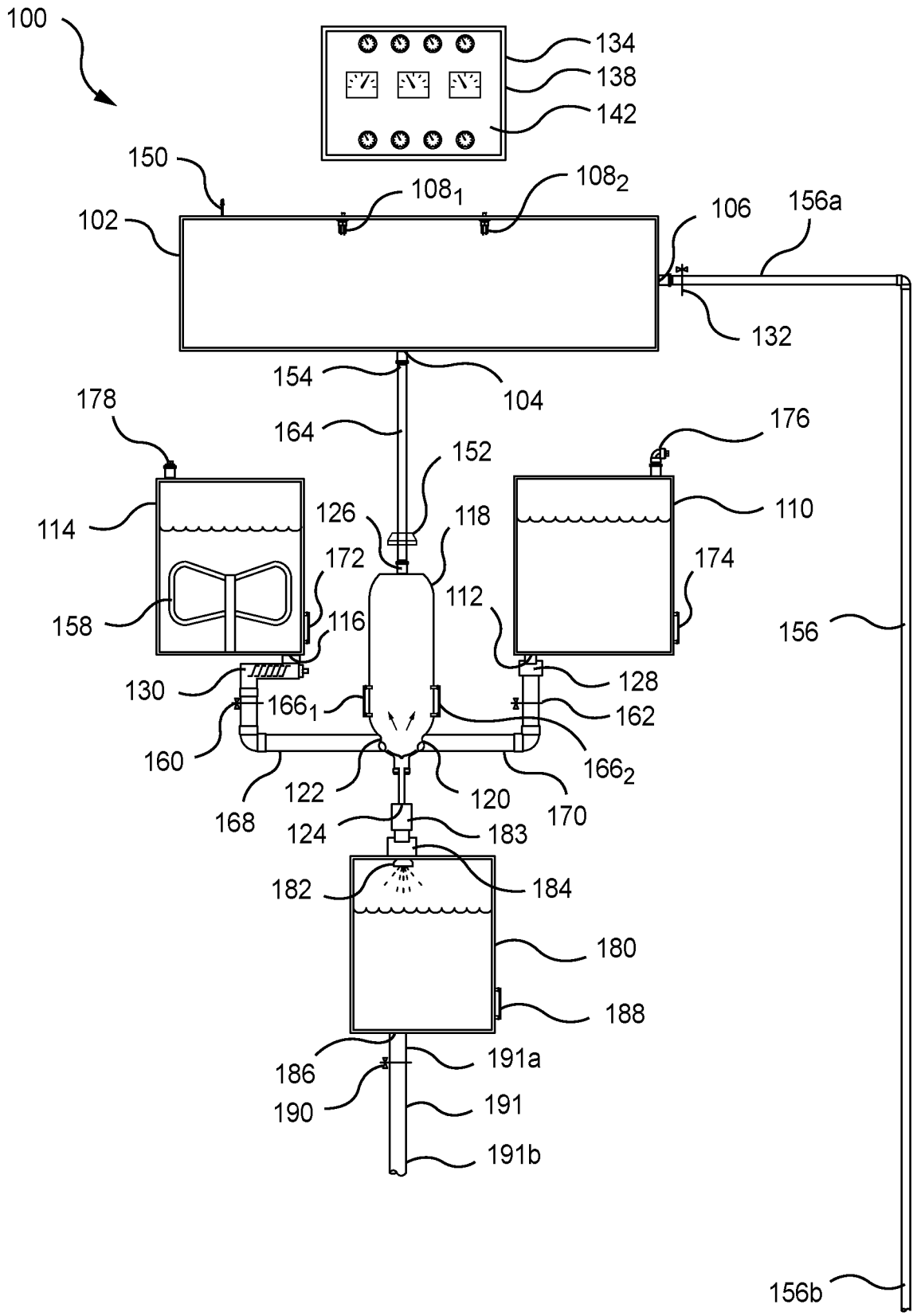
FIG. 3 is a schematic diagram illustrating a firefighting apparatus in accordance with an alternative embodiment.

Reference is now made to FIG. 3, which illustrates another apparatus 100 for fighting fires. Apparatus 100 illustrated in FIG. 3 is analogous to apparatus 100 illustrated in FIG. 1, except for the additional elements and/or features described below. Unless otherwise noted, elements having the same reference numeral have similar structure and/or perform similar function as those in apparatus 100 illustrated in FIG. 1.

As shown, apparatus 100 includes a liquid byproduct pump 184 that may act to regulate release of liquid byproduct from liquid byproduct release outlet 124 of reaction chamber 118. For example, liquid byproduct pump 184 may vary speeds in order to control flow of liquid byproduct released from reaction chamber 118 at liquid byproduct release outlet 124. Liquid byproduct pump 184 may be communicatively coupled to controller 134 (FIG. 2) so that its operation is controllable by controller 134. Liquid byproduct pump 184 may be one of many currently available pumps that are suited for pumping corrosive materials. As an example, a Hydra-Cell® T100 M Series manufactured by Wanner Engineering, Inc. may be used.

Liquid byproduct pump 184 may be activated periodically (e.g. every 10 minutes) to release liquid byproduct from reaction chamber 118. Excessive liquid byproduct in reaction chamber 118 can slow and otherwise impede the reaction of carbonate and acid. By actively pumping liquid byproduct out of reaction chamber 118, liquid byproduct pump 184 may alleviate such occurrences. In addition, by providing an active means to regulate release of liquid byproduct from reaction chamber 118, reaction chamber 118 may be more compact than it might otherwise have been without liquid byproduct pump 184.

Referring still to FIG. 3, reaction chamber 118 may include at least one level sensor 166 for measuring a liquid byproduct level within reaction chamber 118. In the illustrated example, reaction chamber 118 includes two level sensors $\mathbf{166}_1$ and $\mathbf{166}_2$. Each level sensor 166 may be communicatively coupled to controller 134 (FIG. 2). Level sensor(s) 166 may be one of many currently available level sensors. As an example, level sensors 166 may be a FL-LL—Ultrasonic Liquid Level Sensor manufactured by SMD Fluid Controls. Ultrasonic liquid level sensors work by emitting and detecting the reverberations of high frequency sound waves. Although level sensors 166 are shown located on the side of reaction chamber 118, ultrasonic liquid sensors are preferably located at the top of reaction chamber 118.

In alternative embodiments, reaction chamber 118 may include additional level sensors 166, e.g. 3 to 6, or more. The inclusion of multiple level sensors 166 within reaction chamber 118 may provide one or more advantages. For example, if one or more malfunction, the remaining level sensor(s) 166 may still operate to measure the liquid byproduct level within reaction chamber 118. Depending on the application of apparatus 100, reaction chamber 118 may experience shifts in orientation. Reaction chamber 118 is shown right-side up in FIG. 1. However, it may be oriented sideways (i.e. rotated 90° relative to FIG. 1) or in other orientations. Accordingly, the inclusion of level sensors 166 on multiple sides of reaction chamber 118, e.g. as shown with level sensors $\mathbf{166}_1$ and $\mathbf{166}_2$, may allow the liquid byproduct level to be reliably measured across a wide range of reaction chamber 118 orientations. Alternatively, reaction chamber 118 may not include level sensor(s) 166.

Processor 136 may be further configured to:

(i) receive, from level sensor(s) 166 of reaction chamber 118, an input signal including the liquid byproduct level within reaction chamber 118, and (ii) transmit a control signal to liquid byproduct pump 184 instructing it to act according to the liquid byproduct level within reaction chamber 118.

As an example, the control signal transmitted to liquid byproduct pump 184 may instruct it to act (i.e. operate) while the liquid byproduct level within reaction chamber 118 exceeds a reaction chamber level limit. In this way, liquid byproduct pump 184 may be turned on in order to keep the liquid byproduct level at or below the reaction chamber level limit.

In some embodiments, processor 136 may be further configured to:

transmit a control signal to acid supply pump 128 and carbonate supply pump 130 that instructs each to act according to the liquid byproduct level within reaction chamber 118.

As an example, the control signal transmitted to both acid supply pump 128 and carbonate supply pump 130 may instruct each to turn off (or remain off) while the liquid byproduct level within reaction chamber 118 exceeds a reaction chamber high level limit. The reaction chamber high level limit may be higher than the reaction chamber level limit. In this case, the reaction chamber high level limit may represent an additional safety precaution. For example, there may be a case in which liquid byproduct pump 184 is unable to keep the liquid byproduct level within reaction chamber 118 below the reaction chamber level limit. Accordingly, once the liquid byproduct level exceeds the reaction chamber high level limit, controller 134 may instruct acid supply pump 128 and carbonate supply pump 130 to turn off so that further liquid byproduct is not produced in reaction chamber 118. Alternatively, in the event liquid byproduct pump 184 fails or malfunctions, the reaction chamber high level limit may be a "cut off level" used to stop operation of both acid supply pump 128 and carbonate supply pump 130 before reaction chamber 118 reaches its max capacity. Alternatively, the reaction chamber level limit and the reaction chamber high level limit may be the same.

In at least one embodiment, the reaction chamber level limit and the reaction chamber high level limit may be stored in memory 140 of controller 134. In these embodiments, the reaction chamber level limit and reaction chamber high level limit may each be adjusted as desired (e.g. with user interface 142 and/or portable electronic device 148).

Referring still to FIG. 3, apparatus 100 includes a liquid byproduct tank 180 that collects liquid byproduct released from liquid byproduct release outlet 124 of reaction chamber 118. In the illustrated example, liquid byproduct tank 180 includes a liquid byproduct inlet 182 fluidly connected to liquid byproduct release outlet 124 of reaction chamber 118 so that liquid byproduct released from reaction chamber 118 may collect in liquid byproduct tank 180. Liquid byproduct tank 180 is preferably constructed from high-strength, non-corrosive materials (e.g. stainless steel, aluminum alloy etc.) so that it can withstand acid corrosion and other operational stress.

In the illustrated example, liquid byproduct release outlet 124 of reaction chamber 118 and liquid byproduct inlet 182 of liquid byproduct tank 180 are fluidly connected through liquid byproduct release line 183 and liquid byproduct pump 184. Accordingly, liquid byproduct may exit reaction chamber 118 at liquid byproduct release outlet 124, flow through liquid byproduct release line 183 and liquid byproduct pump 184, and enter liquid byproduct tank 180 at liquid byproduct inlet 182. As described above, liquid byproduct pump 184 may act to regulate this flow. Liquid byproduct release line 183 may be any non-corrosive conduit, pipe, or the like. It will be appreciated that many alternative configurations of liquid byproduct release line 183 are possible.

Referring still to FIG. 3, liquid byproduct tank 180 includes a liquid byproduct discharge outlet 186. Liquid byproduct within liquid byproduct tank 180 may be discharged through liquid byproduct discharge outlet 186. Apparatus 100 also includes a liquid byproduct discharge conduit 191 for discharging liquid byproduct from liquid byproduct tank 180. Liquid byproduct discharge conduit 191 extends from a tank end 191*a* to a discharge end 191*b*. Tank end 191*a* is fluidly connected to liquid byproduct discharge outlet 186 so that liquid byproduct released from liquid byproduct discharge outlet 186 of liquid byproduct tank 180 flows through liquid byproduct discharge conduit 191 toward discharge end 191*b*. Discharge end 191*b* may be positioned/oriented so that liquid byproduct flowing through liquid byproduct discharge conduit 191 is appropriately disposed.

Apparatus 100 also includes a liquid byproduct discharge control valve 190 that may act to regulate flow of liquid byproduct through liquid byproduct discharge conduit 191. Liquid byproduct discharge control valve 190 may operate between an open position that allows passage of liquid byproduct through liquid byproduct discharge conduit 191 and a closed position that blocks passage of liquid byproduct through liquid byproduct discharge conduit 191. Liquid byproduct discharge control valve 190 may be communicatively coupled to controller 134 (FIG. 2) so that its operation is controllable by controller 134.

Liquid byproduct discharge control valve 190 may be located at any suitable point along liquid byproduct discharge conduit 191. In the illustrated example, liquid byproduct discharge control valve 190 is located proximate to liquid byproduct discharge outlet 186 of liquid byproduct tank 180. It may be differently located in alternative embodiments. For example, liquid byproduct discharge control valve 190 may be located at discharge end 191*b* of liquid byproduct discharge conduit 191. Alternatively, liquid byproduct discharge control valve 190 may be directly connected to liquid byproduct discharge outlet 186.

Referring still to FIG. 3, liquid byproduct tank 180 includes a level sensor 188 for measuring a liquid byproduct level within liquid byproduct tank 180. Level sensor 188 may be communicatively coupled to controller 134 (FIG. 2). Level sensor 188 may be one of many currently available level sensors. As an example, level sensor 188 may be a FL-LL—Ultrasonic Liquid Level Sensor manufactured by SMD Fluid Controls. Ultrasonic liquid level sensors work by emitting and detecting the reverberations of high frequency sound waves. Although level sensor 188 is shown located on the side of liquid byproduct tank 180, an ultrasonic liquid sensor is preferably located at the top of liquid byproduct tank 180.

In alternative embodiments, liquid byproduct tank 180 may include multiple level sensors 188, e.g. 2 to 6, or more. The inclusion of multiple level sensors 188 within liquid byproduct tank 180 may provide one or more advantages. For example, if one or more malfunction, the remaining level sensor(s) 188 may still operate to measure the liquid byproduct level within liquid byproduct tank 180. Depending on the application of apparatus 100, liquid byproduct tank 180 may experience shifts in orientation. Liquid byproduct tank 180 is shown right-side up in FIG. 3. However, it may be oriented sideways (i.e. rotated 90° relative to FIG. 3) or in other orientations. Accordingly, the inclusion of level sensors 188 on multiple sides of liquid byproduct tank 180 may allow the liquid byproduct level to be reliably measured across a wide range of liquid byproduct tank 180 orientations. Alternatively, liquid byproduct tank 180 may not include level sensor(s) 188.

Processor 136 may be further configured to:

(i) receive, from level sensor(s) 188 of liquid byproduct tank 180, a input signal including the liquid byproduct level within liquid byproduct tank 180, and (ii) transmit a control signal to liquid byproduct discharge control valve 190 instructing it to act according to the liquid byproduct level within liquid byproduct tank 180.

The control signal transmitted to liquid byproduct discharge control valve 190 may instruct it to operate in the open position (i.e. to discharge liquid byproduct) while the liquid byproduct level within liquid byproduct tank 180 exceeds a liquid byproduct high level limit. For example, the liquid byproduct high level limit may be set slightly below the capacity of liquid byproduct tank 180. Accordingly, as a safety measure, controller 134 may instruct liquid byproduct discharge control valve 190 to operate in the open position in order to keep the liquid byproduct level within liquid byproduct tank 180 below its maximum capacity. In at least one embodiment, the liquid byproduct high level limit may be stored in memory 140 of controller 134. In these embodiments, the liquid byproduct high level limit may be adjusted as desired (e.g. with user interface 142 and/or portable electronic device 148).

Referring still to FIG. 3, carbonate tank 114 and acid tank 110 each include a corresponding level sensor 172 and 174 for measuring a carbonate level within carbonate tank 114 and an acid level within acid tank 110. Both level sensors 172 and 174 may be communicatively coupled to controller 134 (FIG. 2). Each level sensor 172 and 174 may be one of many currently available pressure sensors. As an example, each level sensor 172 and 174 may be a FL-LL—Ultrasonic Liquid Level Sensor manufactured by SMD Fluid Controls. As described above, ultrasonic liquid level sensors work by emitting and detecting the reverberations of high frequency sound waves. Although level sensors 172 and 174 are shown located on respective sides of carbonate tank 114 and acid tank 110, ultrasonic liquid sensors are preferably located at the top of carbonate tank 114 and acid tank 110.

In alternative embodiments, one or both carbonate tank 114 and acid tank 110 may include additional level sensors, e.g. 2 to 6, or more. For example, in an alternative embodiment, carbonate tank 114 may include three level sensors 172 and acid tank 110 may include six level sensors 174. The inclusion of multiple level sensors 172 and 174 within carbonate tank 114 and acid tank 110, respectively, may provide one or more advantages. For example, if one or more malfunction, the remaining level sensor(s) 172 and 174 may still operate to correspondingly measure the carbonate level within carbonate tank 114 and the acid level within the acid tank 110. Depending on the application of apparatus 100, one or both carbonate tank 114 and acid tank 110 may experience shifts in orientation. Both carbonate tank 114 and acid tank 110 are shown right-side up in FIG. 3. However, one or both may be oriented sideways (i.e. rotated 90° relative to FIG. 3) or in other orientations. Accordingly, the inclusion of level sensors 172 and 174 on multiple sides of carbonate tank 114 and acid tank 110, respectively, may allow the carbonate and the acid level to be reliably measured across a wide range of carbonate tank 114 and/or acid tank 110 orientations. Alternatively, one or both carbonate tank 114 and acid tank 110 may not include level sensor(s).

Processor 136 may be further configured to:

(i) receive, from level sensor(s) 172 of carbonate tank 114, an input signal including the carbonate level within carbonate tank 114, (ii) transmit a control signal to carbonate supply pump 130 instructing it to act according to the carbonate level within carbonate tank 114, (iii) receive, from level sensor(s) 174 of acid tank 110, an input signal including the acid level within acid tank 110, and/or (iv) transmit a control signal to acid supply pump 128 instructing it to act according to the acid level within acid tank 110.

As an example, the control signal transmitted to carbonate supply pump 130 may instruct it to turn off (or remain off) while the carbonate level within carbonate tank 114 is below a carbonate low level limit. Accordingly, when the carbonate level within carbonate tank 114 is too low, controller 134 may prevent carbonate supply pump 130 from operating (i.e. turning on). Similarly, the control signal transmitted to acid supply pump 128 may instruct it to turn off (or remain off) while the acid level within acid tank 110 is below an acid low level limit. Accordingly, when the acid level within acid tank 110 is too low, controller 134 may prevent acid supply pump 128 from operating (i.e. turning on). In some embodiments, the carbonate low level limit and the acid low level limit may each be stored in memory 140 of controller 134. In these embodiments, the carbonate low level limit and the acid low level limit may each be adjusted as desired (e.g. with user interface 142 and/or portable electronic device 148).

In some embodiments, processor 136 may receive input signals that include the carbonate level and the acid level from corresponding level sensors 172 and 174 every minute (or another set time interval, e.g. every 5 seconds). Accordingly, processor 136 may be able to monitor the carbonate level and the acid level over time. In response to determining that one of i) the acid level is below the acid low level limit and ii) the carbonate level is below the carbonate low level limit, processor 136 may be configured to transmit a signal that includes a low material warning. This signal may be transmitted to user interface 142 in which case the low material warning may take the form of a flashing light or an auditory alert, for example. Alternatively, or in addition, this signal may be transmitted to portable electronic device 148 in which case the low material warning may take the form of a text message, for example. As an example, if the low material warning corresponds to the acid level, acid tank 110 may be refilled with acid at loading port 176.

Figure 4:
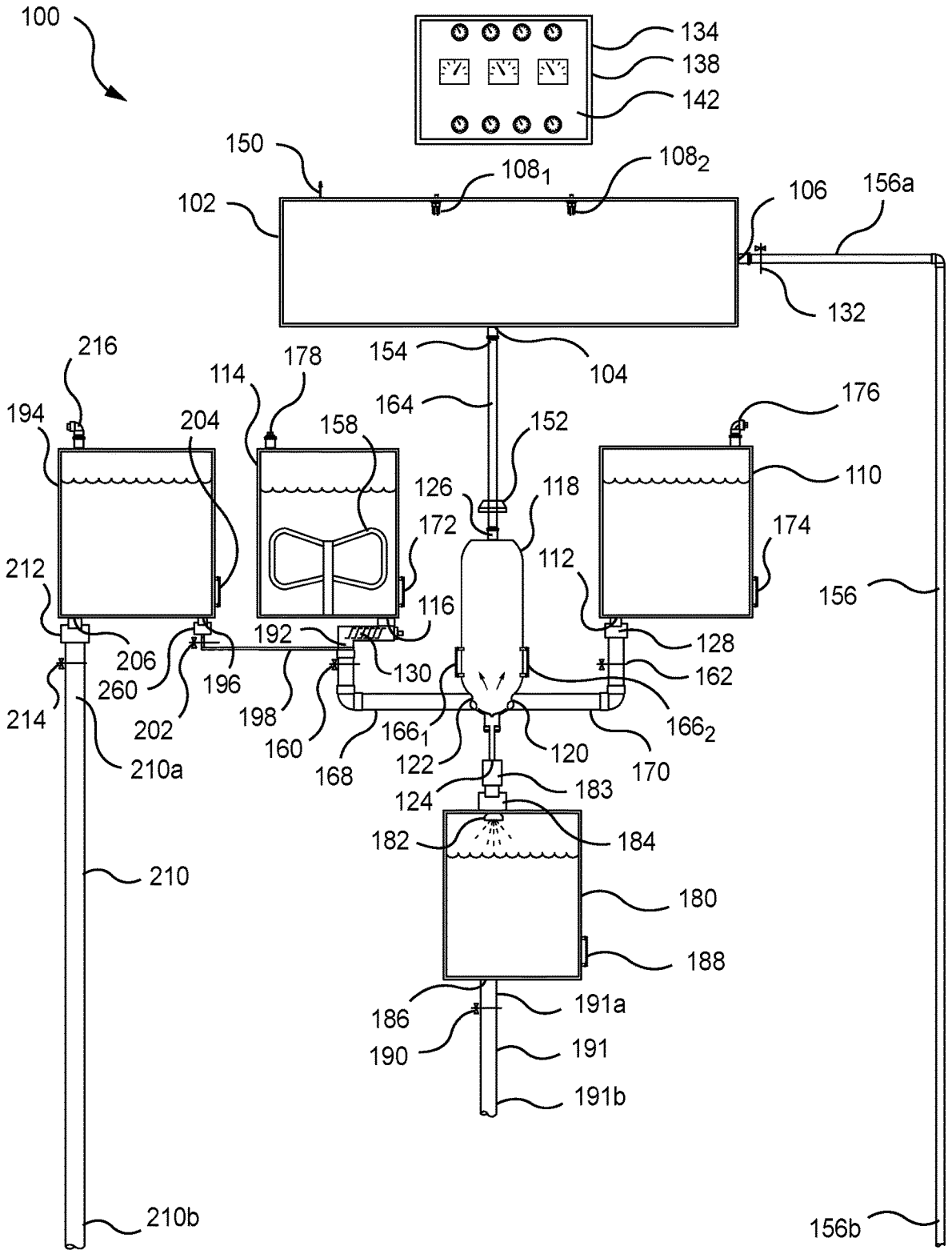
FIG. 4 is a schematic diagram illustrating a firefighting apparatus in accordance with an alternative embodiment.

Reference is now made to FIG. 4, which illustrates another apparatus 100 for fighting fires. Apparatus 100 illustrated in FIG. 4 is analogous to apparatus 100 illustrated in FIG. 3, except for the additional elements and/or features described below. Unless otherwise noted, elements having the same reference numeral have similar structure and/or perform similar function as those in apparatus 100 illustrated in FIG. 3.

As shown, apparatus 100 includes a water tank 194 for holding water. Water tank 194 is preferably constructed from high-strength materials (e.g. titanium, stainless steel, etc.) so that it has the durability to withstand operational stress. In the illustrated example, water tank 194 includes a loading port 216 that may be used to refill water tank 194 with water. For example, loading port 216 may be connected to a loading device (not shown) in order to refill water tank 194 with water.

Water tank 194 may be fluidly connected to carbonate supply line 168. Water tank 194 includes a water supply outlet 196 that fluidly connects water tank 194 to carbonate supply line 168, thereby allowing water from water tank 194 to be conveyed to carbonate supply line 168. Apparatus 100 also includes a water supply pump 200 that may be communicatively coupled to controller 134 (FIG. 2) so that its operation is controllable by controller 134. Water supply pump 200 may act to regulate flow of water from water tank 194 to carbonate supply line 168. For example, water supply pump 200 may vary speeds in order to control the flow of water supplied to carbonate supply line 168. Water supply pump 200 may be one of many currently available pumps that are designed to pump liquids. As an example, a Hydra-Cell® T100M Series manufactured by Wanner Engineering, Inc. may be used.

Upon reaching carbonate supply line 168, water may mix with carbonate flowing therethrough to form a carbonate paste (a "slush-like" solution). Carbonate paste may flow faster and/or more consistently through carbonate supply line 168 than carbonate (e.g. powder) that has not been mixed with water. Accordingly, the mixing of water with carbonate into carbonate paste may improve the flow of carbonate though carbonate supply line 168 and ultimately lead to a greater and/or more reliable quantity of carbonate being supplied to reaction chamber 118.

The mixing of water with carbonate into carbonate paste may also put less stress on carbonate supply pump 130. For example, carbonate supply pump 130 may not need to work as hard because it is easier to regulate movement of carbonate paste (a liquid) through carbonate supply line 168 than carbonate (a solid) (i.e. there is less resistance to flow).

In the illustrated example, carbonate supply line 168 includes a water supply inlet 192 downstream of carbonate supply pump 130. Preferably, water supply inlet 192 is located immediately downstream of carbonate supply pump 130. Such a location for water supply inlet 192 may provide an even greater improvement in flow since it maximizes the length of carbonate supply line 168 in which carbonate paste flows in place of carbonate.

As shown, water supply outlet 196 of water tank 194 and water supply inlet 192 of carbonate supply line 168 are fluidly connected by water supply pump 200 and a water supply line 198. Accordingly, water may exit water tank 194 at water supply outlet 196, flow through water supply pump 200 and water supply line 198, and then enter carbonate supply line 168 at water supply inlet 192. Water supply line 198 may include one or more interconnected conduits, pipes, or the like. As shown, water supply line 198 includes two interconnected conduits arranged at a right angle. It will be appreciated that many alternative configurations of water supply line 198 are possible. The one or more conduits, pipes, or the like included in water supply line 198 are preferably constructed of high-strength material(s) that can withstand elevated pressure and other operational stress.

Processor 136 may be further configured to:

transmit a control signal to water supply pump 200 instructing it to act according to carbonate supply pump 130.

As an example, the control signal transmitted to water supply pump 200 may instruct it to operate at a speed relative to that of carbonate supply pump 130. Alternatively, the control signal transmitted to water supply pump 200 may instruct it to turn off (or remain off) while carbonate supply pump 130 is not operating.

Referring still to FIG. 4, apparatus 100 also includes a water supply control valve 202 that may act to further regulate flow of water from water tank 194 to carbonate supply line 168. In this way, water supply pump 200 and water supply control valve 202 may work together to regulate flow of water from water tank 194 to carbonate supply line 168. Water supply control valve 202 may be communicatively coupled to controller 134 (FIG. 2) so that its operation is controllable by controller 134. Alternatively, apparatus 100 may not include a water supply control valve 202.

Water supply control valve 202 may be located at any point along water supply line 198. In the illustrated example, water supply control valve 202 is located downstream of water supply pump 200. In this location, water supply control valve 202 may act to "fine-tune" the flow of water between water supply pump 200 and carbonate supply line 168. Alternatively, water supply control valve 202 may be located proximate to water supply inlet 192 of carbonate supply line 168. Water supply control valve 202 may operate between an open position that allows passage of water from water supply pump 200 to carbonate supply line 168 and a closed position that blocks passage of water from water supply pump 200 to carbonate supply line 168.

In response to receiving the user command signal, processor 136 may be further configured to:

transmit a control signal to water supply control valve 202 instructing it to act according to at least one of the carbon dioxide tank pressure and the user command signal.

As an example, the control signal transmitted to water supply control valve 202 may instruct it to operate in the closed position while water supply pump 200 is not operating (i.e. off). Accordingly, while water supply pump 200 is off, water supply control valve 202 may operate in the closed position to block passage of water through water supply line 198. Such an arrangement may effectively seal water supply line 198 downstream of water supply control valve 202. This may provide one or more advantages. For example, while water supply control valve 202 operates in the closed position, it may limit or block water that leaks from water supply pump 200 from pooling in water supply line 198 and/or entering carbonate supply line 168 inadvertently.

Referring still to FIG. 4, water tank 194 includes a level sensor 204 for measuring a water level within water tank 194. Level sensor 204 may be communicatively coupled to controller 134 (FIG. 2). Level sensor 204 may be one of many currently available level sensors. As an example, level sensor 204 may be a FL-LL—Ultrasonic Liquid Level Sensor manufactured by SMD Fluid Controls. As described above, ultrasonic liquid level sensors work by emitting and detecting the reverberations of high frequency sound waves. Although level sensor 204 is shown located on the side of water tank 194, an ultrasonic liquid sensor is preferably located at the top of water tank 194.

In alternative embodiments, water tank 194 may include multiple level sensors 204, e.g. 2 to 6, or more. The inclusion of multiple level sensors 204 within water tank 194 may provide one or more advantages. For example, if one or more malfunction, the remaining level sensor(s) 204 may still operate to measure the water level within water tank 194. Depending on the application of apparatus 100, water tank 194 may experience shifts in orientation. Water tank 194 is shown right-side up in FIG. 4. However, it may be oriented sideways (i.e. rotated 90° relative to FIG. 4) or in other orientations. Accordingly, the inclusion of level sensors 204 on multiple sides of water tank 194 may allow the water level to be reliably measured across a wide range of water tank 194 orientations. Alternatively, water tank 194 may not include level sensor(s) 204.

Processor 136 may be further configured to:

(i) receive, from level sensor(s) 204 of water tank 194, an input signal including the water level within water tank 194, (ii) transmit a control signal to water supply pump 200 instructing it to act according to the water level within water tank 194, and/or (iii) transmit a control signal to carbonate supply pump 130 instructing it to act according to the water supply pump 200.

As an example, the control signal transmitted to water supply pump 200 may instruct it to turn off (or remain off) while the water level within water tank 194 is below a water low level limit. Accordingly, when the water level within water tank 194 is too low, controller 134 may prevent water supply pump 200 from operating (i.e. turning on). In some embodiments, the water low level limit may be stored in memory 140 of controller 134. In these embodiments, the water low level limit may be adjusted as desired (e.g. with user interface 142 and/or portable electronic device 148).

As another example, the control signal transmitted to the carbonate supply pump 130 may instruct it to operate at an increased speed while water supply pump 200 is not operating (i.e. off). As described above, carbonate supply pump 130 may encounter more resistance when regulating flow of carbonate that has not been mixed with water. Therefore, it may need to operate at an increased speed while water supply pump 200 is off to achieve the same flowrate.

In some embodiments, processor 136 may receive input signals that include the water level from level sensor(s) 204 every minute (or another set time interval, e.g. every 5 seconds). Accordingly, processor 136 may be able to monitor the water level over time. In response to determining that the water level is below the water low level limit, processor 136 may be configured to transmit a signal that includes a low water warning. This signal may be transmitted to user interface 142 in which case the low water warning may take the form of a flashing light or an auditory alert, for example. Alternatively, or in addition, this signal may be transmitted to portable electronic device 148 in which case the low water warning may take the form of a text message, for example. Controller 134 may also prevent further use of water tank 194 (i.e. seal it off from the rest of apparatus 100) in response to determining that the water level is below the water low level limit.

Referring still to FIG. 4, water tank 194 also includes a water delivery conduit 210 for delivering water from water tank 194 to a fire. Water delivery conduit 210 extends from a tank end 210*a* to a delivery end 210*b*. Tank end 210*a* is fluidly connected to water tank 194 so that water released therefrom may flow through water delivery conduit 210 toward delivery end 210*b*. Delivery end 210*b* may be positioned/oriented (e.g. by a firefighter) so that water flowing through water delivery conduit 210 is delivered to a targeted area of the fire. In the illustrated example, water tank 194 includes a water delivery outlet 206. As shown, tank end 210*a* of water delivery conduit 210 is fluidly connected to water tank 194 at water delivery outlet 206. Water delivery conduit 210 is preferably constructed of high-strength material(s) so that it can withstand elevated pressure and other operational stress.

Apparatus 100 also includes a water delivery pump 212 that may act to regulate flow of water through water delivery conduit 210. For example, water delivery pump 212 may vary speeds in order to control the flow of water through water delivery conduit 210. Water delivery pump 212 may be one of many currently available pumps that are designed to pump liquids. As an example, a Hydra-Cell® Q155L Series manufactured by Wanner Engineering, Inc. may be used. Water delivery pump 212 may be communicatively coupled to controller 134 (FIG. 2) so that its operation is controllable by controller 134. Controller 134 may control operation of water delivery pump 212 in an automated fashion.

A user command signal may include a water delivery pressure. For example, with user interface 142 and/or portable electronic device 148, a firefighter may request that water at a water delivery pressure of 8 bars be released from delivery end 210*b* of water delivery conduit 210.

In response to receiving the user command signal, processor 136 may be further configured to:

transmit a control signal to water delivery pump 212 instructing it to act according to the water delivery pressure.

As an example, the control signal transmitted to water delivery pump 212 may instruct it to operate at a speed needed to release water from delivery end 210*b* of water delivery conduit 210 at the water delivery pressure.

Water may be used to suppress Class A fires. As described above, water from water tank 194 may be applied to a fire by orienting delivery end 210*b* of water delivery conduit 210 toward the fire (i.e. the burning material(s)). Water may suppress a fire by cooling the burning materials. Spraying the burning materials with water may also limit or prevent re-ignition.

In some embodiments, water delivery conduit 210 may include a misting nozzle (not shown) at delivery end 210*b*. As water passes through delivery end 210*b* of water delivery conduit 210, the misting nozzle may produce a mist made up of a plurality of tiny water droplets. All else being equal, the plurality of water droplets have an increased surface area relative to a traditional stream of water. Owing to their surface area, the plurality of tiny water droplets evaporate quicker and thereby absorb heat from the fire quicker than the traditional stream of water.

In the illustrated example, apparatus 100 also includes a water delivery control valve 214 that may act to further regulate flow of water through water delivery conduit 210. In this way, water delivery control valve 214 and water delivery pump 212 may work together to regulate flow of water from water tank 194 through water delivery conduit 210. Water delivery control valve 214 may be communicatively coupled to controller 134 (FIG. 2) so that its operation is controllable by controller 134. Controller 134 may control operation of water delivery control valve 214 in an automated fashion. Alternatively, apparatus 100 may not include a water delivery control valve 214.

Referring still to FIG. 4, water delivery control valve 214 may be located at any point along water delivery conduit 210. In the illustrated example, water delivery control valve 214 is located downstream of water delivery pump 212. In this location, water delivery control valve 214 may act to "fine-tune" the flow of water through water delivery conduit 210. Alternatively, water delivery control valve 214 may be located proximate to delivery end 210*b* of water delivery conduit 210. Water delivery control valve 214 may operate between an open position that allows passage of water through water delivery conduit 210 and a closed position that blocks passage of water through water delivery conduit 210.

In response to receiving the user command signal, processor 136 may be further configured to:

transmit a control signal to water delivery control valve 214 instructing it to act according to the water delivery pressure.

As an example, the control signal transmitted to water delivery control valve 214 may instruct it operate in the closed position while water delivery pump 212 is not operating (i.e. off). Accordingly, while water delivery pump 212 is off, water delivery control valve 214 may operate in the closed position to block passage of water through water delivery conduit 210. Such an arrangement may effectively seal water delivery conduit 210 downstream of water delivery control valve 214. This may provide one or more advantages. For example, while water delivery control valve 214 operates in the closed position, it may limit or block water that leaks from water delivery pump 212 from pooling in water delivery conduit 210 and/or inadvertently leaking out of delivery end 210*b* of water delivery conduit 210.

Figure 5:
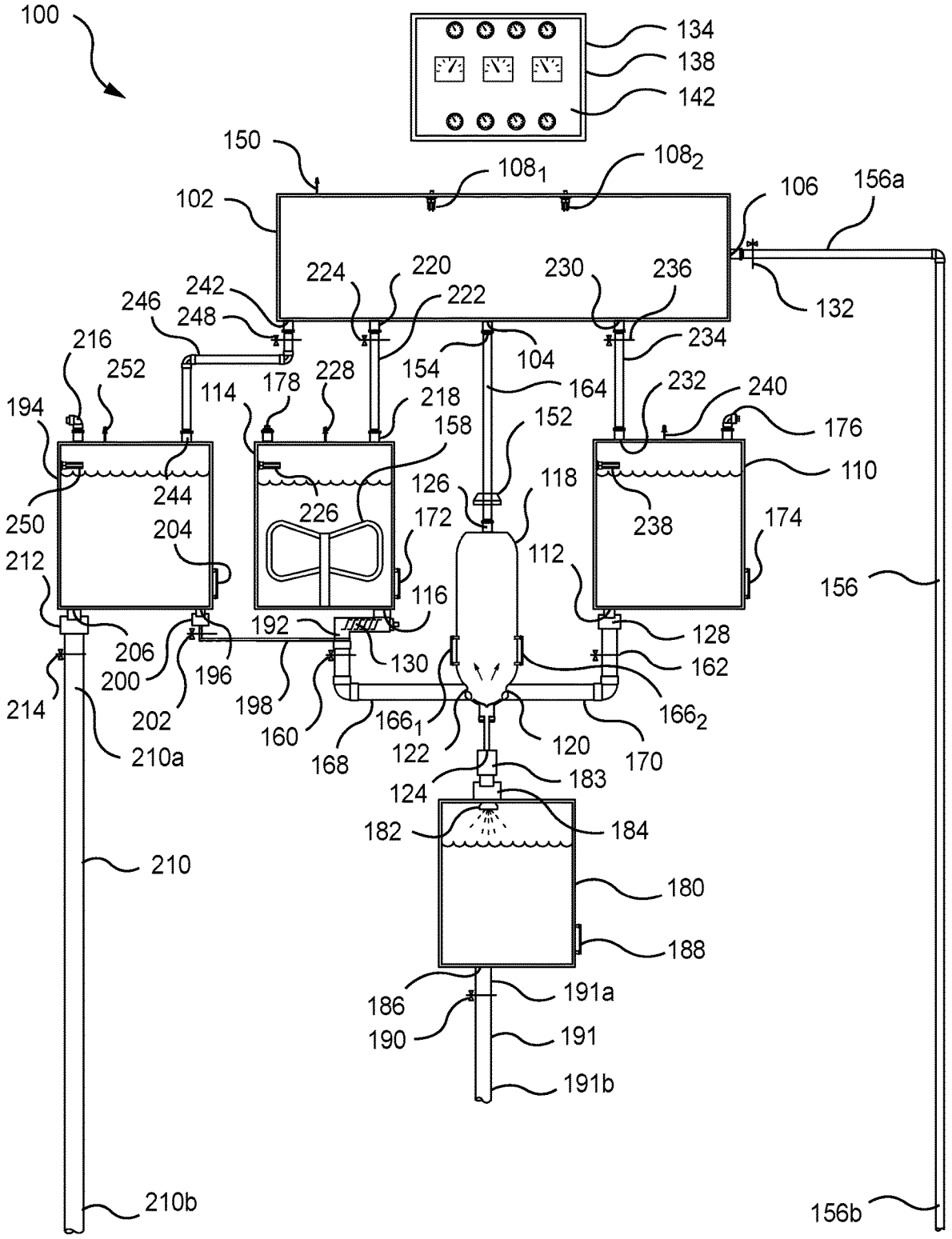
FIG. 5 is a schematic diagram illustrating a firefighting apparatus in accordance with an alternative embodiment.

Reference is now made to FIG. 5, which illustrates another apparatus 100 for fighting fires. Apparatus 100 illustrated in FIG. 5 is analogous to apparatus 100 illustrated in FIG. 4, except for the additional elements and/or features described below. Unless otherwise noted, elements having the same reference numeral have similar structure and/or perform similar function as those in apparatus 100 illustrated in FIG. 4.

As shown, each of acid tank 110, carbonate tank 114 and water tank 194 are fluidly connected to carbon dioxide tank 102. Accordingly, carbon dioxide gas from carbon dioxide tank 102 may be conveyed to acid tank 110, carbonate tank 114 and the water tank 194 in order to pressurize acid tank 110, carbonate tank 114 and the water tank 194. Since, in the illustrated example, carbonate tank 114, acid tank 110 and water tank 194 are each pressurized with carbon dioxide gas, these tanks are preferably constructed of high-strength material(s) that can withstand elevated gas pressures. In some embodiments, one or more of the carbonate tank 114, acid tank 110 and water tank 194 may not be pressurized.

As shown, apparatus 100 includes a carbonate tank pressurization control valve 224, an acid tank pressurization control valve 236, and a water tank pressurization control valve 248. Pressurization control valves 224, 236 and 248 may act to regulate pressurization of carbonate tank 114, acid tank 110 and water tank 194, respectively. Control valves 224, 236 and 248 may be communicatively coupled to controller 134 (FIG. 2) so that their operation is controllable by controller 134. Controller 134 may control operation of one or more of pressurization control valves 224, 236 and 248 in an automated fashion.

In the illustrated example, carbon dioxide tank 102 includes pressurization outlets 220, 230 and 242. Carbonate tank 114 also includes a pressurization inlet 218. As shown, pressurization outlet 220 of carbon dioxide tank 102 and pressurization inlet 218 of carbonate tank 114 are fluidly connected by a pressurization line 222. Accordingly, carbon dioxide gas may exit carbon dioxide tank 102 at pressurization outlet 220, flow through pressurization line 222, and enter carbonate tank 114 at pressurization inlet 218.

In the illustrated example, acid tank 110 also includes a pressurization inlet 232. As shown, pressurization outlet 230 of carbon dioxide tank 102 and pressurization inlet 232 of acid tank 110 are fluidly connected by a pressurization line 234. Accordingly, carbon dioxide gas may exit carbon dioxide tank 102 at pressurization outlet 230, flow through pressurization line 234, and enter acid tank 110 at pressurization inlet 232.

In the illustrated example, water tank 194 also includes a pressurization gas inlet 244. As shown, pressurization outlet 242 of carbon dioxide tank 102 and pressurization inlet 244 of water tank 194 are fluidly connected by a pressurization line 246. Accordingly, carbon dioxide gas may exit carbon dioxide tank 102 at pressurization outlet 242, flow through pressurization line 246, and enter water tank 194 at pressurization inlet 244.

Pressurization lines 222, 234 and 246 may include one or more interconnected conduits, pipes, or the like. As shown, pressurization line 246 includes three interconnected conduits while pressurization lines 222 and 234 are one conduit each. It will be appreciated that many alternative configurations of pressurization lines 222, 234, 246 are possible. The one or more conduits, pipes, or the like included in each pressurization line 222, 234 and 246 are preferably constructed of high-strength material(s) that can withstand elevated gas pressure and other operational stress.

Pressurization control valves 224, 236 and 248 may be located at any point along corresponding pressurization lines 222, 234 and 246. Pressurization control valves 224, 236 and 248 may independently operate between (i) an open position that allows passage of carbon dioxide gas through corresponding pressurization lines 222, 234 and 246, and (ii) a closed position that blocks passage of carbon dioxide gas through respective pressurization lines 222, 234 and 246. In the illustrated example, pressurization control valves 224, 236 and 248 are located proximate to corresponding pressurization outlets 220, 230 and 242. Each may be differently located in alternative embodiments. For example, one or more of pressurization control valves 224, 236 and 248 may be located proximate to pressurization inlets 218, 232 and 244, respectively. Alternatively, one or more of pressurization control valves 224, 236 and 248 may be directly connected to pressurization outlets 220, 230 and 242, respectively.

Referring still to FIG. 5, carbonate tank 114, acid tank 110, and water tank 194 each include a corresponding pressure sensor 226, 238 and 250 for measuring a carbonate tank pressure, an acid tank pressure and a water tank pressure. Each pressure sensor 226, 238 and 250 may be one of many currently available pressure sensors. As an example, each pressure sensor 226, 238 and 250 may be a DST P92C CAN pressure sensor manufactured by Danfoss Engineering.

In alternative embodiments, one or more of carbonate tank 114, acid tank 110 and water tank 194 may include additional pressure sensors, e.g. 3 to 6, or more. For example, in an alternative embodiment, carbonate tank 114 may include six pressure sensors 226, acid tank 110 may include four pressure sensors 238, and water tank 194 may include five pressure sensors 250. The inclusion of multiple pressure sensors may provide one or more advantages. For example, if one or more malfunction, the remaining pressure sensor(s) may still operate to measure the tank pressure.

Pressure sensor(s) 226, 238 and 250 may be communicatively coupled to controller 134 (FIG. 2). In response to receiving the user command signal, processor 136 may be further configured to:

(i) receive, from pressure sensor(s) 226 of carbonate tank 114, a input signal including the carbonate tank pressure, (ii) transmit a control signal to carbonate tank pressurization control valve 224 instructing it to act according to the carbonate tank pressure, (iii) receive, from pressure sensor(s) 238 of acid tank 110, a input signal including the acid tank pressure, (iv) transmit a control signal to acid tank pressurization control valve 236 instructing it to act according to the acid tank pressure, (v) receive, from pressure sensor(s) 250 of water tank 194, a input signal including the water tank pressure, and/or (vi) transmit a control signal to water tank pressurization control valve 248 instructing it to act according to the water tank pressure.

Memory 140 of controller 134 may store baseline tank pressures for each of carbonate tank 114, acid tank 110 and water tank 194. In some embodiments, the baseline tank pressures of each tank may be a pressure at which each tank is desirably maintained throughout operation. As an example, while acid tank pressure level is below the baseline acid tank pressure, the control signal transmitted to acid tank pressurization control valve 236 may instruct it to operate in the open position (i.e. until the acid tank pressure returns to the baseline acid tank pressure). In this way, when one of the tank pressures is too low, controller 134 may instruct the pressurization control valve for that tank to operate in the open position (e.g. to re-pressurize the tank to its desired operating pressure). In some embodiments, the baseline tank pressures of each tank may be adjusted as desired (e.g. with user interface 142 and/or portable electronic device 148).

Referring still to FIG. 5, carbonate tank 114, acid tank 110, and water tank 194 each have a corresponding pressure relief valve 228, 240, and 252. Pressure relief valve 228 may act to regulate release of carbon dioxide gas from carbonate tank 114. Pressure relief valve 240 may act to regulate release of carbon dioxide gas from acid tank 110. Pressure relief valve 252 may act to regulate release of carbon dioxide gas from water tank 194. Each pressure relief valve 228, 240 and 252 may operate between an open position that allows carbon dioxide gas to escape and a closed position that blocks escape of carbon dioxide gas. Each pressure relief valve 228, 240 and 252 may be communicatively coupled to the controller 134 (FIG. 2) so that its operation is controllable by controller 134. Controller 134 may control operation of one or more of pressure relief valves 228, 240 and 252 in an automated fashion. Processor 136 may be further configured to:

(i) transmit a control signal to pressure relief valve 228 of carbonate tank 114 instructing it to act according to the carbonate tank pressure, (ii) transmit a control signal to pressure relief valve 240 of acid tank 114 instructing it to act according to the acid tank pressure, and/or (iii) transmit a control signal to pressure relief valve 252 of water tank 194 instructing it to act according to the water tank pressure.

As an example, the control signal transmitted to pressure relief valve 228 of carbonate tank 114 may instruct it to operate in the open position (i.e. to release carbon dioxide gas) while the carbonate tank pressure exceeds a carbonate tank pressure threshold. The carbonate tank pressure threshold may be the pressure rating of carbonate tank 114 or another safety limit. Accordingly, as a safety measure, each of pressure relief valves 228, 240 and 252 may act (i.e. open and close) to keep the pressure of their corresponding tank below its pressure threshold. In at least one embodiment, the pressure thresholds may be stored in memory 140 of controller 134. In these embodiments, the pressure thresholds may be adjusted as desired (e.g. with user interface 142 and/or portable electronic device 148). In the event one or more of pressure sensor(s) 226, 238 and 250 malfunction (or become inoperable for any reason), pressure relief valves 228, 240 and 252 may automatically open when the pressure inside the corresponding tank surpasses an upper pressure limit (i.e. by shear mechanical force of the gas pressure).

Pressurizing carbonate tank 114, acid tank 110 and water tank 194 may provide one or more advantages. For example, pressurization of water tank 194 may aid operation of water supply pump 200 and water delivery pump 212. A significant portion of the water's pumping force may be provided by the gas pressure within water tank 194. As a result, water supply pump 200 and water delivery pump 212 may not need to work as hard. For example, with the support of the gas pressure, water supply pump 200 may be able to operate at a lower speed to convey water to carbonate supply line 168.

Along the same lines, water delivery pump 212 may not need to work as hard to meet a requested water delivery pressure. In some cases, the propulsive force supplied by the gas pressure in water tank 194 is sufficient to meet the requested water delivery pressure. In these cases, water delivery pump 212 may act as a flow regulator. In other cases, the propulsive force provided by the gas pressure in water tank 194 and water delivery pump 212 may work together to meet elevated water delivery pressures. In these cases, the gas pressure within water tank 194 may boost the flowrate provided by water supply pump 200 operating at a given speed. Pressurization of carbonate tank 114 and acid tank 110 may aid operation of carbonate supply pump 130 and acid supply pump 128 in a similar fashion.

Alternatively, or in addition, pressurizing carbonate tank 114 may keep carbonate held therein moisture-free. If moisture is introduced (or allowed to collect) within carbonate tank 114, portions of the carbonate held therein may solidify. This may lead to clogs and/or damage carbonate supply pump 130. Pressurizing carbonate tank 114 can significantly reduce the likelihood of solidification.

Alternatively, or in addition, pressurization of carbonate tank 114, acid tank 110 and water tank 194 may facilitate the identification of leaks. In some embodiments, processor 136 may be configured to receive input signals from pressure sensors 226, 238 and 250 that include the corresponding carbonate tank pressure, the acid tank pressure and the water tank pressure every 30 seconds (or another set time interval, e.g. every 5 seconds). Accordingly, processor 136 may be able to monitor the carbonate tank pressure, the acid tank pressure and the water tank pressure over time to identify abnormal drops in pressure. Abnormal drops in pressure over time may be the sign of a leak. In response to identifying an abnormal drop in pressure in one of carbonate tank 114, acid tank 110 and water tank 194, processor 136 may be configured to transmit a signal that includes a pressure drop warning. This signal may be transmitted to user interface 142 in which case the pressure drop warning may take the form of a flashing light or an auditory alert, for example. Alternatively, or in addition, this signal may be transmitted to portable electronic device 148 in which case the pressure drop warning may take the form of a text message, for example. As an example, if the pressure drop warning corresponds to the water tank pressure, controller 134 may prevent further use of water tank 194 (i.e. seal it off from the rest of apparatus 100). Alternatively, or in addition, water tank 194 may be inspected for leaks. In the event a leak is discovered, it may be repaired or water tank 194 may be replaced.

Figure 6:
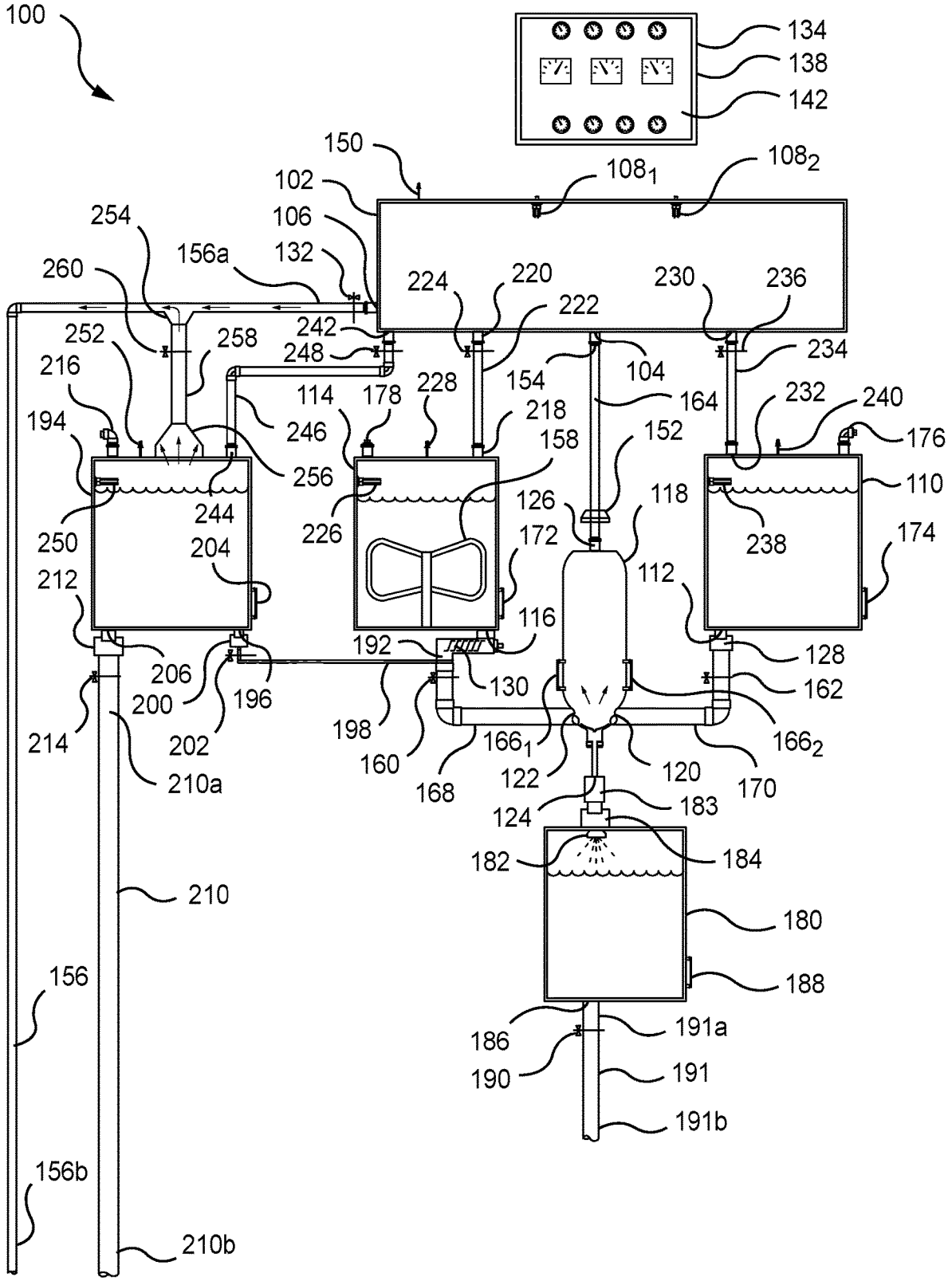
FIG. 6 is a schematic diagram illustrating a firefighting apparatus in accordance with an alternative embodiment.

Reference is now made to FIG. 6, which illustrates another apparatus 100 for fighting fires. Apparatus 100 illustrated in FIG. 6 is analogous to apparatus 100 illustrated in FIG. 5, except for the additional elements and/or features described below. Unless otherwise noted, elements having the same reference numeral have similar structure and/or perform similar function as those in apparatus 100 illustrated in FIG. 5.

As will be described below, Bernoulli's Principal may be used to evaporate water and draw the resulting water vapor from water tank 194 into carbon dioxide gas delivery conduit 156. As shown, carbon dioxide gas delivery conduit 156 is fluidly connected to water tank 194 so that evaporated water may be selectively drawn into carbon dioxide gas delivery conduit 156. The drawn in water vapor (or evaporated water molecules) may mix with carbon dioxide gas flowing through carbon dioxide gas delivery conduit 156 to form saturated carbon dioxide. Saturated carbon dioxide may be characterized as carbon dioxide gas having a plurality of interspersed water molecules.

In the illustrated example, carbon dioxide gas delivery conduit 156 includes an evaporated water inlet 254 and water tank 194 includes an evaporated water outlet 256. Apparatus 100 includes an evaporated water uptake conduit 258 that fluidly connects evaporated water outlet 256 of water tank 194 to evaporated water inlet 254 of carbon dioxide gas delivery conduit 156. Accordingly, as shown, water vapor may flow from water tank 194, through evaporated water uptake conduit 258, to carbon dioxide gas delivery conduit 156. As described above, water vapor mixes with carbon dioxide gas flowing carbon dioxide gas delivery conduit 156 to form saturated carbon dioxide.

Evaporated water uptake conduit 258 may include one or more interconnected conduits, pipes, or the like. In the illustrated example, evaporated water uptake conduit 258 is a single straight conduit. Many alternative configurations of evaporated water uptake conduit 258 are possible. The one or more conduits, pipes, or the like included in evaporated water uptake conduit 258 and 246 are preferably constructed of high-strength material(s) that can withstand sharp pressure fluctuation and other operational stress.

Preferably, as shown, evaporated water uptake conduit 258 has a flared (i.e. widened) section where it connects to evaporated water outlet 256 of water tank 194. By expanding the inlet of evaporated water uptake conduit 258 at water tank 194, the flared section may facilitate the drawing of evaporated water molecules.

Referring still to FIG. 6, an evaporation control valve 260 is located along the evaporated water uptake conduit 258. Evaporation control valve 260 may act to regulate flow of evaporated water molecules through evaporated water uptake line 258. Evaporation control valve 260 may operate between an open position that allows passage of evaporated water from water tank 194 to carbon dioxide gas delivery conduit 156 and (ii) a closed position that blocks passage of evaporated water from water tank 194 to carbon dioxide gas delivery conduit 156. Evaporation control valve 260 may be communicatively coupled to controller 134 (FIG. 2) so that its operation is controllable by controller 134. Controller 134 may control operation of evaporation control valve 260 in an automated fashion.

Evaporation control valve 260 may be located at any point along evaporated water uptake conduit 258. In the illustrated example, evaporation control valve 260 is located proximate to evaporated water inlet 254 of carbon dioxide gas delivery conduit 156. Alternatively, evaporation control valve 260 may be located proximate to evaporated water outlet 256 of water tank 194. Bernoulli's Principle may be used to evaporate water and draw the evaporated water molecules from water tank 194 into carbon dioxide gas delivery conduit 156. While evaporation control valve 260 is operating in the closed position, pressure relief valve 252 of water tank 194 opens until water tank 194 is depressurized (i.e. carbon dioxide gas therein is released). Depressurized, in this context, may mean that most (e.g. 85 to 95%), or all, the carbon dioxide gas within water tank 194 has been released.

Once water tank 194 is depressurized, evaporation control valve 260 is opened. As high speed carbon dioxide gas travelling through carbon dioxide gas delivery conduit 156 passes evaporated water uptake conduit 258, it creates a low pressure zone over the evaporated water uptake conduit 258. This pressure differential creates a suction force that acts to further reduce the water tank pressure below atmospheric pressure. Such a decrease in atmospheric pressure may cause water molecules within water tank 194 to evaporate. This is achieved by vacuum evaporation, which is the process of causing the pressure in a liquid-filled container to be reduced below the vapor pressure of the liquid, causing the liquid to evaporate at a lower temperature than normal. For example, water boils at 100° C. (212 F) at atmospheric pressure (1.01 bar). However, by reducing the pressure inside water tank 194, it may be possible to boil water at room temperature, or lower. Further, heating the water inside water tank 194 may increase the rate of vaporization under the vacuum evaporation process. This heating could be provided in one or more ways, e.g. application of electrical current, exothermic chemical reactions, application of engine heat, etc. Once a water molecule evaporates, the suction force may draw it through evaporated water uptake conduit 258 and into carbon dioxide gas delivery conduit 156 where it mixes with carbon dioxide gas flowing therethrough. As described below, controller 134 may be configured to instruct pressure relief valve 252 of water tank 194 and/or evaporation control valve 260 to use Bernoulli's Principle so that apparatus 100 can deliver saturated carbon dioxide to a fire.

In addition to a carbon dioxide delivery pressure, a user command signal may include a saturation level. For example, with user interface 142 and/or portable electronic device 148, a firefighter may request that carbon dioxide at a carbon dioxide delivery pressure of 10 bars and a saturation level of 50% be released from delivery end 156*b* of carbon dioxide gas delivery conduit 156. In response to receiving the user command signal, processor 136 may be further configured to:

(i) to transmit a control signal to pressure relief valve 252 of water tank 194 instructing it to release carbon dioxide gas until water tank 194 is depressurized, and (ii) transmit a control signal to evaporation control valve 260 instructing it to act according to the saturation level.

In cases where water tank 194 is not pressurized, a control signal may not need to be transmitted to pressure relief valve 252 of water tank 194 that instructs it to release carbon dioxide gas (i.e. water tank 194 is already sufficiently depressurized).

As an example, the control signal transmitted to evaporation water control valve 260 may instruct it to act (i.e. open) so that saturated carbon dioxide is released from delivery end 156*b* of carbon dioxide gas delivery conduit 156 at the saturation level requested. Based on the saturation level, controller 134 may instruct evaporation control valve 260 to fully open, partially open, slightly open, etc.

As another example, when a user command signal does not include a saturation level (or includes a 0% water saturation level), the control signal transmitted to evaporation water control valve 260 may instruct it to operate in the closed position. In this example, carbon dioxide gas (without water saturation) is released from delivery end 156*b* of carbon dioxide gas delivery conduit 156.

Saturated carbon dioxide may be used to suppress Class A, Class B and/or Class C fires. Saturated carbon dioxide may be applied to a fire by orienting delivery end 156*b* of carbon dioxide gas delivery conduit 156 toward the fire (i.e. the burning material(s)). In this context, carbon dioxide gas delivery conduit 156 may be characterized as saturated carbon dioxide delivery conduit 156.

As soon as saturated carbon dioxide exits delivery conduit 156, the interspersed water molecules condense into water droplets. These water droplets absorb heat from the fire. At the same time, carbon dioxide gas may replace the fire's oxygen and thereby suffocate the fire. The smaller the droplets of water, the larger the overall surface area that may absorb heat from the fire. Accordingly, with smaller droplet sizes, heat may be absorbed more efficiently.

In general, the application of a steady stream of water should not be used to suppress class B fires (flammable liquids and gas fires). The stream of water may disperse/scatter the fire's fuel and spread the flames. However, saturated carbon dioxide may be used to suppress Class B fires. The application of small droplets of water may not disperse/scatter the fire's fuel and spread the flames.

Figure 7:
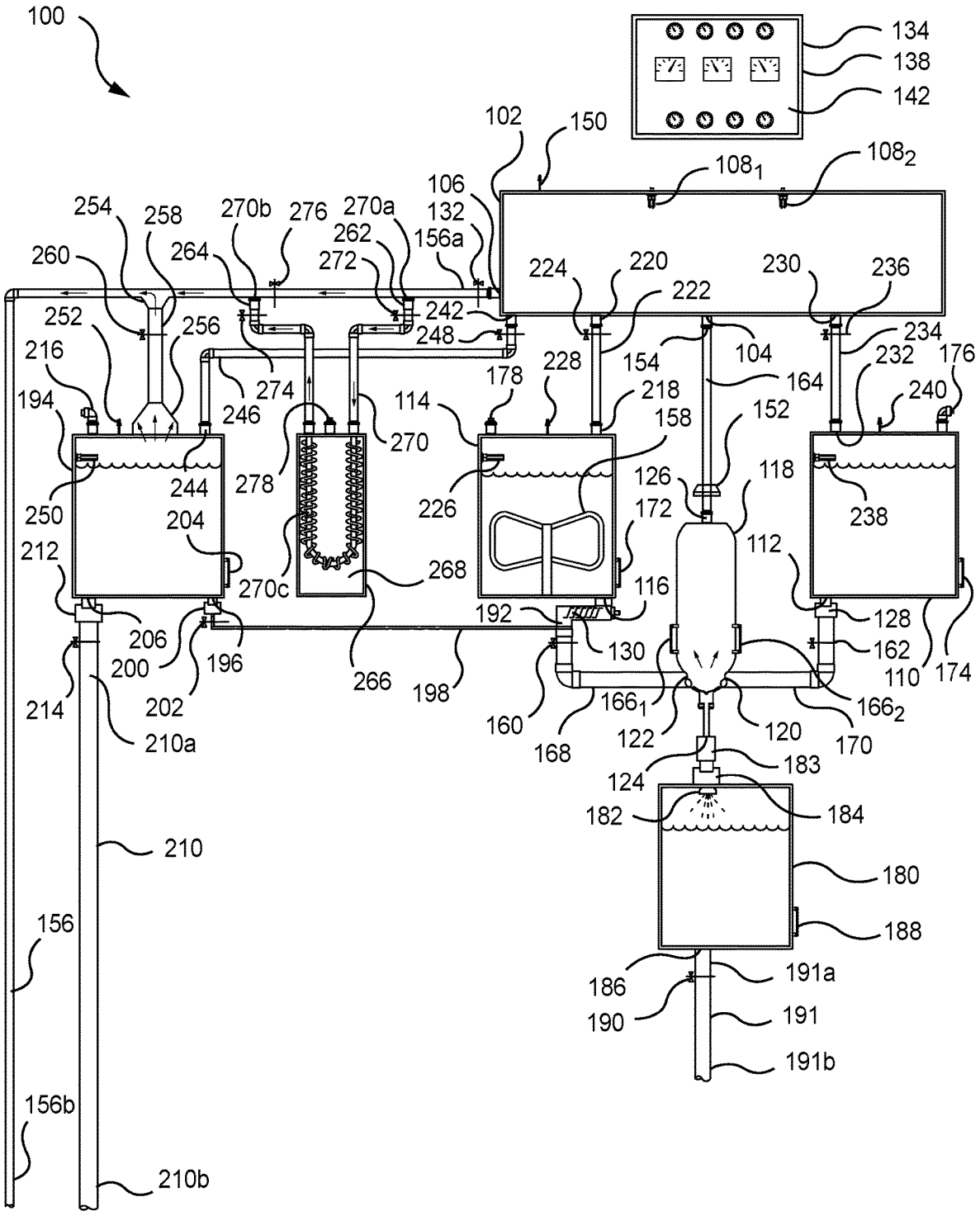
FIG. 7 is a schematic diagram illustrating a firefighting apparatus in accordance with an alternative embodiment.

Reference is now made to FIG. 7, which illustrates another apparatus 100 for fighting fires. Apparatus 100 illustrated in FIG. 7 is analogous to apparatus 100 illustrated in FIG. 6, except for the additional elements and/or features described below. Unless otherwise noted, elements having the same reference numeral have similar structure and/or perform similar function as those in apparatus 100 illustrated in FIG. 6.

As shown, apparatus 100 includes a thermal tank 266 for holding a heat exchange medium 268. Thermal tank 266 includes a loading port 278 that may be used to refill thermal tank 266 with heat exchange medium 268. For example, loading port 278 may be connected to a loading device (not shown) in order to refill thermal tank 266 with heat exchange medium 268. Thermal tank 266 is preferably constructed from high-strength non-corrosive materials (e.g. stainless steel, aluminum alloy etc.) so that it can withstand acid corrosion and other operational stress.

In some embodiments, a segment of carbon dioxide gas delivery conduit 156, upstream of evaporated water inlet 254, passes through thermal tank 266 so that carbon dioxide gas flowing therethrough may exchange heat with heat exchange medium 268. Heat exchange medium 268 may be heated to heat carbon dioxide gas as it passes through thermal tank 266. Alternatively, heat exchange medium 268 may be cooled to cool carbon dioxide gas as it passes through thermal tank 266. Thermal tank 266 may be communicatively coupled to controller 234 (FIG. 2) so that the heating and/or cooling of heat exchange medium 268 is controllable by controller 234.

In the illustrated example, carbon dioxide gas delivery conduit 156 includes a branch outlet 262 and a branch inlet 264 downstream of the branch outlet. Both of branch outlet 262 and branch inlet 264 are upstream of evaporated water inlet 254. Apparatus 100 includes a branch line 270 that extends from an inlet end 270*a* to an outlet end 270*b*. Inlet end 270*a* of branch line 270 is fluidly connected to branch outlet 262 of carbon dioxide gas delivery conduit 156 and outlet end 270*b* of branch line 270 is fluidly connected to branch inlet 264 of carbon dioxide gas delivery conduit 156.

As shown, segment 270*c* of branch line 270 passes through thermal tank 266. In this way, as carbon dioxide gas flows therethrough it may exchange heat with heat exchange medium 268 within thermal tank 266. In the illustrated example, segment 270*c* of branch line 270 is coiled to increase contact with heat exchange medium 268. Such a configuration may increase heat transfer between heat exchange medium 268 and the carbon dioxide gas flowing therethrough. Alternatively, segment 270*c* of branch line 270 may not be coiled.

Branch line 270 may include one or more interconnected conduits, pipes, or the like. As shown, branch line 270 includes seven interconnected conduits. The one or more conduits, pipes, or the like included in branch line 270 are preferably constructed of high-strength material(s) that can withstand elevated gas pressure, sharp temperature fluctuation, and other operational stress.

In the illustrated example, a first branch control valve 272 is positioned along branch line 270 upstream of segment 270*c*, a second branch control valve 274 is positioned along branch 270 downstream of segment 270*c*, and a diverter control valve 276 is positioned along carbon dioxide gas delivery conduit 156 between branch outlet 262 and branch inlet 264. As will be described below, first branch control valve 272, second branch control valve 274 and diverter control valve 276 may act together to divert carbon dioxide gas through branch line 270. First branch control valve 272 and second branch control valve 274 may operate between an open position that allows passage of carbon dioxide gas through branch line 270 and a closed position that blocks passage of carbon dioxide gas through branch line 270. Similarly, diverter control valve 276 may operate between an open position that allows passage of carbon dioxide gas through carbon dioxide gas delivery conduit 156 and a closed position that blocks passage of carbon dioxide gas through carbon dioxide gas delivery conduit 156.

Each of first branch control valve 272, second branch control valve 274 and diverter control valve 276 may be communicatively coupled to the controller 134 (FIG. 2) so that their operation is controllable by controller 134. Controller 134 may control operation of one or more of first branch control valve 272, second branch control valve 274 and diverter control valve 276 in an automated fashion.

In addition to a carbon dioxide delivery pressure and a saturation level, a user command signal may include one of a carbon dioxide gas cooling level and a carbon dioxide gas heating level. For example, with user interface 142 and/or portable electronic device 148, a firefighter may request that carbon dioxide at a carbon dioxide delivery pressure of 10 bars and a saturation level of 50% and a carbon dioxide heating level of "high" be released from delivery end 156*b* of carbon dioxide gas delivery conduit 156. In response to receiving the user command signal, processor 136 may be further configured to:

transmit a control signal to first branch control valve 272, second branch 274 and diverter control valve 276 instructing each to act according to one of the carbon dioxide cooling level and the carbon dioxide heating level.

As an example, the control signal transmitted to diverter control valve 276 may instruct it to operate in the closed position while the control signal transmitted to first branch control valve 272 and second branch 274 instructs each to operate in the open position. In this example, carbon dioxide gas flowing through carbon dioxide gas delivery conduit 156 is diverted through branch line 270 and thereby passes through thermal tank 266. As another example, the control signal transmitted to diverter control valve 276 may instruct it to operate in the open position while the control signal transmitted to first branch control valve 272 and second branch control valve 274 instructs each to operate in the closed position. In this example, carbon dioxide gas flowing through carbon dioxide gas delivery conduit 156 is not diverted through branch line 270.

In some embodiments, heat exchange medium 268 is heated so that the carbon dioxide gas flowing through carbon dioxide gas delivery conduit 156 may be heated before it mixes with evaporated water that, as described above, may be drawn in from water tank 194. The evaporated water drawn in from water tank 194 may be transformed into steam as it mixes with the heated carbon dioxide gas flowing through carbon dioxide gas delivery conduit 156.

While heat exchange medium 268 is heated, carbon dioxide flowing through segment 270*c* of branch line 270 may be heated as it passes through thermal tank 266. Heat exchange medium 268 may include water or another suitable solvent. For example, heat exchange medium 268 may be heated by a controlled release of salt. The mixing of salt and water produces an exothermic reaction (i.e. releases heat). For example, controller 134 may control the release of salt into heat exchange medium 268 according to the requested carbon dioxide heating level. Alternatively, or in addition, heat exchange medium 268 may be heated by an electric current. For example, controller 134 may control the amount of electric current provided to heat exchange medium 268 according to the requested carbon dioxide heating level.

As described above, evaporated water drawn in from water tank 194 may be transformed into steam as it mixes with the heated carbon dioxide gas flowing through carbon dioxide gas delivery conduit 156. Alternatively, evaporated water drawn in from water tank 194 may be heated sufficiently such that contact with hot air surrounding the fire readily transforms the evaporated water into steam.

Steam may be used to suppress Class A, Class B and/or Class C fires. The application of steam may be advantageous in one or more applications. For example, suppressing fires in an enclosed area and/or diluting and humidifying accumulated hot gases that are trapped in the enclosed area. Steam can be an effective fire suppressant as it may expand and replace the air surrounding the fire. Replacing the air (i.e. oxygen) surrounding the fire may slow the fire's chemical reaction rate. One litre of water can expand into about 1700 litres of steam at 100° C. Therefore, steam can expand to cover a wide area with limited amounts of water.

In some embodiments, heat exchange medium 268 is cooled so that the carbon dioxide gas flowing through carbon dioxide gas delivery conduit 156 may be cooled before it mixes with evaporated water that, as described above, may be drawn in from water tank 194. The temperature of the evaporated water drawn in from water tank 194 may drop below 0° C. as it mixes with the cooled carbon dioxide gas flowing through carbon dioxide gas delivery conduit 156. As it exits delivery end 156*b* of carbon dioxide delivery conduit 156, cooled water droplets may transform into ice particles. The ice particles may be applied to the fire along with the cooled carbon dioxide gas.

While heat exchange medium 268 is cooled, carbon dioxide flowing through segment 270*c* of branch line 270 may be cooled as it passes through thermal tank 266. Heat exchange medium 268 may include one of many suitable coolant solutions. The coolant solution may include one or more of water, acetone, ethylene glycol, ethanol, methanol, pentane, isopropyl alcohol, and liquid nitrogen. For example, heat exchange medium 268 may be cooled by a controlled release of dry ice into the coolant solution. Controller 134 may control such release of dry ice into the coolant solution according to the requested carbon dioxide cooling level. In some embodiments, controller 134 may maintain the temperature of the coolant solution between about 13° C. and about −196° C. Preferably, controller 134 maintains the temperature of the coolant solution between about −70° C. and about −120° C.

Ice particles may be used to suppress Class A, Class B and/or Class C fires. The application of ice particles may cool the fire. Owing to the large temperature difference between the ice particles and the fire, the amount of heat that may be absorbed by ice particles is higher than liquid water. This may facilitate faster cooling of the fire. Unlike water, which generally runs and leaves only a thin layer on the burning material, ice particles may accumulate (i.e. pile up) on the burning material. In turn, as more ice particles can be located on the burning materials, they can absorb more heat and cool the fire faster. Furthermore, the ability to deposit ice particles on surfaces that are open to air may act to blanket those surfaces from air contact. This may reduce the likelihood of a flash-over fire.

Figure 8:
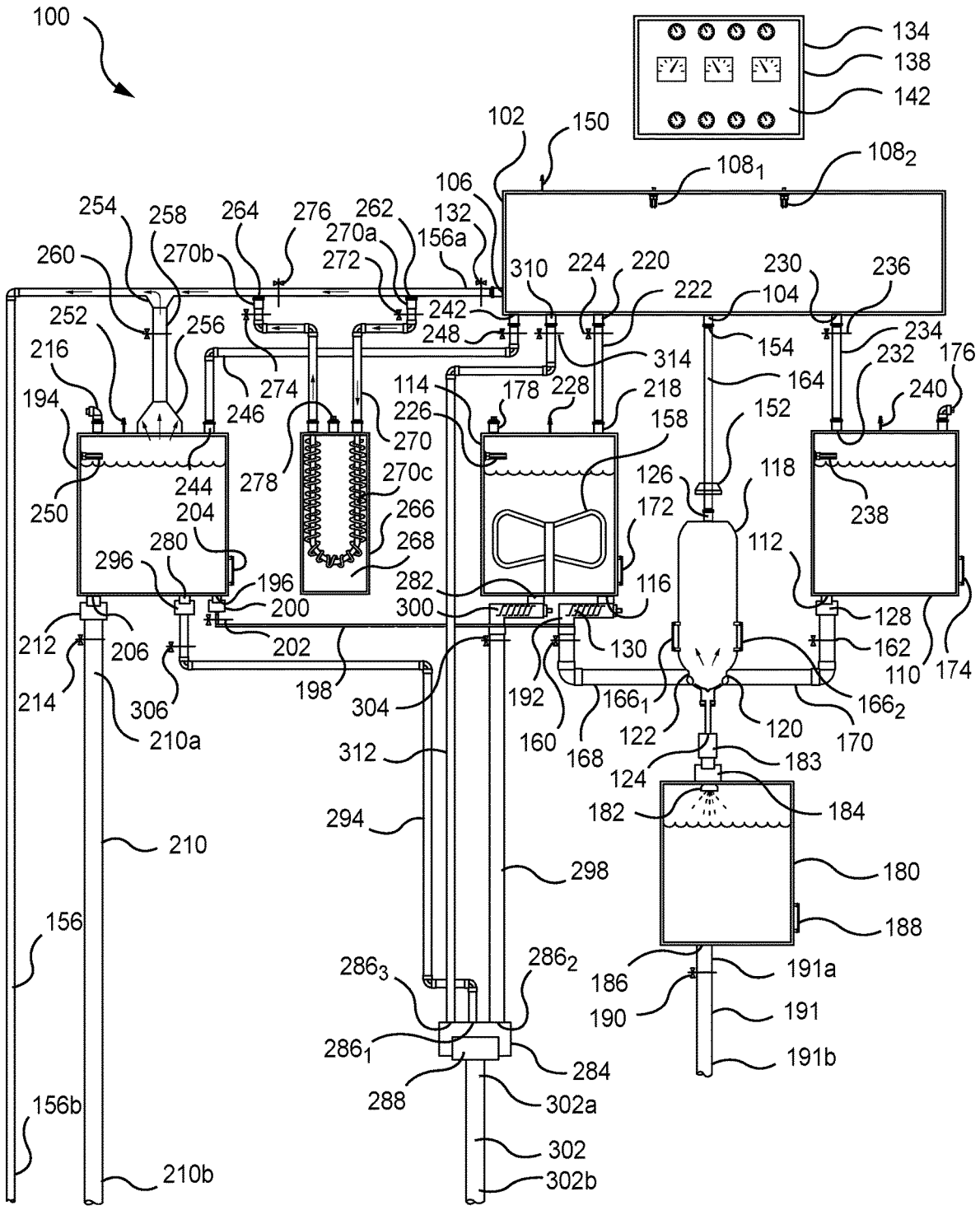
FIG. 8 is a schematic diagram illustrating a firefighting apparatus in accordance with an alternative embodiment.

Reference is now made to FIG. 8, which illustrates another apparatus 100 for fighting fires. Apparatus 100 illustrated in FIG. 8 is analogous to apparatus 100 illustrated in FIG. 7, except for the additional elements and/or features described below. Unless otherwise noted, elements having the same reference numeral have similar structure and/or perform similar function as those in apparatus 100 illustrated in FIG. 7.

As shown, apparatus 100 includes a mixing chamber 284 that is fluidly connected to each of carbon dioxide tank 102, carbonate tank 114, and water tank 194. One or more of carbon dioxide gas, carbonate and water may be conveyed to mixing chamber 284 from carbon dioxide tank 102, carbonate tank 114 and water tank 194, respectively. Within mixing chamber 284, carbonate may be mixed with at least one of carbon dioxide gas and water to form a carbonate solution. Carbonate solution may be delivered from mixing chamber 284 to a fire with a mixing chamber delivery conduit 302. As will be described below, mixing chamber 284 may include one or more mixing elements that act to mix carbonate with at least one of carbon dioxide gas and water.

Figure 9:
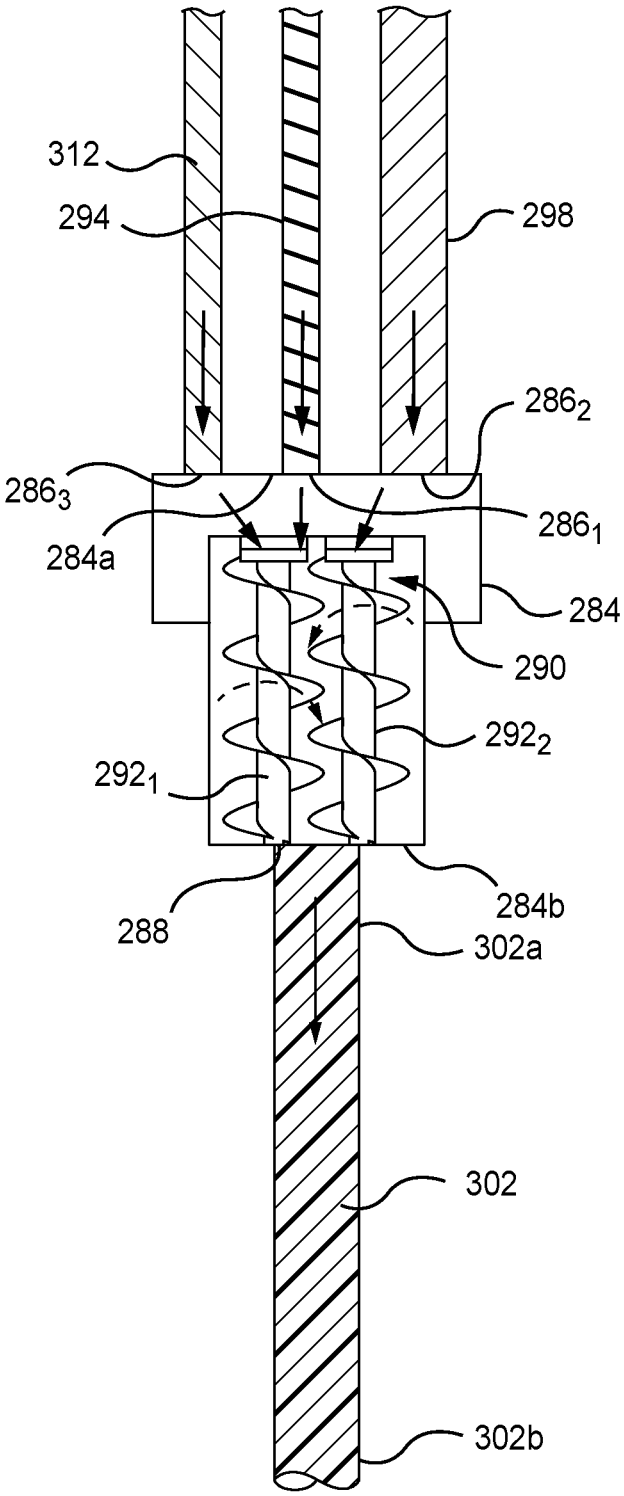
FIG. 9 is a schematic diagram of an exemplary mixing chamber usable in a firefighting apparatus.

Turning to FIG. 9, mixing chamber 284 extends from an inlet end 284*a* to an outlet end 284*b*. Mixing chamber 284 includes three inlet ports $\mathbf{286}_1$, $\mathbf{286}_2$ and $\mathbf{286}_3$ at inlet end 284*a*, an outlet port 288 at outlet end 284*b*, and an internal passage 290 that extends between inlet ports 286 and outlet port 288. Mixing chamber 284 also includes two mixing elements $\mathbf{292}_1$ and $\mathbf{292}_2$ located in internal passage 290. In alternative embodiments, mixing chamber 284 may include more or less mixing elements 292. Each mixing element 292 may act (i.e. rotate/spin) to mix carbonate with at least one of carbon dioxide gas and water as they flow through internal passage 290. In addition, each mixing element 292 may act to propel the carbonate solution through mixing chamber delivery conduit 302.

Each mixing element 292 may be communicatively coupled to controller 134 so that its operation is controllable by controller 134. Controller 134 may control operation of each mixing element 292 in an automated fashion. Mixing chamber 284 may be one of many currently available inline mixers that are designed to mix two or more materials together. As an example, a Series 7000 Ultra Shear Mixer manufactured by Charlie Ross & Son Company may be used.

Referring again to FIG. 8, apparatus 100 includes a water transfer pump 296 that acts to regulate flow of water from water tank 194 to mixing chamber 284, a carbonate transfer pump 300 that acts to regulate flow of carbonate from carbonate tank 114 to mixing chamber 284, and a carbon dioxide gas transfer control valve 314 that acts to regulate flow of carbon dioxide gas from carbon dioxide tank 102 to mixing chamber 284.

Water transfer pump 296 and/or carbonate transfer pump 300 may vary their speeds in order to correspondingly control the flow of water and carbonate supplied to mixing chamber 284. Water transfer pump 296, carbonate transfer pump 300 and carbon dioxide gas transfer control valve 314 may be communicatively coupled to controller 134 (FIG. 2) so that their operation is controllable by controller 134. Controller 134 may control operation of one or more of water transfer pump 296, carbonate transfer pump 300 and carbon dioxide gas transfer control valve 314 in an automated fashion. Water transfer pump 296 may be one of many currently available pumps that are designed to pump liquids. As an example, a Hydra-Cell® T200M Series manufactured by Wanner Engineering, Inc. may be used. Carbonate transfer pump 300 may be one of many currently available pumps that are designed to pump solids. As an example, a NOTOS®: 4 NS—Geared Twin Screw Pump manufactured by Netzsch Pumps & Systems may be used.

Referring still to FIG. 8, water tank 194 includes a water transfer outlet 280, carbonate tank 114 includes a carbonate transfer outlet 282, and carbon dioxide tank 102 includes a carbon dioxide gas transfer outlet 310. Inlet port $\mathbf{286}_1$ of mixing chamber 284 is fluidly connected to water transfer outlet 280 of water tank 194 by water transfer pump 296 and a water transfer line 294. Accordingly, water may exit water tank 194 at water transfer outlet 280, flow through water transfer pump 296 and water transfer line 294, and enter mixing chamber 284 at inlet port $\mathbf{286}_1$. As described above, water transfer pump 296 may act to regulate this flow. Water transfer line 294 may include one or more interconnected conduits, pipes, or the like. As shown, water transfer line 294 includes five interconnected conduits. It will be appreciated that many alternative configurations of water transfer line 294 are possible.

Inlet port $\mathbf{286}_2$ of mixing chamber 284 is fluidly connected to carbonate transfer outlet 282 of carbonate tank 114 by carbonate transfer pump 300 and a carbonate transfer line 298. Accordingly, carbonate may exit carbonate tank 114 at carbonate transfer outlet 282, flow through carbonate transfer pump 300 and carbonate transfer line 298, and enter mixing chamber 284 at inlet port $\mathbf{286}_2$. As described above, carbonate transfer pump 300 may act to regulate this flow. Carbonate transfer line 298 may include one or more interconnected conduits, pipes, or the like. As shown, carbonate transfer line 298 includes a single conduit. It will be appreciated that many alternative configurations of carbonate transfer line 298 are possible.

Inlet port $\mathbf{286}_3$ of mixing chamber 284 is fluidly connected to carbon dioxide gas transfer outlet 310 of carbon dioxide tank 102 by a carbon dioxide gas transfer line 312. Accordingly, carbon dioxide gas may exit carbon dioxide tank 102 at carbon dioxide gas transfer outlet 310, flow through carbon dioxide gas transfer line 312, and enter mixing chamber 284 at inlet port $\mathbf{286}_3$. Carbon dioxide gas transfer control valve 314 may operate between an open position that allows passage of carbon dioxide gas through carbon dioxide gas transfer line 312 and a closed position that blocks passage of carbon dioxide gas through carbon dioxide gas transfer line 312.

Carbon dioxide gas transfer control valve 314 may be located at any point along carbon dioxide gas transfer line 312. In the illustrated example, carbon dioxide gas transfer control valve 314 is located proximate to carbon dioxide gas transfer outlet 310 of carbon dioxide tank 102. In an alternative embodiment, carbon dioxide gas transfer control valve 314 may be located proximate to inlet port $\mathbf{286}_3$ of mixing chamber 284. Carbon dioxide gas transfer line 312 may include one or more interconnected conduits, pipes, or the like. As shown, carbon dioxide gas transfer line 312 includes three interconnected conduits. It will be appreciated that many alternative configurations of carbon dioxide gas transfer line 312 are possible. The one or more conduits, pipes, or the like included in carbon dioxide gas transfer line 312 are preferably constructed of high-strength material(s) that can withstand elevated gas pressure and other operational stress.

Referring still to FIG. 8, mixing chamber delivery conduit 302 extends from a chamber end 302*a* to a delivery end 302*b*. Chamber end 302*a* is fluidly connected to outlet port 288 of mixing chamber 284 so that carbonate solution released therefrom may flow through mixing chamber delivery conduit 302 toward delivery end 302*b*. Delivery end 302*b* may be positioned/oriented (e.g. by a firefighter) so that carbonate solution flowing through mixing chamber delivery conduit 302 is delivered to a targeted area of the fire. Mixing chamber delivery conduit 302 is preferably constructed of high-strength material(s) so that it can withstand elevated pressure and other operational stress.

A user command signal may include a carbonate solution delivery pressure and/or a carbonate concentration. For example, with user interface 142 and/or portable electronic device 148, a firefighter may request that carbonate solution at a carbonate solution delivery pressure of 5 bars and a carbonate concentration of 85% be released from delivery end 302*b* of mixing chamber delivery conduit 302. In response to receiving the user command signal, processor 136 may be further configured to:

(i) transmit a control signal to water transfer pump 296 instructing it to act according to at least one of the carbonate solution delivery pressure and the carbonate concentration, (ii) transmit a control signal to carbonate transfer pump 300 instructing it to act according to at least one of the carbonate solution delivery pressure and the carbonate concentration, (iii) transmit a control signal to carbon dioxide gas transfer control valve 314 instructing it to act according to at least one of the carbonate solution delivery pressure and the carbonate concentration, and/or (iv) transmit a control signal to each mixing element 292 instructing that mixing element to operate according to at least one of the carbonate solution delivery pressure and the carbonate concentration.

Accordingly, controller 134 may regulate production of carbonate solution within mixing chamber 284 by controlling operation of water transfer pump 296, carbonate transfer pump 300, carbon dioxide gas transfer control valve 314, and mixing element(s) 292. Carbonate solution may be one of a carbonate paste, a carbonate foam, and a carbonate and water concentrate solution. In cases where carbonate is mixed with both water and carbon dioxide gas, the carbonate solution may be carbonate foam. In cases in which carbonate is mixed with water, the carbonate solution may be carbonate paste, or a carbonate and water concentrate solution. In both cases, carbonate concentration is preferably kept high in order to minimize water use. A reduction in water use may, in turn, reduce water damage and water runoffs that can carry toxic chemicals from the fire to one or more of soil, sewer systems, and nearby water tables.

As described above, in addition to performing a mixing function, mixing element(s) 292 may act to propel the carbonate solution through mixing chamber delivery conduit 302. Accordingly, the control signal transmitted to mixing elements(s) 292 may instruct each to operate at a speed needed to meet the requested carbonate delivery pressure.

In the illustrated example, apparatus 100 also includes a carbonate transfer control valve 304 that may act to further regulate flow of carbonate from carbonate tank 114 to mixing chamber 284. In this way, carbonate transfer control valve 304 and carbonate transfer pump 300 may work together to regulate flow of carbonate from carbonate tank 114 to mixing chamber 284. Carbonate transfer control valve 304 may be communicatively coupled to controller 134 (FIG. 2) so that its operation is controllable by controller 134. Controller 134 may control operation of carbonate transfer control valve 304 in an automated fashion. In an alternative embodiment, apparatus 100 may not include a carbonate transfer control valve 304.

Referring still to FIG. 8, carbonate transfer control valve 304 may be located at any point along carbonate transfer line 298. In the illustrated example, carbonate transfer control valve 304 is located downstream of carbonate transfer pump 300. In this location, carbonate transfer control valve 304 may act to "fine-tune" the flow of carbonate between carbonate transfer pump 300 and mixing chamber 284. Alternatively, carbonate transfer control valve 304 may be located proximate to inlet port $\mathbf{286}_2$ of mixing chamber 284. Carbonate transfer control valve 304 may operate between an (i) open position that allows passage of carbonate through carbonate transfer line 298, and (ii) a closed position that blocks passage of carbonate through carbonate transfer line 298.

In response to receiving the user command signal, processor 136 may be further configured to:

transmit a control signal to carbonate transfer control valve 304 instructing it to act according to at least one of the carbonate solution delivery pressure and the carbonate concentration.

As an example, the control signal transmitted to carbonate transfer control valve 304 may instruct it to operate in the closed position while carbonate transfer pump 300 is not operating (i.e. off). Accordingly, while carbonate transfer pump 300 is off, carbonate transfer control valve 304 may operate in the closed position to block passage of carbonate through carbonate transfer line 298. Such an arrangement may effectively seal carbonate transfer line 298 downstream of carbonate transfer control valve 304. This may provide one or more advantages. For example, while carbonate transfer control valve 304 operates in the closed position, it may limit or block carbonate that leaks from carbonate transfer pump 300 from pooling in carbonate transfer line 298 and/or entering mixing chamber 284 inadvertently.

In the illustrated example, apparatus 100 also includes a water transfer control valve 306 that may act to further regulate flow of water from water tank 194 to mixing chamber 284. In this way, water transfer control valve 306 and water transfer pump 296 may work together to regulate flow of water from water tank 194 to mixing chamber 284. Water transfer control valve 306 may be communicatively coupled to controller 134 (FIG. 2) so that its operation is controllable by controller 134. Controller 134 may control operation of water transfer control valve 306 in an automated fashion. In an alternative embodiment, apparatus 100 may not include a water transfer control valve 306.

Referring still to FIG. 8, water transfer control valve 306 may be located at any point along water transfer line 294. In the illustrated example, water transfer control valve 306 is located downstream of water transfer pump 296. In this location, water transfer control valve 306 may act to "fine-tune" the flow of water between water transfer pump 296 and mixing chamber 284. Alternatively, water transfer control valve 306 may be located proximate to inlet port $\mathbf{286}_1$ of mixing chamber 284. Water transfer control valve 306 may operate between an (i) open position that allows passage of water through water transfer line 294, and (ii) a closed position that blocks passage of water through water transfer line 294.

In response to receiving the user command signal, processor 136 may be further configured to:

transmit a control signal to water transfer control valve 306 instructing it to act according to at least one of the carbonate solution delivery pressure and the carbonate concentration.

As an example, the control signal transmitted to water transfer control valve 306 may instruct it to operate in the closed position while water transfer pump 296 is not operating (i.e. off). Accordingly, while water transfer pump 296 is off, water transfer control valve 306 may operate in the closed position to block passage of water through water transfer line 294. Such an arrangement may effectively seal water transfer line 294 downstream of water transfer control valve 306. This may provide one or more advantages. For example, while water transfer control valve 306 operates in the closed position, it may limit or block water that leaks from water transfer pump 296 from pooling in water transfer line 294 and/or entering mixing chamber 284 inadvertently.

Carbonate solution may be used to suppress Class B and/or Class C fires. The application of carbonate may be advantageous in one or more applications. For example, carbonate solution may be applied to a burning material. The water within the carbonate solution may cool the burning material by absorbing heat. Once the water evaporates, a layer of carbonate may blanket the burning material. The higher the concentration of carbonate in the carbonate solution, the thicker the layer of carbonate may be.

For example, in cases where carbonate tank 114 holds sodium bicarbonate, the carbonate solution may be referred to as a "sodium bicarbonate solution". Sodium bicarbonate is a known Class B and Class C fire suppressant. Sodium bicarbonate may gradually decompose into sodium carbonate, water, and carbon dioxide at temperatures higher than about 80° C. (176 F). This rate of decomposition may be quicker at higher temperatures, such as at 200° C. (392 F) and above.

Similarly, in cases where carbonate tank 114 holds potassium bicarbonate, the carbonate solution may be referred to as a "potassium bicarbonate solution". Potassium bicarbonate ($KHCO_3$) may be used as a fire suppressant in extinguishing deep-fat fryers and various other Class B fires. Potassium bicarbonate may gradually decompose into potassium carbonate, water, and carbon dioxide at temperatures between about 100° C. (212 F) and about 120° C. (248 F). Potassium bicarbonate is the only dry chemical fire suppression agent recognized by the U.S. National Fire Protection Association for firefighting at airport crash rescue sites.

Figure 10:
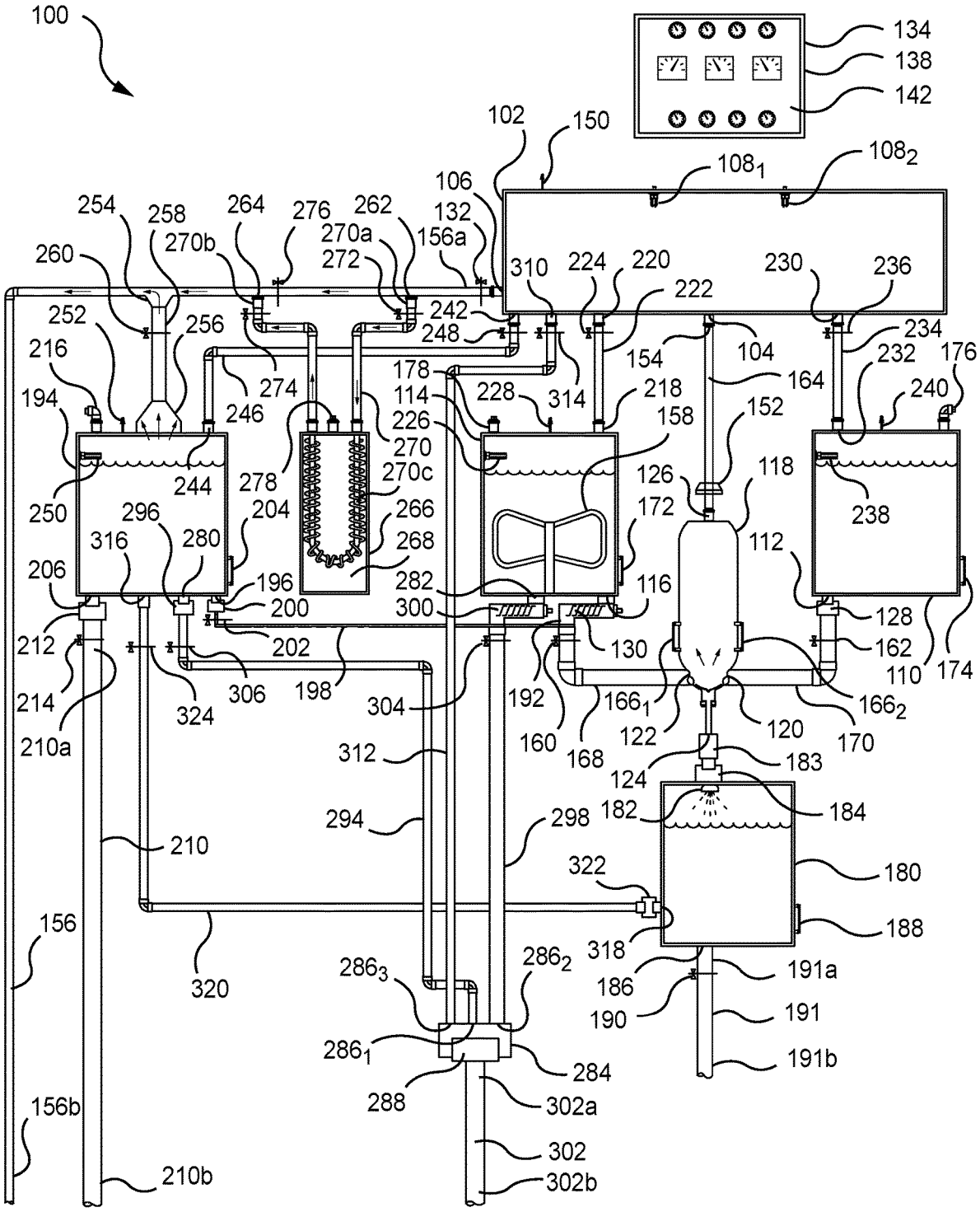
FIG. 10 is a schematic diagram illustrating a firefighting apparatus in accordance with an alternative embodiment.

Reference is now made to FIG. 10, which illustrates another apparatus 100 for fighting fires. Apparatus 100 illustrated in FIG. 10 is analogous to apparatus 100 illustrated in FIG. 8, except for the additional elements and/or features described below. Unless otherwise noted, elements having the same reference numeral have similar structure and/or perform similar function as those in apparatus 100 illustrated in FIG. 8.

As shown, liquid byproduct tank 180 is fluidly connected to water tank 194 so that liquid byproduct may be conveyed from liquid byproduct tank 180 to water tank 194. Apparatus 100 includes an exchange pump 322 that may act to regulate flow of liquid byproduct from liquid byproduct tank 180 to water tank 194. This may provide one or more advantages. For example, if the water level within water tank 194 is low (i.e. below the water low level limit), liquid byproduct may be conveyed to water tank 194 to at least partially refill water tank 194. For cases where there are no nearby sources of water to refill water tank 194, the ability to replenish water tank 194 with liquid byproduct may be an important advantage.

Additionally, the boiling point of liquid byproduct may be higher than the boiling point of water (100° C. at atmospheric pressure). For example, the boiling point of sodium acetate (a liquid byproduct when acid tank 110 holds acetic acid and carbonate tank 114 holds sodium bicarbonate) is 120° C. (at atmospheric pressure). As a result, when sodium acetate is added to water tank 194, it may raise the boiling/evaporation point of the resulting mixture (i.e. water plus sodium acetate). The greater the proportion of sodium acetate relative to water, the higher the boiling/evaporation point will rise. When applied to a fire, this mixture can absorb a larger amount of heat than water only since a higher temperature is needed to evaporate it.

Exchange pump 322 may vary speeds in order to control the flow of liquid byproduct conveyed to water tank 194. Exchange pump 322 may be communicatively coupled to controller 134 (FIG. 2) so that its operation is controllable by controller 134. Controller 134 may control operation of exchange pump 322 in an automated fashion. Exchange pump 322 may be one of many currently available pumps that are that are suited for pumping corrosive liquids. As an example, a Hydra-Cell® T200M Series manufactured by Wanner Engineering, Inc. may be used.

Referring still to FIG. 10, water tank 194 includes an exchange port 316 and liquid byproduct tank 180 includes an exchange port 318. Exchange port 316 of water tank 194 is fluidly connected to exchange port 318 of liquid byproduct tank 180 by exchange pump 318 and an exchange line 320. Accordingly, liquid byproduct may exit liquid byproduct tank 180 at exchange port 318, flow through exchange pump 322 and exchange line 320, and enter water tank 194 at exchange port 316. As described above, exchange pump 322 may act to regulate this flow. Exchange line 320 may include one or more interconnected conduits, pipes, or the like. As shown, water transfer line 294 includes two interconnected conduits arranged at a right angle. It will be appreciated that many alternative configurations of exchange line 320 are possible.

In the illustrated example, exchange pump 322 is connected directly to exchange port 318 of liquid byproduct tank 180. However, in alternative embodiments, exchange pump 322 may be positioned in another suitable location. For example, exchange pump 322 may be connected to exchange port 316 of water tank 194. Alternatively, exchange pump 322 may be connected between conduits of exchange line 320.

Processor 136 may be further configured to:

(i) receive, from level sensor(s) 204 of water tank 194, an input signal including the water level, (ii) receive, from level sensor(s) 188 of liquid byproduct tank 180, an input signal including the liquid byproduct level, and/or (iii) transmit a control signal to exchange pump 322 instructing it act according to at least one of the water level within the water tank and the liquid byproduct level within the liquid byproduct tank.

As an example, the control signal transmitted to exchange pump 322 may instruct it to act (i.e. operate) while the water level within water tank 194 is below the water low level limit. In this way, exchange pump 322 may be activated in order to keep the water level at or above the water low level limit. In some cases, the water low level limit may be set just above 0 litres (i.e. before water tank 194 is empty). In these cases, controller 134 may instruct exchange pump 322 to operate in order to prevent water tank 194 from becoming empty.

In the illustrated example, apparatus 100 also includes an exchange control valve 324 that may act to further regulate flow of liquid byproduct from liquid byproduct tank 180 to water tank 194. In this way, exchange control valve 324 and exchange pump 322 may work together to regulate flow of liquid byproduct from liquid byproduct tank 180 to water tank 194. Exchange control valve 324 be communicatively coupled to controller 134 (FIG. 2) so that its operation is controllable by controller 134. Controller 134 may control operation of exchange control valve 324 in an automated fashion. In an alternative embodiment, apparatus 100 may not include an exchange control valve 324.

Referring still to FIG. 10, exchange control valve 324 may be located at any point along exchange line 320. In the illustrated example, exchange control valve 324 is located downstream of exchange pump 322 and proximate to exchange port 316 of water tank 194. In this location, exchange control valve 324 may act to "fine-tune" the flow of liquid byproduct between exchange pump 322 and water tank 194. Alternatively, exchange control valve 324 may be located proximate to exchange port 318 of liquid byproduct tank 180. Exchange control valve 324 may operate between an (i) open position that allows passage of liquid byproduct through exchange line 320, and (ii) a closed position that blocks passage of liquid byproduct through exchange line 320.

Processor 136 may be further configured to:

transmit a control signal to exchange control valve 324 instructing it to act according to at least one of the water level within the water tank and the liquid byproduct level within liquid byproduct tank 180.

As an example, the control signal transmitted to exchange control valve 324 may instruct it to operate in the closed position while exchange pump 322 is not operating (i.e. off). Accordingly, while exchange pump 322 is off, exchange control valve 324 may operate in the closed position to block passage of liquid byproduct through exchange line 320. Such an arrangement may effectively seal exchange line 320 downstream of exchange control valve 324. This may provide one or more advantages. For example, while exchange control valve 324 operates in the closed position, it may limit or block liquid byproduct that leaks from exchange pump 322 from entering water tank 194 inadvertently.

In some embodiments, exchange pump 322 may be reversible. In these embodiments, exchange pump 322 may act to regulate flow of liquid byproduct and water between liquid byproduct tank 180 and water tank 194. For example, exchange pump 322 may act in one of i) a forward direction to regulate flow of liquid byproduct from liquid byproduct tank 180, through exchange line 320, to water tank 194, and ii) a backward direction to regulate flow of water from water tank 194, through exchange line 320, to liquid byproduct tank 180. In these embodiments, reversible exchange pump 322 may be one of many currently available "two-way" pumps that are suited for pumping corrosive liquids. As an example, an XR331—SAE B type Pump ø101.6 Flange manufactured by Vivoil may be used.

The control signal transmitted to exchange pump 322 may instruct it to act in the forward direction (i) while the water level within water tank 194 is below the water low level limit and/or (ii) while the liquid byproduct level within liquid byproduct tank 180 exceeds the liquid byproduct high level limit. As described above, the water low level limit may be set just above 0 litres (i.e. before water tank 194 is empty), while the liquid byproduct high level limit may be set slightly below the maximum capacity of liquid byproduct tank 180, for example.

On the other hand, the control signal transmitted to exchange pump 322 may instruct it to act in the backward direction (i) while the water level within water tank 194 exceeds a water high level limit and/or (ii) while the liquid byproduct level within liquid byproduct tank 180 is below a liquid byproduct low level limit. For example, the water high level limit may be set slightly below the maximum capacity of water tank 194. For example, the liquid byproduct low level limit may be set just above 0 litres (i.e. before liquid byproduct tank 180 is empty). In some embodiments, the water high level limit and/or the liquid byproduct low level limit may be stored in memory 140 of controller 134. In these embodiments, the water high level limit and/or the liquid byproduct low level limit may be adjusted as desired (e.g. with user interface 142 and/or portable electronic device 148).

Figure 11:
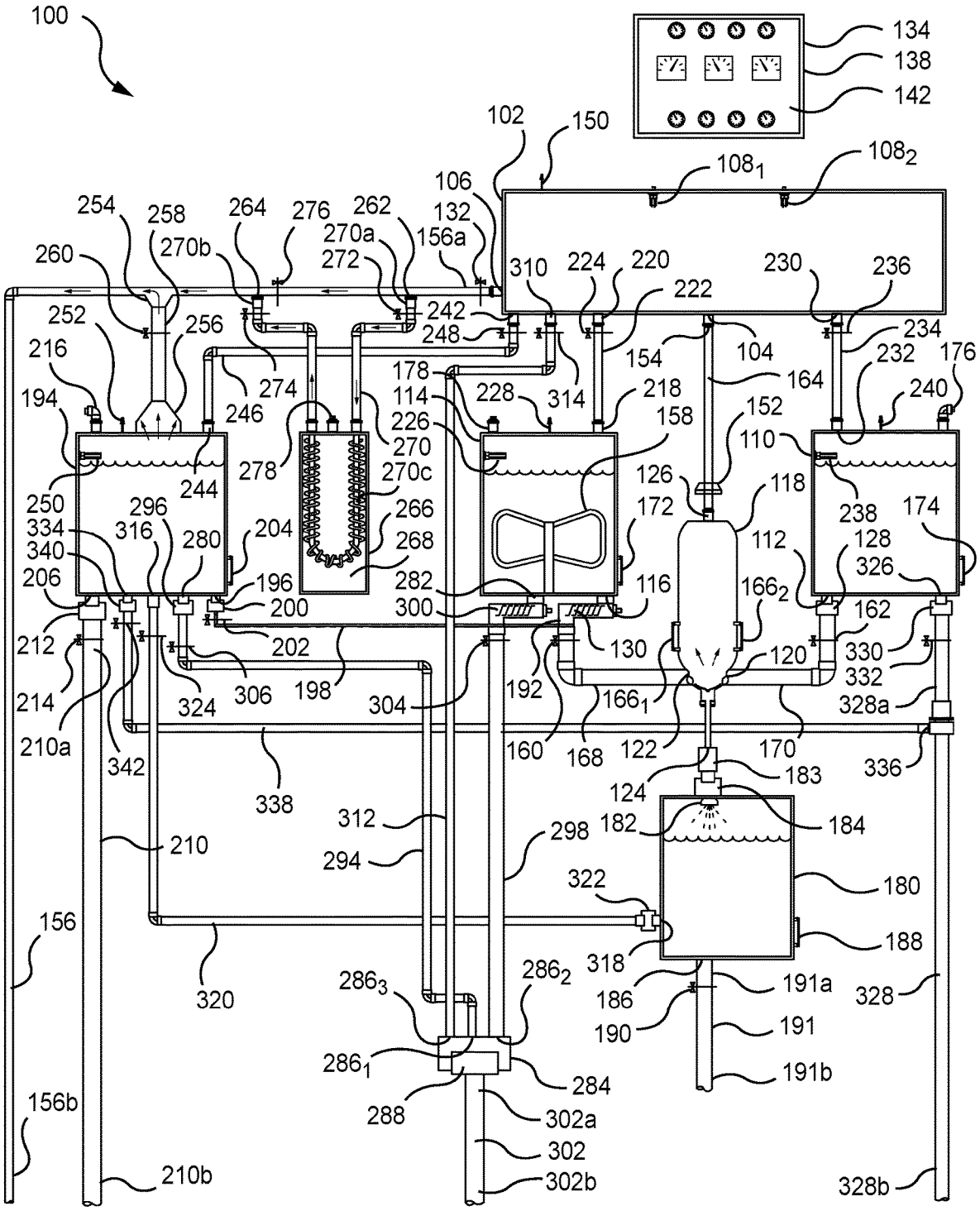
FIG. 11 is a schematic diagram illustrating a firefighting apparatus in accordance with an alternative embodiment.

Reference is now made to FIG. 11, which illustrates another apparatus 100 for fighting fires. Apparatus 100 illustrated in FIG. 11 is analogous to apparatus 100 illustrated in FIG. 10, except for the additional elements and/or features described below. Unless otherwise noted, elements having the same reference numeral have similar structure and/or perform similar function as those in apparatus 100 illustrated in FIG. 10.

As shown, apparatus 100 includes an acid delivery conduit 328 for delivering acid from acid tank 110 to a fire. Acid delivery conduit 328 extends from a tank end 328*a* to a delivery end 328*b*. Tank end 328*a* is fluidly connected to acid tank 110 so that acid released therefrom may flow through acid delivery conduit 328 toward delivery end 328*b*. Delivery end 328*b* may be positioned/oriented (e.g. by a firefighter) so that acid flowing through acid delivery conduit 328 is delivered to a targeted area of the fire. In the illustrated example, acid tank 110 includes an acid delivery outlet 326. As shown, tank end 328*a* of acid delivery conduit 328 is fluidly connected to acid tank 110 at acid delivery outlet 326. Acid delivery conduit 328 is preferably constructed of high-strength, non-corrosive material(s) so that it can withstand acid corrosion, elevated pressure, and other operational stress Referring still to FIG. 11, apparatus 100 includes an acid delivery pump 330 that may act to regulate flow of acid through acid delivery conduit 328. For example, acid delivery pump 330 may vary speeds in order to control the flow of acid through acid delivery conduit 328. Acid delivery pump 330 may be one of many currently available pumps that are designed to pump corrosive liquids. As an example, a Hydra-Cell® T100 M Series manufactured by Wanner Engineering, Inc. may be used. Acid delivery pump 330 may be communicatively coupled to controller 134 (FIG. 2) so that its operation is controllable by controller 134. Controller 134 may control operation of acid delivery pump 330 in an automated fashion.

A user command signal may include an acid delivery pressure. For example, with user interface 142 and/or portable electronic device 148, a firefighter may request that acid at an acid delivery pressure of 4 bars be released from delivery end 328*b* of acid delivery conduit 328. In response to receiving the user command signal, processor 136 may be further configured to:

transmit a control signal to acid delivery pump 330 instructing it to operate according to the acid delivery pressure.

As an example, the control signal transmitted to acid delivery pump 330 may instruct it to operate at a speed needed to release acid from delivery end 328*b* of acid delivery conduit 328 at the acid delivery pressure.

In the illustrated example, apparatus 100 also includes an acid delivery control valve 332 that may act to further regulate flow of acid through acid delivery conduit 328. In this way, acid delivery control valve 332 and acid delivery pump 330 may work together to regulate flow of acid from acid tank 110 through acid delivery conduit 328. Acid delivery control valve 332 may be communicatively coupled to controller 134 (FIG. 2) so that its operation is controllable by controller 134. Controller 134 may control operation of acid delivery control valve 332 in an automated fashion. Alternatively, apparatus 100 may not include an acid delivery control valve 332.

Referring still to FIG. 11, acid delivery control valve 332 may be located at any point along acid delivery conduit 328. In the illustrated example, acid delivery control valve 332 is located downstream of acid delivery pump 330. In this location, acid delivery control valve 332 may act to "fine-tune" the flow of acid through acid delivery conduit 328. Alternatively, acid delivery control valve 332 may be located proximate to delivery end 328*b* of acid delivery conduit 328. Acid delivery control valve 332 may operate between an open position that allows passage of acid through acid delivery conduit 328 and a closed position that blocks passage of acid through acid delivery conduit 328.

In response to receiving the user command signal, processor 136 may be further configured to:

transmit a control signal to acid delivery control valve 332 instructing it to act according to the acid delivery pressure.

As an example, the control signal transmitted to acid delivery control valve 332 may instruct it to operate in the closed position while acid delivery pump 330 is not operating (i.e. off). Accordingly, while acid delivery pump 330 is off, acid delivery control valve 332 may operate in the closed position to block passage of acid through acid delivery conduit 328. Such an arrangement may effectively seal acid delivery conduit 328 downstream of acid delivery control valve 332. This may provide one or more advantages. For example, while acid delivery control valve 332 operates in the closed position, it may limit or block acid that leaks from acid delivery pump 330 from pooling in acid delivery conduit 328 and/or inadvertently leaking out of delivery end 328*b* of acid delivery conduit 328.

In the illustrated example, water tank 194 is fluidly connected to acid delivery conduit 328 so that water may be conveyed from water tank 194 to acid delivery conduit 328. Apparatus 100 includes an acid dilution pump 340 that may act to regulate flow of water from water tank 194 to acid delivery conduit 328. Water may be mixed with acid flowing through acid delivery conduit 328 in order to dilute (i.e. weaken the acid). This may provide one or more advantages. For example, since acid may be diluted with water prior to exiting delivery end 328*b* of acid delivery conduit 328, acid tank 110 may hold highly concentrated acid (e.g. nearly 100% pure acid). This may allow acid tank 110 to be more compact than it might have been otherwise.

Acid dilution pump 340 may vary speeds in order to control the flow of water conveyed to acid delivery conduit 328. Acid dilution pump 340 may be communicatively coupled to controller 134 (FIG. 2) so that its operation is controllable by controller 134. Controller 134 may control operation of acid dilution pump 340 in an automated fashion. Acid dilution pump 340 may be one of many currently available pumps that are that are suited for pumping liquids. As an example, a Hydra-Cell® T200M Series manufactured by Wanner Engineering, Inc. may be used.

Referring still to FIG. 11, water tank 194 includes an acid dilution outlet 334 and acid delivery conduit 328 includes an acid dilution inlet 336. Acid dilution outlet 334 of water tank 194 is fluidly connected to acid dilution inlet 336 of acid delivery conduit 328 by acid dilution pump 340 and an acid dilution line 338. Accordingly, water may exit water tank 194 at acid dilution outlet 334, flow through acid dilution pump 340 and acid dilution line 338, and enter acid delivery conduit 328 at acid dilution inlet 336. As described above, acid dilution pump 340 may act to regulate this flow. Acid dilution line 338 may include one or more interconnected conduits, pipes, or the like. As shown, acid dilution line 338 includes two interconnected conduits arranged at a right angle. It will be appreciated that many alternative configurations of acid dilution line 338 are possible.

In the illustrated example, acid dilution pump 340 is connected directly to acid dilution outlet 334 of water tank 194. However, in alternative embodiments, acid dilution pump 340 may be positioned in another suitable location. For example, acid dilution pump 340 may be connected to acid dilution inlet 336 of acid delivery conduit 328. Alternatively, acid dilution pump 340 may be connected between conduits of acid dilution line 338.

In addition to an acid delivery pressure, a user command signal may include an acid concentration. For example, with user interface 142 or portable electronic device 148, a firefighter may request that acid at an acid delivery pressure of 6 bars and an acid concentration of 70% be released from delivery end 328*b* of acid delivery conduit 328. In response to receiving the user command signal, processor 136 may be further configured to:

transmit a control signal to acid dilution pump 340 instructing it to act according to the acid concentration.

As an example, the control signal transmitted to acid dilution pump 340 may instruct it to operate at a speed needed to dilute acid flowing through acid delivery conduit 328 to the acid concentration. A lower acid concentration may require acid dilution pump 340 to operate at a higher speed than a higher acid concentration because more water needs to be conveyed from water tank 194 to acid delivery conduit 328.

In the illustrated example, apparatus 100 also includes an acid dilution control valve 342 that may act to further regulate flow of water from water tank 194 to acid delivery conduit 328. In this way, acid dilution control valve 342 and acid dilution pump 340 may work together to regulate flow of water from water tank 194 to acid delivery conduit 328. Acid dilution control valve 342 be communicatively coupled to controller 134 (FIG. 2) so that its operation is controllable by controller 134. Controller 134 may control operation of acid dilution control valve 342 in an automated fashion. In an alternative embodiment, apparatus 100 may not include an acid dilution control valve 342.

Referring still to FIG. 11, acid dilution control valve 342 may be located at any point along acid dilution line 338. In the illustrated example, acid dilution control valve 342 is located downstream of acid dilution pump 340. In this location, acid dilution control valve 342 may act to "fine-tune" the flow of water between acid dilution pump 340 and acid delivery conduit 328. Alternatively, acid dilution control valve 342 may be located proximate to acid dilution inlet 336 of acid delivery conduit 328. Acid dilution control valve 342 may operate between an (i) open position that allows passage of water through acid dilution line 338, and (ii) a closed position that blocks passage of liquid byproduct through acid dilution line 338.

In response to receiving the user command signal, processor 136 may be further configured to:

transmit a control signal to acid dilution control valve 342 instructing it to act according to the acid concentration.

As an example, the control signal transmitted to acid dilution control valve 342 may instruct it to operate in the closed position while acid dilution pump 340 is not operating (i.e. off). Accordingly, while acid dilution pump 340 is off, acid dilution control valve 342 may operate in the closed position to block passage of water through acid dilution line 338. Such an arrangement may effectively seal acid dilution line 338 downstream of acid dilution control valve 342. This may provide one or more advantages. For example, while acid dilution control valve 342 operates in the closed position, it may limit or block water that leaks from exchange pump 322 from pooling in acid dilution line 338 and/or entering acid delivery conduit 328 inadvertently.

Acid may be applied together with carbonate solution to suppress Class A and/or Class C fires. In some cases, acid and carbonate solution may be applied concurrently to a fire by respectively orienting delivery end 328*b* of acid delivery conduit 328 and delivery end 302*b* of mixing chamber delivery conduit 302 toward the fire. The acid and carbonate solution may react on the fire surface to form carbon dioxide gas. Since this reaction takes place on or around the fire surface, the carbon dioxide gas produced is well positioned to replace the air surrounding the fire and thereby starve the fire. Additionally, the water within the carbonate solution (and the water that many be mixed with the acid to dilute it to the acid concentration) may cool the burning material by absorbing heat.

In other cases, acid may be applied to a fire after carbonate solution. As described above, carbonate solution may be applied to a burning material. The water within the carbonate solution may cool the burning material by absorbing heat. Once the water evaporates, a layer of carbonate may blanket the burning material. At this point, an application of acid over the layer of carbonate may cause a reaction that produces carbon dioxide gas directly on the fire surface. The liquid byproducts of this reaction (e.g. sodium acetate and water if acetic acid and sodium bicarbonate are the acid and carbonate used) may further cool the burning material by absorbing heat.

Figure 12:
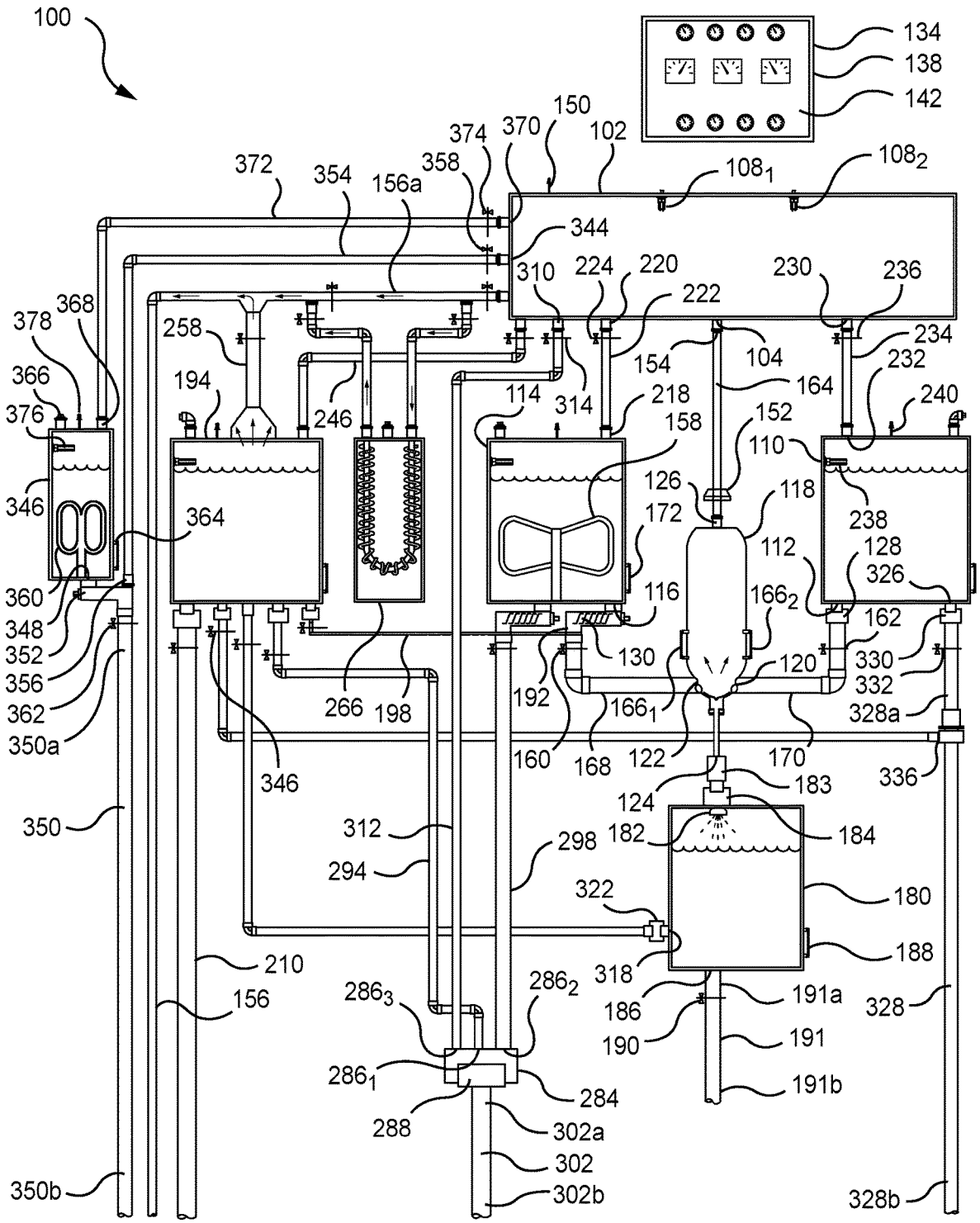
FIG. 12 is a schematic diagram illustrating a firefighting apparatus in accordance with an alternative embodiment.

Reference is now made to FIG. 12, which illustrates another apparatus 100 for fighting fires. Apparatus 100 illustrated in FIG. 12 is analogous to apparatus 100 illustrated in FIG. 11, except for the additional elements and/or features described below. Unless otherwise noted, elements having the same reference numeral have similar structure and/or perform similar function as those in apparatus 100 illustrated in FIG. 11.

As shown, apparatus 100 includes an additional tank 346 for holding fire suppressant. Fire suppressant may include one or more types of salt (e.g. magnesium sulfate salt), one or more types of sand (e.g. granite sand), or a combination thereof. In some embodiments, there may be two or more additional tanks 346 (e.g. one holding salt and one holding sand). Additional tank 346 is preferably constructed from high-strength materials (e.g. titanium, stainless steel, etc.) so that it has the durability to withstand operational stress. In the illustrated example, additional tank 346 includes a loading port 366 that may be used to refill additional tank 346 with fire suppressant. For example, loading port 366 may be connected to a loading device (not shown) in order to refill additional tank 346 with fire suppressant.

In the illustrated example, additional tank 346 includes a stirring element 360. Stirring element 360 acts to mix fire suppressant within additional tank 346 so that the likelihood of solidification may be reduced or even eliminated. For example, stirring element 360 may operate (i.e. rotate) continuously or periodically at a regular interval. Stirring element 360 may be communicatively coupled to controller 134 so that its operation is controllable by controller 134 in an automated fashion.

With reference to FIG. 12, stirring element 360 is illustrated as a multi-arm mixer that rotates to stir the fire suppressant. It will be appreciated that stirring element 360 may be configured differently in alternative embodiments. In one or more alternative embodiments, additional tank 346 may include additional stirring elements 360, e.g. located in different positions to improve mixing distribution. Alternatively, additional tank 346 may not include a stirring element 360.

Referring still to FIG. 12, additional tank 346 also includes a fire suppressant delivery conduit 350 for delivering fire suppressant from additional tank 346 to a fire. Fire suppressant delivery conduit 350 extends from a tank end 350*a* to a delivery end 350*b*. Tank end 350*a* is fluidly connected to additional tank 346 so that fire suppressant released therefrom may flow through fire suppressant delivery conduit 350 toward delivery end 350*b*. Delivery end 350*b* may be positioned/oriented (e.g. by a firefighter) so that fire suppressant flowing through fire suppressant delivery conduit 350 is delivered to a targeted area of the fire. In the illustrated example, additional tank 346 includes a fire suppressant outlet 348. As shown, tank end 350*a* of fire suppressant delivery conduit 350 is fluidly connected to additional tank 346 at fire suppressant outlet 348. Fire suppressant delivery conduit 350 is preferably constructed of high-strength material(s) so that it can withstand elevated pressure and operational stress.

Apparatus 100 also includes a fire suppressant pump 352 that may act to regulate flow of fire suppressant through fire suppressant delivery conduit 350. For example, fire suppressant delivery pump 352 may vary speeds in order to control the flow of fire suppressant through fire suppressant delivery conduit 350. Fire suppressant delivery pump 352 may be one of many currently available pumps that are designed to pump solids. As an example, a N.Mac® Twin Shaft Grinder manufactured by Netzsch Pumps & Systems may be used. Fire suppressant delivery pump 352 may be communicatively coupled to controller 134 (FIG. 2) so that its operation is controllable by controller 134. Controller 134 may control operation of fire suppressant delivery pump 352 in an automated fashion.

Referring still to FIG. 12, fire suppressant delivery conduit 350 is fluidly connected to carbon dioxide tank 102 so that carbon dioxide gas from carbon dioxide tank 102 is able to propel fire suppressant through fire suppressant delivery conduit 350. Apparatus 100 includes a propulsion control valve 358 that may act to regulate propulsion (i.e. speed) of fire suppressant through fire suppressant delivery conduit 350. Propulsion control valve 358 may be communicatively coupled to controller 134 (FIG. 2) so that its operation is controllable by controller 134. Controller 134 may control operation of propulsion control valve 358 in an automated fashion.

In the illustrated example, carbon dioxide tank 102 includes a propulsion outlet 344, and fire suppressant delivery conduit 350 includes a propulsion inlet 356. As shown, propulsion outlet 344 of carbon dioxide tank 102 and propulsion inlet 356 of fire suppressant delivery conduit 350 are fluidly connected by a propulsion line 354. Accordingly, carbon dioxide gas may exit carbon dioxide tank 102 at propulsion outlet 344, flow through propulsion line 354, and enter fire suppressant delivery conduit 350 at propulsion inlet 356.

Propulsion line 354 may include one or more interconnected conduits, pipes, or the like. As shown, propulsion line 354 includes two interconnected conduits arranged at a right angle. It will be appreciated that many alternative configurations of propulsion line 354 are possible. The one or more conduits, pipes, or the like included in propulsion line 354 are preferably constructed of high-strength material(s) that can withstand elevated gas pressure and other operational stress.

Propulsion control valve 358 may be located at any point along propulsion line 354. Propulsion control valve 358 may operate between (i) an open position that allows passage of carbon dioxide gas through propulsion line 354, and (ii) a closed position that blocks passage of carbon dioxide gas through propulsion line 354. In the illustrated example, propulsion control valve 358 is located proximate to propulsion outlet 344 of carbon dioxide tank 102. It may be differently located in alternative embodiments. For example, propulsion control valve 358 may be located proximate to propulsion inlet 356 of fire suppressant delivery conduit 350. Alternatively, propulsion control valve 358 may be directly connected to pressurization outlet 344 of carbon dioxide tank 102.

In the illustrated example, tank end 350*a* of fire suppressant delivery conduit 350 is connected to fire suppressant pump 352 which is connected to fire suppressant delivery outlet 348 of additional tank 346. As shown, propulsion inlet 356 of fire suppressant delivery conduit 350 is located at tank end 350*a* of fire suppressant delivery conduit 350. Such an arrangement may provide one or more advantages. For example, a significant portion of fire suppressant's propulsive force through fire suppressant delivery conduit 350 may be provided by pressurized carbon dioxide gas that is conveyed through propulsion line 354 from carbon dioxide tank 102. With the propulsion provided by the pressurized gas, fire suppressant pump 352 may be able to operate at a lower speed. In some cases, fire suppressant pump 352 may act to regulate flow of fire suppressant from additional tank 346 to fire suppressant delivery conduit 350 where pressurized carbon dioxide gas then propels the fire suppressant material through fire suppressant delivery conduit 350. In other cases, the propulsive force provided by pressurized carbon dioxide gas and fire suppressant pump 352 may work together to boost overall propulsion of fire suppressant through fire suppressant delivery conduit 350.

A user command signal may include a fire suppressant delivery pressure. For example, with user interface 142, a firefighter may request that fire suppressant at a fire suppressant delivery pressure of 5 bars be released from delivery end 350*b* of fire suppressant delivery conduit 350. In response to receiving the user command signal, processor 136 may be configured to:

transmit a control signal to fire suppressant pump 352 instructing it to act according to the fire suppressant delivery pressure, and/or transmit a control signal to propulsion control valve 358 instructing it to operate according to the fire suppressing material delivery pressure.

In the illustrated example, apparatus 100 also includes a fire suppressant delivery control valve 362 that may act to further regulate flow of fire suppressant through fire suppressant delivery conduit 350. In this way, fire suppressant delivery control valve 362, fire suppressant pump 352 and propulsion control valve 358 may work together to regulate flow of fire suppressant from additional tank 346 through fire suppressant delivery conduit 350. Fire suppressant delivery control valve 362 may be communicatively coupled to controller 134 (FIG. 2) so that its operation is controllable by controller 134. Controller 134 may control operation of fire suppressant delivery control valve 362 in an automated fashion. Alternatively, apparatus 100 may not include a fire suppressant delivery control valve 362.

Referring still to FIG. 12, fire suppressant delivery control valve 362 may be located at any point along fire suppressant delivery conduit 350. In the illustrated example, fire suppressant delivery control valve 362 is located downstream of fire suppressant pump 352 and propulsion inlet 356. In this location, fire suppressant delivery control valve 362 may act to "fine-tune" the flow (i.e. speed) of fire suppressant through fire suppressant delivery conduit 350. Alternatively, fire suppressant delivery control valve 362 may be located proximate to delivery end 350*b* of fire suppressant delivery conduit 350. Fire suppressant delivery control valve 362 may operate between i) an open position that allows passage of fire suppressant and carbon dioxide gas through fire suppressant delivery conduit 350 and ii) a closed position that blocks passage of fire suppressant and carbon dioxide gas through fire suppressant delivery conduit 350.

In response to receiving the user command signal, processor 136 may be further configured to:

transmit a control signal to fire suppressant delivery control valve 362 instructing it to act according to the fire suppressant delivery pressure.

As an example, the control signal transmitted to fire suppressant delivery control valve 362 may instruct it to operate in the closed position while fire suppressant pump 352 is not operating (i.e. off). Accordingly, while fire suppressant pump 352 is off, fire suppressant delivery control valve 362 may operate in the closed position to block passage of fire suppressant through fire suppressant delivery conduit 350. Such an arrangement may effectively seal fire suppressant delivery conduit 350 downstream of fire suppressant delivery control valve 362. This may provide one or more advantages. For example, while fire suppressant delivery control valve 362 operates in the closed position, it may limit or block fire suppressant that leaks from fire suppressant pump 352 from pooling in fire suppressant delivery conduit 350 and/or inadvertently leaking out of delivery end 350*b* of fire suppressant delivery conduit 350.

Referring still to FIG. 12, additional tank 346 includes a level sensor 364 for measuring a fire suppressant level within additional tank 346. Level sensor 364 may be communicatively coupled to controller 134 (FIG. 2). Level sensor 364 may be one of many currently available level sensors. As an example, level sensor 364 may be a FL-LL—Ultrasonic Liquid Level Sensor manufactured by SMD Fluid Controls. As described above, ultrasonic liquid level sensors work by emitting and detecting the reverberations of high frequency sound waves. Although level sensor 364 is shown located on the side of additional tank 346, an ultrasonic liquid sensor is preferably located at the top of additional tank 346.

In alternative embodiments, additional tank 346 may include multiple level sensors 364, e.g. 2 to 6, or more. The inclusion of multiple level sensors 364 within additional tank 346 may provide one or more advantages. For example, if one or more malfunction, the remaining level sensor(s) 364 may still operate to measure the fire suppressant level within additional tank 346. Depending on the application of apparatus 100, additional tank 346 may experience shifts in orientation. Additional tank 346 is shown right-side up in FIG. 12. However, it may be oriented sideways (i.e. rotated 90° relative to FIG. 12) or in other orientations. Accordingly, the inclusion of level sensors 364 on multiple sides of additional tank 346 may allow the fire suppressant level to be reliably measured across a wide range of additional tank 346 orientations. Alternatively, additional tank 346 may not include level sensor(s) 364.

Processor 136 may be further configured to:

(i) receive, from level sensor(s) 364 of additional tank 346, an input signal including the fire suppressant level within additional tank 346, and (ii) transmit a control signal to fire suppressant pump 352 instructing it to act according to the fire suppressant level within additional tank 346.

As an example, the control signal transmitted to fire suppressant pump 352 may instruct it to turn off (or remain off) while the fire suppressant level within additional tank 346 is below a fire suppressant low level limit. Accordingly, when the fire suppressant level within additional tank 346 is too low, controller 134 may prevent fire suppressant pump 352 from operating (i.e. turning on). In some embodiments, the fire suppressant low level limit may be stored in memory 140 of controller 134. In these embodiments, the fire suppressant low level limit may be adjusted as desired (e.g. with user interface 142 and/or portable electronic device 148).

In some embodiments, processor 136 may receive input signals that include the fire suppressant level from level sensor(s) 364 every minute (or another set time interval, e.g. every 5 seconds). Accordingly, processor 136 may be able to monitor the fire suppressant level over time. In response to determining that the fire suppressant level is below the fire suppressant low level limit, processor 136 may be configured to transmit a signal that includes a low fire suppressant warning. This signal may be transmitted to user interface 142 in which case the low fire suppressant warning may take the form of a flashing light or an auditory alert, for example. Alternatively, or in addition, this signal may be transmitted to portable electronic device 148 in which case the low fire suppressant warning may take the form of a text message, for example. At this point, the firefighter may refill additional tank 346 with fire suppressant or enter a new command (e.g. with user interface 142 and/or portable electronic device 148) that does not require fire suppressant material. Controller 134 may also prevent further use of additional tank 346 (i.e. seal it off from the rest of apparatus 100) in response to determining that the fire suppressant level is below the fire suppressant low level limit.

Referring still to FIG. 12, additional tank 346 is fluidly connected to carbon dioxide tank 102. Accordingly, carbon dioxide gas from carbon dioxide tank 102 may be conveyed to additional tank 346 to pressurize it. Since additional tank 346 may be pressurized with carbon dioxide gas, it is preferably constructed of high-strength material(s) that can withstand elevated gas pressures. In some embodiments, additional tank 346 may not be pressurized.

As shown, apparatus 100 includes an additional tank pressurization control valve 374 that may act to regulate pressurization of additional tank 346. Pressurization control valve 374 may be communicatively coupled to controller 134 (FIG. 2) so that its operation is controllable by controller 134. Controller 134 may control operation of pressurization control valve 374 in an automated fashion.

In the illustrated example, carbon dioxide tank 102 includes a pressurization outlet 370, and additional tank 346 includes a pressurization inlet 368. As shown, pressurization outlet 370 of carbon dioxide tank 102 and pressurization inlet 368 of additional tank 346 are fluidly connected by a pressurization line 372. Accordingly, carbon dioxide gas may exit carbon dioxide tank 102 at pressurization outlet 370, flow through pressurization line 372, and enter additional tank 346 at pressurization inlet 368.

Pressurization line 372 may include one or more interconnected conduits, pipes, or the like. As shown, pressurization line 372 includes two interconnected conduits arranged at a right angle. It will be appreciated that many alternative configurations of pressurization line 372 are possible. The one or more conduits, pipes, or the like included in pressurization line 372 are preferably constructed of high-strength material(s) that can withstand elevated gas pressure and other operational stress.

Pressurization control valve 374 may be located at any point along pressurization line 372. Pressurization control valve 374 may operate between (i) an open position that allows passage of carbon dioxide gas through pressurization line 372, and (ii) a closed position that blocks passage of carbon dioxide gas through pressurization line 372. In the illustrated example, pressurization control valve 374 is located proximate to pressurization outlet 370 of carbon dioxide tank 102. It may be differently located in alternative embodiments. For example, pressurization control valve 374 may be located proximate to pressurization inlet 368 of additional tank 346. Alternatively, pressurization control valve 374 may be connected to pressurization outlet 370 of carbon dioxide tank 102.

Referring still to FIG. 12, additional tank 346 includes a pressure sensor 376 for measuring an additional tank pressure. Pressure sensor 376 may be one of many currently available pressure sensors. As an example, pressure sensor 376 may be DST P92C CAN pressure sensor manufactured by Danfoss Engineering. In alternative embodiments, additional tank 346 may include additional pressure sensors 376, e.g. 3 to 6, or more. For example, in an alternative embodiment, additional tank 346 may include four pressure sensors 376. The inclusion of multiple pressure sensors 376 may provide one or more advantages. For example, if one or more malfunction, the remaining pressure sensor(s) 376 may still operate to measure the additional tank pressure.

Pressure sensor(s) 376 may be communicatively coupled to controller 134 (FIG. 2). Processor 136 may be further configured to:

(i) receive, from pressure sensor(s) 376 of additional tank 346, a input signal including the additional tank pressure, and (ii) transmit a control signal to additional tank pressurization control valve 374 instructing it to act according to the additional tank pressure.

Memory 140 of controller 134 may store a baseline additional tank pressure for additional tank 346. In some embodiments, the baseline additional tank pressure may be a pressure at which additional tank 346 is desirably maintained throughout operation. As an example, while the additional tank pressure level is below the baseline additional tank pressure, the control signal transmitted to additional tank pressurization control valve 374 may instruct it to operate in the open position (i.e. until the additional tank pressure returns to the baseline additional tank pressure). In this way, when the additional tank pressure is too low, controller 134 may instruct pressurization control valve 374 to operate in the open position (e.g. to re-pressurize additional tank 346 to its desired operating pressure). In some embodiments, the baseline additional tank pressure may be adjusted as desired (e.g. with user interface 142 and/or portable electronic device 148).

Referring still to FIG. 12, additional tank 346 includes a pressure relief valve 378. Pressure relief valve 378 may act to regulate release of carbon dioxide gas from additional tank 346. Pressure relief valve 378 may operate between i) an open position that allows carbon dioxide gas to escape and ii) a closed position that blocks escape of carbon dioxide gas. Pressure relief valve 378 may be communicatively coupled to the controller 134 (FIG. 2) so that its operation is controllable by controller 134. Controller 134 may control operation of pressure relief valve 378 in an automated fashion. Processor 136 may be further configured to:

transmit a control signal to pressure relief valve 378 of additional tank 346 instructing it to act according to the additional tank pressure.

As an example, the control signal transmitted to pressure relief valve 378 of additional tank 346 may instruct it to operate in the open position (i.e. to release carbon dioxide gas) while the additional tank pressure exceeds an additional tank pressure threshold. The additional tank pressure threshold may be the pressure rating of additional tank 346 or another safety limit. Accordingly, as a safety measure, pressure relief valve 378 may act (i.e. open and close) to keep the pressure of additional tank 346 below the additional tank pressure threshold. In at least one embodiment, the additional tank pressure threshold may be stored in memory 140 of controller 134. In these embodiments, the additional tank pressure threshold may be adjusted as desired (e.g. with user interface 142 and/or portable electronic device 148). In the event pressure sensor(s) 376 malfunction (or become inoperable for any reason), pressure relief valve 378 may automatically open when the pressure inside additional tank 346 surpasses an upper pressure limit (i.e. by shear mechanical force of the gas pressure).

Pressurizing additional tank 346 may provide one or more advantages. For example, such pressurization may aid operation of fire suppressant pump 352. A significant portion of fire suppressant's pumping force may be provided by the gas pressure within additional tank 346. As a result, fire suppressant pump 352 may not need to work as hard. For example, with the support of the gas pressure, fire suppressant pump 352 may be able to operate at a lower speed. Alternatively, or in addition, pressurizing additional tank 346 may keep fire suppressant held therein moisture-free. If moisture is introduced (or allowed to collect) within additional tank 346, portions of the fire suppressant held therein may solidify. This may lead to clogs and/or damage fire suppressant pump 352. Pressurizing additional tank 346 can significantly reduce the likelihood of solidification.

Alternatively, or in addition, pressurization of additional tank 346 may facilitate the identification of leaks. In some embodiments, processor 136 may be configured to receive input signals from pressure sensor(s) 376 that include the additional tank pressure every minute (or another set time interval, e.g. every 30 seconds). Accordingly, processor 136 may be able to monitor the additional tank pressure over time to identify abnormal drops in pressure. Abnormal drops in pressure over time may be the sign of a leak. In response to identifying an abnormal drop in pressure in additional tank 346, processor 136 may be configured to transmit a signal that includes a pressure drop warning. This signal may be transmitted to user interface 142 in which case the pressure drop warning may take the form of a flashing light or an auditory alert, for example. Alternatively, or in addition, this signal may be transmitted to portable electronic device 148 in which case the pressure drop warning may take the form of a text message, for example. Upon identifying an abnormal pressure drop, controller 134 may also prevent further use of additional tank 346 (i.e. seal it off from the rest of apparatus 100). Alternatively, or in addition, additional tank 346 may be inspected for leaks. In the event a leak is discovered, it may be repaired or additional tank 346 may be replaced.

As described above, fire suppressant held in additional tank 346 may include one or more types of salt, one or more types of sand, or a combination thereof. Salt may be applied together with water to suppress Class A and/or Class C fires. In some cases, water and salt may be applied concurrently to a fire by respectively orienting delivery end **210*b* of water delivery conduit 210 and delivery end 350*b* of fire suppressant delivery conduit 350** toward the fire. Thus, water and salt may mix at the fire surface.

For example, when ammonium chloride ($NH_4Cl$) salt dissolves in water (an endothermic reaction), it can drop the water's temperature to near 0° C. Similarly, when Ammonium nitrate ($NH_4NO_3$) salt dissolves in water, it may nearly freeze the water. Accordingly, these salts may lower the water's temperature when mixed therewith. The heat capacity of water is very high (4184 KJ/kg). Accordingly, when the dissolved salt drops the water temperature 20° C. to 25°

C. below its ambient temperature, for example, it takes much more heat to evaporate it. Consequently, the cooled water can absorb a sizeable amount of heat from the fire and thereby cool it quicker than if the water was not cooled.

As another example, when magnesium sulfate ($MgSO_4$) salt, sodium hydroxide (NaOH) salt and/or calcium chloride ($CaCl_2$) salt dissolve in water (an exothermic reaction), they raise the water's temperature nearly to its boiling point. Such an exothermic reaction may produce steam. As described above, steam may be used to suppress Class A, Class B and/or Class C fires.

High-pressure salt or sand may be used to suppress Class A, Class B and/or Class K fires. Granulated chemical salt may be propelled from delivery end 350*b* of fire suppressant delivery conduit 350 with the aid of high pressure carbon dioxide gas from carbon dioxide tank 102. For example, the application of granulated salt at high pressure may cover hot grease (e.g. kitchen fires) and prevent it from being splattered around. At the same time, the carbon dioxide gas may replace the fire's oxygen, thereby starving the fire.

Similarly, granite sand may be propelled from delivery end 350*b* of fire suppressant delivery conduit 350 with the aid of high pressure carbon dioxide gas from carbon dioxide tank 102. The application of sand at high pressure may also be referred to "sandblasting". For example, sandblasting a crown fire can cut away the tree's branches and leaves that are on fire. Sandblasting may be used to suppress wildfires by cutting down tree branches, leaves and bark that are on fire. Sandblasting may be also be used to fight structural fires by cutting away surfaces and other materials that are on fire. For example, the sand projectiles may exit delivery end 350*b* of fire suppressant delivery conduit 350 with sufficient pressure to cut holes through walls and roofs.

Figure 13:
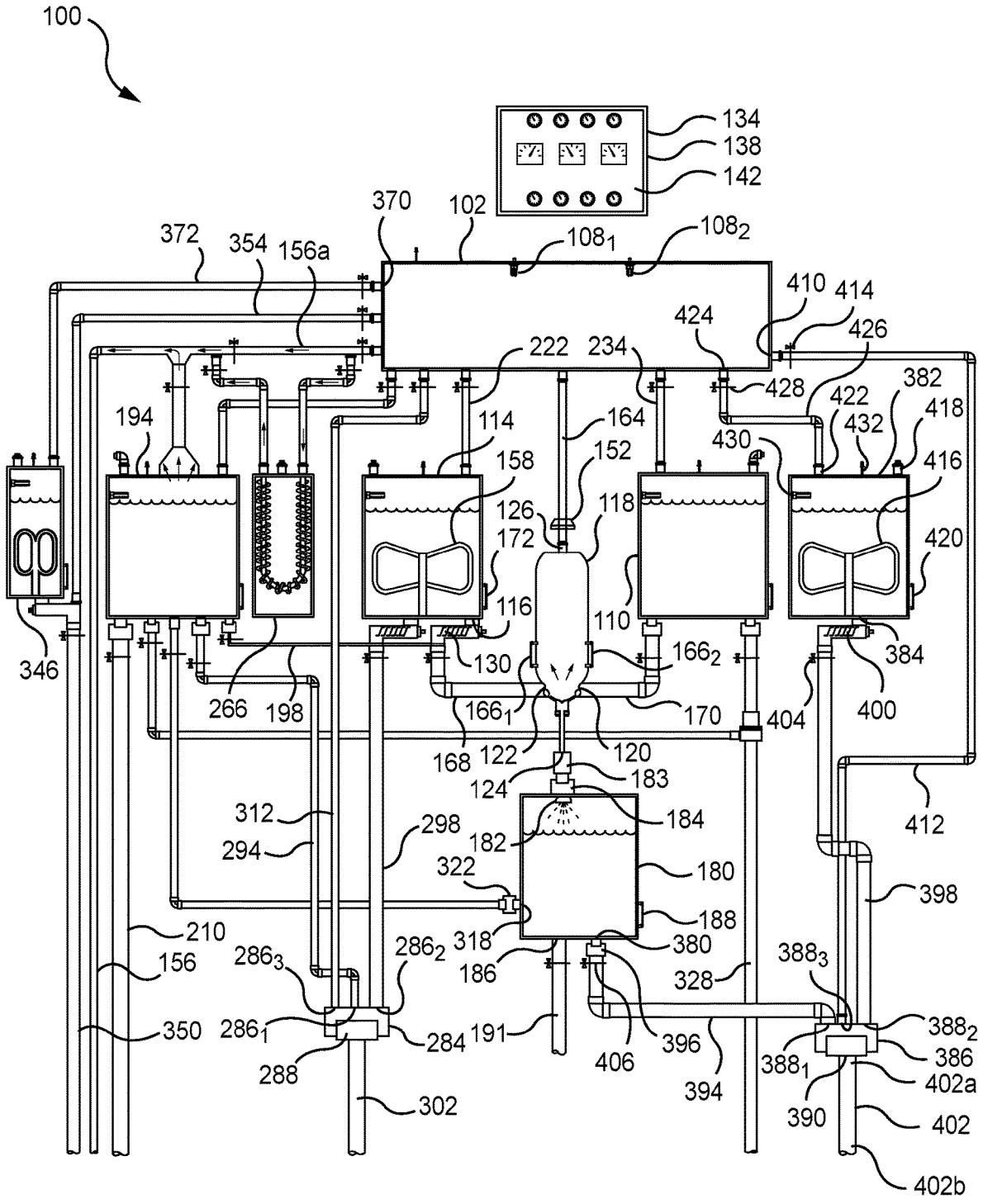
FIG. 13 is a schematic diagram illustrating a firefighting apparatus in accordance with an alternative embodiment.

Reference is now made to FIG. 13, which illustrates another apparatus 100 for fighting fires. Apparatus 100 illustrated in FIG. 13 is analogous to apparatus 100 illustrated in FIG. 12, except for the additional elements and/or features described below. Unless otherwise noted, elements having the same reference numeral have similar structure and/or perform similar function as those in apparatus 100 illustrated in FIG. 12.

As shown, apparatus 100 includes a supplemental tank 382 for holding fire suppressant. Fire suppressant may include silica powder, a chemical compound, or a combination thereof. In some embodiments, there may be two or more supplemental tanks 382 (e.g. one holding silica powder and one holding a chemical compound). Supplemental tank 382 is preferably constructed from high-strength materials (e.g. titanium, stainless steel, etc.) so that it has the durability to withstand operational stress. In the illustrated example, supplemental tank 382 includes a loading port 418 that may be used to refill supplemental tank 382 with fire suppressant. For example, loading port 418 may be connected to a loading device (not shown) in order to refill supplemental tank 382 with fire suppressant.

In the illustrated example, supplemental tank 382 includes a stirring element 416. Stirring element 416 acts to mix fire suppressant within supplemental tank 382 so that the likelihood of solidification may be reduced or even eliminated. For example, stirring element 416 may operate (i.e. rotate) continuously or periodically at a regular interval. Stirring element 416 may be communicatively coupled to controller 134 so that its operation is controllable by controller 134 in an automated fashion.

With reference to FIG. 13, stirring element 416 is illustrated as a multi-arm mixer that rotates to stir the fire suppressant. It will be appreciated that stirring element 416 may be configured differently in alternative embodiments. In one or more alternative embodiments, supplemental tank 382 may include additional stirring elements 416, e.g. located in different positions to improve mixing distribution. Alternatively, supplemental tank 382 may not include a stirring element 416.

Apparatus 100 also includes a mixing chamber 386 that is fluidly connected to each of carbon dioxide tank 102, liquid byproduct tank 180, and supplemental tank 382. One or more of carbon dioxide gas, liquid byproduct and fire suppressant may be conveyed to mixing chamber 386 from carbon dioxide tank 102, liquid byproduct tank 180 and supplemental tank 382, respectively. Within mixing chamber 386, fire suppressant may be mixed with at least one carbon dioxide gas and liquid byproduct to form a fire suppressing solution. As described above, the liquid byproduct may be an aqueous solution of sodium acetate (e.g. when the acid held in acid tank 110 is acetic acid and the carbonate held in carbonate tank 114 is sodium bicarbonate).

In an alternative embodiment (not shown), mixing chamber 386 may be fluidly connected to carbon dioxide tank 102, water tank 194, and supplemental tank 382. Accordingly, one or more of carbon dioxide gas, water and fire suppressant may be conveyed to mixing chamber 386 from carbon dioxide tank 102, water tank 194 and supplemental tank 382, respectively. In these embodiments, the fire suppressing solution may be formed by mixing fire suppressant with at least one carbon dioxide gas and water within mixing chamber 386. In another alternative embodiment (not shown), mixing chamber 386 may be fluidly connected to carbon dioxide tank 102, water tank 194, liquid byproduct tank 180 and supplemental tank 382.

As will be described below, mixing chamber 386 may include one or more mixing elements that act to mix fire suppressant with at least one of carbon dioxide gas and liquid byproduct (or water). Fire suppressing solution may be delivered from mixing chamber 386 to a fire with a mixing chamber delivery conduit 402.

Mixing chamber 386 extends from an inlet end to an outlet end. Mixing chamber 386 includes three inlet ports $\mathbf{388}_1$, $\mathbf{388}_2$ and $\mathbf{388}_3$ at the inlet end, an outlet port 390 at the outlet end, and an internal passage (not shown, but similar to internal passage 290 shown in FIG. 9) that extends between inlet ports 388 and outlet port 390. Mixing chamber 386 also includes at least one mixing element located in the internal passage (not shown, but similar to mixing element(s) 292 shown in FIG. 9). Each mixing element may act (i.e. rotate/spin) to mix fire suppressant with at least one of carbon dioxide gas and liquid byproduct (or water) as they flow through the internal passage. Further, each mixing element may act to propel the fire suppressing solution through mixing chamber delivery conduit 402. Each mixing element may be communicatively coupled to controller 134 so that its operation is controllable by controller 134. Controller 134 may control operation of each mixing element in an automated fashion. Mixing chamber 386 may be one of many currently available inline mixers that are designed to mix two or more materials together. As an example, a Series 7000 Ultra Shear Mixer manufactured by Charlie Ross & Son Company may be used.

Referring still to FIG. 13, apparatus 100 includes a fire suppressant supply pump 400 that acts to regulate flow of fire suppressant from supplemental tank 382 to mixing chamber 386, a liquid byproduct supply pump 396 that acts to regulate flow of liquid byproduct from liquid byproduct tank 180 to mixing chamber 386, and a carbon dioxide gas supply control valve 414 that acts to regulate flow of carbon dioxide gas from carbon dioxide tank 102 to mixing chamber 386.

Fire suppressant supply pump 400 and/or liquid byproduct supply pump 396 may vary their speeds in order to correspondingly control the flow of fire suppressant and liquid byproduct supplied to mixing chamber 386. Fire suppressant supply pump 400, liquid byproduct supply pump 396 and carbon dioxide gas supply control valve 414 may be communicatively coupled to controller 134 (FIG. 2) so that their operation is controllable by controller 134. Controller 134 may control operation of one or more of fire suppressant supply pump 400, liquid byproduct supply pump 396 and carbon dioxide gas supply control valve 414 in an automated fashion. Fire suppressant supply pump 400 may be one of many currently available pumps that are designed to pump solids. As an example, a N.Mac® Twin Shaft Grinder manufactured by Netzsch Pumps & Systems may be used. Liquid byproduct supply pump 396 may be one of many currently available pumps that are designed to pump liquids. As an example, a Hydra-Cell® T200M Series manufactured by Wanner Engineering, Inc. may be used.

Referring still to FIG. 13, supplemental tank 382 includes a fire suppressant supply outlet 384, liquid byproduct tank 180 includes a liquid byproduct supply outlet 380, and carbon dioxide tank 102 includes a carbon dioxide gas supply outlet 410. Inlet port $\mathbf{388}_1$ of mixing chamber 386 is fluidly connected to liquid byproduct supply outlet 380 of liquid byproduct tank 180 by liquid byproduct supply pump 396 and a liquid byproduct supply line 394. Accordingly, liquid byproduct may exit liquid byproduct tank 180 at liquid byproduct supply outlet 380, flow through liquid byproduct supply pump 396 and liquid byproduct supply line 394, and enter mixing chamber 386 at inlet port $\mathbf{388}_1$. As described above, liquid byproduct supply pump 396 may act to regulate this flow. Liquid byproduct supply line 394 may include one or more interconnected conduits, pipes, or the like. As shown, liquid byproduct supply line 394 includes two interconnected conduits arranged at a right angle. It will be appreciated that many alternative configurations of liquid byproduct supply line 394 are possible.

Inlet port $\mathbf{388}_2$ of mixing chamber 386 is fluidly connected to fire suppressant supply outlet 384 of supplemental tank 382 by fire suppressant supply pump 400 and a fire suppressant supply line 398. Accordingly, fire suppressant may exit supplemental tank 382 at fire suppressant supply outlet 384, flow through fire suppressant supply pump 400 and fire suppressant supply line 398, and enter mixing chamber 386 at inlet port $\mathbf{388}_2$. As described above, fire suppressant supply pump 400 may act to regulate this flow. Fire suppressant supply line 398 may include one or more interconnected conduits, pipes, or the like. As shown, fire suppressant supply line 398 includes three interconnected conduits. It will be appreciated that many alternative configurations of fire suppressant supply line 398 are possible.

Inlet port $\mathbf{388}_3$ of mixing chamber 386 is fluidly connected to carbon dioxide gas supply outlet 410 of carbon dioxide tank 102 by a carbon dioxide gas supply line 412. Accordingly, carbon dioxide gas may exit carbon dioxide tank 102 at carbon dioxide gas supply outlet 410, flow through carbon dioxide gas supply line 412, and enter mixing chamber 386 at inlet port $\mathbf{388}_3$. Carbon dioxide gas supply control valve 414 may operate between i) an open position that allows passage of carbon dioxide gas through carbon dioxide gas supply line 412 and ii) a closed position that blocks passage of carbon dioxide gas through carbon dioxide gas supply line 412.

Carbon dioxide gas supply control valve 414 may be located at any point along carbon dioxide gas supply line 412. In the illustrated example, carbon dioxide gas supply control valve 414 is located proximate to carbon dioxide gas supply outlet 410 of carbon dioxide tank 102. In an alternative embodiment, carbon dioxide gas supply control valve 414 may be located proximate to inlet port $\mathbf{388}_3$ of mixing chamber 386. Carbon dioxide gas supply line 412 may include one or more interconnected conduits, pipes, or the like. As shown, carbon dioxide gas supply line 412 includes four interconnected conduits. It will be appreciated that many alternative configurations of carbon dioxide gas supply line 412 are possible. The one or more conduits, pipes, or the like included in carbon dioxide gas supply line 412 are preferably constructed of high-strength material(s) that can withstand elevated gas pressure and other operational stress.

Referring still to FIG. 13, mixing chamber delivery conduit 402 extends from a chamber end 402*a* to a delivery end 402*b*. Chamber end 402*a* is fluidly connected to outlet port 390 of mixing chamber 386 so that fire suppressing solution released therefrom may flow through mixing chamber delivery conduit 402 toward delivery end 402*b*. Delivery end 402*b* may be positioned/oriented (e.g. by a firefighter) so that fire suppressing solution flowing through mixing chamber delivery conduit 402 is delivered to a targeted area of the fire. Mixing chamber delivery conduit 402 is preferably constructed of high-strength material(s) that can withstand elevated pressure and other operational stress.

A user command signal may include a fire suppressing solution delivery pressure and a fire suppressant concentration. For example, with user interface 142 and/or portable electronic device 148, a firefighter may request that fire suppressing solution at a fire suppressing solution delivery pressure of 8 bars and a fire suppressant concentration of 75% be released from delivery end 402*b* of mixing chamber delivery conduit 402. In response to receiving the user command signal, processor 136 may be further configured to:

(i) transmit a control signal to fire suppressant supply pump 400 instructing it to act according to at least one of the fire suppressing solution delivery pressure and the fire suppressant concentration, (ii) transmit a control signal to liquid byproduct supply pump 396 instructing it to act according to at least one of the fire suppressing solution delivery pressure and the fire suppressant concentration, (iii) transmit a control signal to carbon dioxide gas supply control valve 414 instructing it to act according to at least one of the fire suppressing solution delivery pressure and the fire suppressant concentration, and/or (iv) transmit a control signal to each mixing element of mixing chamber 386 instructing that mixing element to operate according to at least one of the fire suppressing solution delivery pressure and the fire suppressant concentration.

Accordingly, controller 134 may regulate production of fire suppressing solution within mixing chamber 386 by controlling operation of fire suppressant supply pump 400, liquid byproduct supply pump 396, carbon dioxide gas supply control valve 414, and the mixing element(s) of mixing chamber 386. As will be described below, when silica powder is held in supplemental tank 382, the fire suppressing solution formed within mixing chamber 386 may be one of silica spray, silica foam and silica paste. Alternatively, when a chemical compound is held in supplemental tank 382, the fire suppressing solution formed within mixing chamber 386 may be one of dry chemical spray, chemical foam, and chemical jelly.

As described above, in addition to performing a mixing function, the mixing element(s) of mixing chamber 386 (e.g. see mixing elements 292 of FIG. 9) may act to propel the fire suppressing solution through mixing chamber delivery conduit 302. Accordingly, the control signal transmitted to mixing elements(s) of mixing chamber 386 may instruct each to operate at a speed needed to meet the requested fire suppressing solution delivery pressure.

In the illustrated example, apparatus 100 also includes a fire suppressant supply control valve 404 that may act to further regulate flow of fire suppressant from supplemental tank 382 to mixing chamber 386. In this way, fire suppressant supply control valve 404 and fire suppressant supply pump 400 may work together to regulate flow of fire suppressant from supplemental tank 382 to mixing chamber 386. Fire suppressant supply transfer control valve 404 may be communicatively coupled to controller 134 (FIG. 2) so that its operation is controllable by controller 134. Controller 134 may control operation of fire suppressant supply control valve 404 in an automated fashion. In an alternative embodiment, apparatus 100 may not include a fire suppressant supply control valve 404.

Referring still to FIG. 13, fire suppressant supply control valve 404 may be located at any point along fire suppressant supply line 398. In the illustrated example, fire suppressant supply control valve 404 is located downstream of fire suppressant supply pump 400. In this location, fire suppressant supply control valve 404 may act to "fine-tune" the flow of fire suppressant between fire suppressant supply pump 400 and mixing chamber 386. Alternatively, fire suppressant supply control valve 404 may be located proximate to inlet port $\mathbf{388}_2$ of mixing chamber 386. Fire suppressant supply control valve 404 may operate between an (i) open position that allows passage of fire suppressant through fire suppressant supply line 398 and (ii) a closed position that blocks passage of fire suppressant through fire suppressant supply line 398.

In response to receiving the user command signal, processor 136 may be further configured to:

transmit a control signal to fire suppressant supply control valve 404 instructing it to act according to at least one of the fire suppressing solution delivery pressure and the fire suppressant concentration.

As an example, the control signal transmitted to fire suppressant supply control valve 404 may instruct it to operate in the closed position while fire suppressant supply pump 400 is not operating (i.e. off). Accordingly, while fire suppressant supply pump 400 is off, fire suppressant supply control valve 404 may operate in the closed position to block passage of fire suppressant through fire suppressant supply line 398. Such an arrangement may effectively seal fire suppressant supply line 398 downstream of fire suppressant supply control valve 404. This may provide one or more advantages. For example, while fire suppressant supply control valve 404 operates in the closed position, it may limit or block fire suppressant that leaks from fire suppressant supply pump 400 from pooling in fire suppressant supply line 398 and/or entering mixing chamber 386 inadvertently.

In the illustrated example, apparatus 100 also includes a liquid byproduct supply control valve 406 that may act to further regulate flow of liquid byproduct from liquid byproduct tank 180 to mixing chamber 386. In this way, liquid byproduct supply control valve 406 and liquid byproduct supply pump 396 may work together to regulate flow of liquid byproduct from liquid byproduct tank 180 to mixing chamber 386. Liquid byproduct supply control valve 406 may be communicatively coupled to controller 134 (FIG. 2) so that its operation is controllable by controller 134. Controller 134 may control operation of liquid byproduct supply control valve 406 in an automated fashion. In an alternative embodiment, apparatus 100 may not include a liquid byproduct supply control valve 406.

Referring still to FIG. 13, liquid byproduct supply control valve 406 may be located at any point along liquid byproduct supply line 394. In the illustrated example, liquid byproduct supply control valve 406 is located downstream of liquid byproduct supply pump 396. In this location, liquid byproduct supply control valve 406 may act to "fine-tune" the flow of liquid byproduct between liquid byproduct supply pump 396 and mixing chamber 386. Alternatively, liquid byproduct supply control valve 406 may be located proximate to inlet port $\mathbf{388}_1$ of mixing chamber 386. Liquid byproduct supply control valve 406 may operate between an (i) open position that allows passage of liquid byproduct through liquid byproduct supply line 394 and (ii) a closed position that blocks passage of liquid byproduct through liquid byproduct line 394.

In response to receiving the user command signal, processor 136 may be further configured to:

transmit a control signal to liquid byproduct supply control valve 406 instructing it to act according to at least one of the fire suppressing solution delivery pressure and the fire suppressant concentration.

As an example, the control signal transmitted to liquid byproduct supply control valve 406 may instruct it to operate in the closed position while liquid byproduct supply pump 396 is not operating (i.e. off). Accordingly, while liquid byproduct supply pump 396 is off, liquid byproduct supply control valve 406 may operate in the closed position to block passage of liquid byproduct through liquid byproduct supply line 394. Such an arrangement may effectively seal liquid byproduct supply line 394 downstream of liquid byproduct supply control valve 406. This may provide one or more advantages. For example, while liquid byproduct supply control valve 406 operates in the closed position, it may limit or block water that leaks from liquid byproduct supply pump 396 from pooling in liquid byproduct supply line 394 and/or entering mixing chamber 386 inadvertently.

Referring still to FIG. 13, supplemental tank 382 includes a level sensor 420 for measuring a fire suppressant level within supplemental tank 382. Level sensor 420 may be communicatively coupled to controller 134 (FIG. 2). Level sensor 420 may be one of many currently available level sensors. As an example, level sensor 420 may be a FL-LL—Ultrasonic Liquid Level Sensor manufactured by SMD Fluid Controls. As described above, ultrasonic liquid level sensors work by emitting and detecting the reverberations of high frequency sound waves. Although level sensor 420 is shown located on the side of supplemental tank 382, an ultrasonic liquid sensor is preferably located at the top of supplemental tank 382.

In alternative embodiments, supplemental tank 382 may include multiple level sensors 420, e.g. 2 to 6, or more. The inclusion of multiple level sensors 420 within supplemental tank 382 may provide one or more advantages. For example, if one or more malfunction, the remaining level sensor(s) 420 may still operate to measure the fire suppressant level within supplemental tank 382. Depending on the application of apparatus 100, supplemental tank 382 may experience shifts in orientation. Supplemental tank 382 is shown right-side up in FIG. 13. However, it may be oriented sideways (i.e. rotated 90° relative to FIG. 13) or in other orientations. Accordingly, the inclusion of level sensors 420 on multiple sides of supplemental tank 382 may allow the fire suppressant level to be reliably measured across a wide range of supplemental tank 382 orientations. Alternatively, supplemental tank 382 may not include level sensor(s) 420.

Processor 136 may be further configured to:

(i) receive, from level sensor(s) 420 of supplemental tank 382, an input signal including the fire suppressant level within supplemental tank 382, and (ii) transmit a control signal to fire suppressant supply pump 400 instructing it to act according to the fire suppressant level within supplemental tank 382.

As an example, the control signal transmitted to fire suppressant supply pump 400 may instruct it to turn off (or remain off) while the fire suppressant level within supplemental tank 382 is below a fire suppressant low level limit. Accordingly, when the fire suppressant level within supplemental tank 382 is too low, controller 134 may prevent fire suppressant supply pump 400 from operating (i.e. turning on). In some embodiments, the fire suppressant low level limit may be stored in memory 140 of controller 134. In these embodiments, the fire suppressant low level limit may be adjusted as desired (e.g. with user interface 142 and/or portable electronic device 148).

In some embodiments, processor 136 may receive input signals that include the fire suppressant level from level sensor(s) 420 every minute (or another set time interval, e.g. every 5 seconds). Accordingly, processor 136 may be able to monitor the fire suppressant level over time. In response to determining that the fire suppressant level is below the fire suppressant low level limit, processor 136 may be configured to transmit a signal that includes a low fire suppressant warning. This signal may be transmitted to user interface 142 in which case the low fire suppressant warning may take the form of a flashing light or an auditory alert, for example. Alternatively, or in addition, this signal may be transmitted to portable electronic device 148 in which case the low fire suppressant warning may take the form of a text message, for example. At this point, the firefighter may refill supplemental tank 382 with fire suppressant or enter a new command (e.g. with user interface 142 and/or portable electronic device 148) that does not require fire suppressant material. Controller 134 may also prevent further use of supplemental tank 382 (i.e. seal it off from the rest of apparatus 100) in response to determining that the fire suppressant level is below the fire suppressant low level limit.

Referring still to FIG. 13, supplemental tank 382 is fluidly connected to carbon dioxide tank 102. Accordingly, carbon dioxide gas from carbon dioxide tank 102 may be conveyed to supplemental tank 382 to pressurize it. Since supplemental tank 382 may be pressurized with carbon dioxide gas, it is preferably constructed of high-strength material(s) that can withstand elevated gas pressures. In some embodiments, supplemental tank 382 may not be pressurized.

As shown, apparatus 100 includes a supplemental tank pressurization control valve 428 that may act to regulate pressurization of supplemental tank 382. Pressurization control valve 428 may be communicatively coupled to controller 134 (FIG. 2) so that its operation is controllable by controller 134. Controller 134 may control operation of pressurization control valve 428 in an automated fashion.

In the illustrated example, carbon dioxide tank 102 includes a pressurization outlet 424, and supplemental tank 382 includes a pressurization inlet 422. As shown, pressurization outlet 424 of carbon dioxide tank 102 and pressurization inlet 422 of supplemental tank 382 are fluidly connected by a pressurization line 426. Accordingly, carbon dioxide gas may exit carbon dioxide tank 102 at pressurization outlet 424, flow through pressurization line 426, and enter supplemental tank 382 at pressurization inlet 422.

Pressurization line 426 may include one or more interconnected conduits, pipes, or the like. As shown, pressurization line 426 includes three interconnected conduits. It will be appreciated that many alternative configurations of pressurization line 426 are possible. The one or more conduits, pipes, or the like included in pressurization line 426 are preferably constructed of high-strength material(s) that can withstand elevated gas pressure and other operational stress.

Pressurization control valve 428 may be located at any point along pressurization line 426. Pressurization control valve 428 may operate between (i) an open position that allows passage of carbon dioxide gas through pressurization line 426, and (ii) a closed position that blocks passage of carbon dioxide gas through pressurization line 426. In the illustrated example, pressurization control valve 428 is located proximate to pressurization outlet 424 of carbon dioxide tank 102. It may be differently located in alternative embodiments. For example, pressurization control valve 428 may be located proximate to pressurization inlet 422 of supplemental tank 382. Alternatively, pressurization control valve 428 may be connected to pressurization outlet 424 of carbon dioxide tank 102.

Referring still to FIG. 13, supplemental tank 382 includes a pressure sensor 430 for measuring a supplemental tank pressure. Pressure sensor 430 may be one of many currently available pressure sensors. As an example, pressure sensor 430 may be a DST P92C CAN pressure sensor manufactured by Danfoss Engineering. In alternative embodiments, supplemental tank 382 may include additional pressure sensors 430, e.g. 3 to 6, or more. For example, in an alternative embodiment, supplemental tank 382 may include four pressure sensors 430. The inclusion of multiple pressure sensors 430 may provide one or more advantages. For example, if one or more malfunction, the remaining pressure sensor(s) 430 may still operate to measure the supplemental tank pressure.

Pressure sensor(s) 430 may be communicatively coupled to controller 134 (FIG. 2). Processor 136 may be further configured to:

(i) receive, from pressure sensor(s) 430 of supplemental tank 382, a input signal including the supplemental tank pressure, and (ii) transmit a control signal to supplemental tank pressurization control valve 428 instructing it to act according to the supplemental tank pressure.

Memory 140 of controller 134 may store a baseline supplemental tank pressure for supplemental tank 382. In some embodiments, the baseline supplemental tank pressure may be a pressure at which supplemental tank 382 is desirably maintained throughout operation. As an example, while the supplemental tank pressure level is below the baseline supplemental tank pressure, the control signal transmitted to supplemental tank pressurization control valve 428 may instruct it to operate in the open position (i.e. until the supplemental tank pressure returns to the baseline supplemental tank pressure). In this way, when the supplemental tank pressure is too low, controller 134 may instruct pressurization control valve 428 to operate in the open position (e.g. to re-pressurize supplemental tank 382 to its desired operating pressure). In some embodiments, the baseline supplemental tank pressure may be adjusted as desired (e.g. with user interface 142 and/or portable electronic device 148).

Referring still to FIG. 13, supplemental tank 382 includes a pressure relief valve 432. Pressure relief valve 432 may act to regulate release of carbon dioxide gas from supplemental tank 382. Pressure relief valve 432 may operate between an open position that allows carbon dioxide gas to escape and a closed position that blocks escape of carbon dioxide gas. Pressure relief valve 432 may be communicatively coupled to the controller 134 (FIG. 2) so that its operation is controllable by controller 134. Controller 134 may control operation of pressure relief valve 432 in an automated fashion. Processor 136 may be further configured to:

transmit a control signal to pressure relief valve 432 of supplemental tank 382 instructing it to act according to the supplemental tank pressure.

As an example, the control signal transmitted to pressure relief valve 432 of supplemental tank 382 may instruct it to operate in the open position (i.e. to release carbon dioxide gas) while the supplemental tank pressure exceeds a supplemental tank pressure threshold. The supplemental tank pressure threshold may be the pressure rating of supplemental tank 382 or another safety limit. Accordingly, as a safety measure, pressure relief valve 432 may act (i.e. open and close) to keep the pressure of supplemental tank 382 below the supplemental tank pressure threshold. In at least one embodiment, the supplemental tank pressure threshold may be stored in memory 140 of controller 134. In these embodiments, the supplemental tank pressure threshold may be adjusted as desired (e.g. with user interface 142 and/or portable electronic device 148). In the event pressure sensor(s) 376 malfunction (or become inoperable for any reason), pressure relief valve 432 may automatically open when the pressure inside supplemental tank 382 surpasses an upper pressure limit (i.e. by shear mechanical force of the gas pressure).

Pressurizing supplemental tank 382 may provide one or more advantages. For example, such pressurization may aid operation of fire suppressant supply pump 400. A significant portion of the fire suppressant's pumping force may be provided by the gas pressure within supplemental tank 382. As a result, fire suppressant supply pump 400 may not need to work as hard. For example, with the support of the gas pressure, fire suppressant supply pump 400 may be able to operate at a lower speed. Alternatively, or in addition, pressurizing supplemental tank 382 may keep fire suppressant held therein moisture-free. If moisture is introduced (or allowed to collect) within supplemental tank 382, portions of the fire suppressant held therein may solidify. This may lead to clogs and/or damage fire suppressant supply pump 400. Pressurizing supplemental tank 382 can significantly reduce the likelihood of solidification.

Alternatively, or in addition, pressurization of supplemental tank 382 may facilitate the identification of leaks. In some embodiments, processor 136 may be configured to receive input signals from pressure sensor(s) 430 that include the supplemental tank pressure every minute (or another set time interval, e.g. every 5 seconds). Accordingly, processor 136 may be able to monitor the supplemental tank pressure over time to identify abnormal drops in pressure. Abnormal drops in pressure over time may be the sign of a leak. In response to identifying an abnormal drop in pressure in supplemental tank 382, processor 136 may be configured to transmit a signal that includes a pressure drop warning. This signal may be transmitted to user interface 142 in which case the pressure drop warning may take the form of a flashing light or an auditory alert, for example. Alternatively, or in addition, this signal may be transmitted to portable electronic device 148 in which case the pressure drop warning may take the form of a text message, for example. Upon identifying an abnormal pressure drop, controller 134 may also prevent further use of supplemental tank 382 (i.e. seal it off from the rest of apparatus 100). Alternatively, or in addition, supplemental tank 382 may be inspected for leaks. In the event a leak is discovered, it may be repaired or supplemental tank 382 may be replaced.

Silica powder may be used to suppress Class A, Class B and/or Class C fires. Silica is the most abundant and readily available material on the Earth. It is inexpensive to process, store and use. Its use may reduce costs associated with fire suppression, while providing excellent firefighting capability.

Mixing chamber 386 may produce silica spray by mixing silica power (from supplemental tank 382) with carbon dioxide gas (from carbon dioxide tank 102). No liquid byproduct (or water) is needed to produce silica spray within mixing chamber 386. The silica spray may be ejected from delivery end 402*b* of mixing chamber delivery conduit 402 with the aid of high pressure carbon dioxide gas from carbon dioxide tank 102. When directed at a fire, the fine silica powder may act to blanket the fire and thereby suffocate it. The blanket of silica powder may break the chain reaction in a liquid and/or gas fire (something the application of water cannot do). Additionally, since the silica powder is applied with carbon dioxide gas, the carbon dioxide gas may act as an additional fire suppressant by replacing the air surrounding the fire.

Mixing chamber 386 may produce silica foam by mixing silica powder (from supplemental tank 382) with liquid byproduct (from liquid byproduct tank 180) and carbon dioxide gas (from carbon dioxide tank 102). The silica foam may be ejected from delivery end 402*b* of mixing chamber delivery conduit 402 with the aid of high pressure carbon dioxide gas from carbon dioxide tank 102. Silica foam may be used to suppress for Class A and/or Class B fires. Again, as is the case with silica spray described above, the carbon dioxide gas may act as an additional fire suppressant by replacing the air surrounding the fire.

Mixing chamber 386 may produce silica paste by mixing silica powder (from supplemental tank 382) with liquid byproduct (from liquid byproduct tank 180). No carbon dioxide gas is needed to produce silica paste within mixing chamber 386. The amount of liquid byproduct (or water) supplied to mixing chamber 386 may determine the viscosity of the silica paste produced. When a limited amount of liquid byproduct (or water) is suppled to mixing chamber 386, the silica paste will be thicker (i.e. more viscous). The silica paste may be ejected from delivery end 402*b* of mixing chamber delivery conduit 402 with propulsion provided by the mixing elements of mixing chamber 386 (e.g. see mixing elements 292 of FIG. 9).

Silica paste may be an effective suppressant of flash-over fires. For example, silica paste may be applied on surfaces that carry high risk of flash-over fires, e.g. like rooftops, flat surfaces, walls, columns, etc. The application of silica paste may also prevent smoke damages caused by fires. Further, silica paste also acts as resource-efficient fire suppressant for wildfires to avoid the massive use of water that is typically sprayed on homes and other structures. For example, a firefighter may apply silica paste on a home in a wildfire zone using only the small amount of water needed to form the silica paste within mixing chamber 386. The applied silica paste may dry and cover the home to prevent ignition when struck by the embers of the wildfire.

Chemical powder may be used to suppress Class A, Class B, Class C, Class D and/or Class K fires. The specific chemical powder held within supplemental tank 382 may be varied for each fire type. For example, the chemical powder held in supplemental tank 382 may include monoammonium phosphate, sodium hydroxide, sodium polyacrylate, huntite, hydromagnesite, aluminum hydroxide, magnesium hydroxide, acrylic acid, soy protein, or a combination thereof. Once applied to the fire, the chemical powder decomposes via an endothermic reaction, absorbing heat and releasing both water and carbon dioxide in the process. Accordingly, their use as fire suppressants provide fire retardant properties to the materials with which they are mixed.

Mixing chamber 386 may produce a dry chemical spray by mixing chemical powder (from supplemental tank 382) with carbon dioxide gas (from carbon dioxide tank 102). No liquid byproduct (or water) is needed to produce dry chemical spray within mixing chamber 386. The dry chemical spray may be ejected from delivery end 402*b* of mixing chamber delivery conduit 402 with the aid of high pressure carbon dioxide gas from carbon dioxide tank 102. Dry chemical spray may be an effective Class B and/or Class C fire suppressant. When directed at a fire, the fine chemical powder may act to blanket the fire and thereby suffocate it. The blanket of chemical powder may break the chain reaction in a liquid and/or gas fire (something the application of water cannot do). Additionally, since the dry chemical powder is applied with carbon dioxide gas, the carbon dioxide gas may act as an additional fire suppressant by replacing the air surrounding the fire.

Mixing chamber 386 may produce chemical foam by mixing chemical powder (from supplemental tank 382) with liquid byproduct (from liquid byproduct tank 180) and carbon dioxide gas (from carbon dioxide tank 102). The chemical foam may be ejected from delivery end 402*b* of mixing chamber delivery conduit 402 with the aid of high pressure carbon dioxide gas from carbon dioxide tank 102. Chemical foam is an effective Class A and/or Class B fire suppressant. When applied to a fire, chemical foam may expand and blanket the fire, thus starving it of fuel. Also, because chemical foam is mixed with water, it has a cooling effect as well. Again, as is the case with dry chemical spray described above, the carbon dioxide gas may act as an additional fire suppressant by replacing the air surrounding the fire.

In some cases, the chemical powder held in supplemental tank 382 may include a superabsorbent polymer (also called slush powder). Superabsorbent polymers may be able to absorb up to 300 times its weight in water. In these cases, mixing chamber 386 may produce chemical gel (also referred as a hydrogel) by mixing chemical powder (from supplemental tank 382) with liquid byproduct (from liquid byproduct tank 180) or water (from water tank 194). No carbon dioxide gas may be needed to produce hydrogels within mixing chamber 386. The hydrogel may include a network of polymer chains that are hydrophilic. The polymers in the hydrogel may soak up hundreds of times its weight in water creating millions of tiny droplets of water that are surrounded by a polymer shell. The results is a plurality of tiny water droplets that are surrounded by a polymer shell.

The hydrogel may be ejected from delivery end 402*b* of mixing chamber delivery conduit 402 with propulsion provided by the mixing elements of mixing chamber 386 (e.g. see mixing elements 292 of FIG. 9). The hydrogel may have one or more fire retarding properties, e.g. heat absorbing, cooling, expansion, fire resistance, etc. (depending on type of chemical powder/superabsorbent polymer used). Hydrogel may possess similar fire suppression characteristics as silica paste described above, but with the added benefit of heat-retarding properties. As the hydrogel is applied on a surface, the tiny water droplets may stack one on top of one another, forming a layered thermal protective blanket over the surface to which it is applied. In order for the heat of the fire to penetrate this blanket, it must burn off each layer of water droplets and their polymer coating. The polymer shell surrounding each water droplet and their stacked arrangement may significantly prevent water evaporation. As a result, hydrogels can provide thermal protection from fire for extended periods.

In some cases, instead of holding a chemical powder, supplemental tank 382 may hold a liquid chemical. The liquid chemical may be phosphorus-based and/or may include a foaming agent, e.g. sodium laureth sulfate, sodium lauryl ether sulfate, sodium dodecyl sulfate, ammonium lauryl sulfate, etc. In these cases, mixing chamber 386 may produce the fire suppressing solution by mixing liquid chemical (from supplemental tank 382) with carbon dioxide gas (from carbon dioxide tank 102). No liquid byproduct (or water) is needed. When the liquid chemical contains a foaming agent, the fire suppressing solution is a "bubbly" carbon dioxide foam. This foam may be ejected from delivery end 402*b* of mixing chamber delivery conduit 402 with the aid of high pressure carbon dioxide gas from carbon dioxide tank 102. Carbon dioxide foam may be an effective Class K fire suppressant (e.g. fires involving cooking materials). The foam may suppress a fire in two ways. First, the carbon dioxide foam may act to cool the fire. Second, its foam-like nature may act to seal or blanket fire, thereby blocking the chemical reaction and/or preventing re-ignition. Carbon dioxide foam may also be an effective Class A fire suppressant (e.g. fires involving wood, paper and similar materials).

Figure 14:
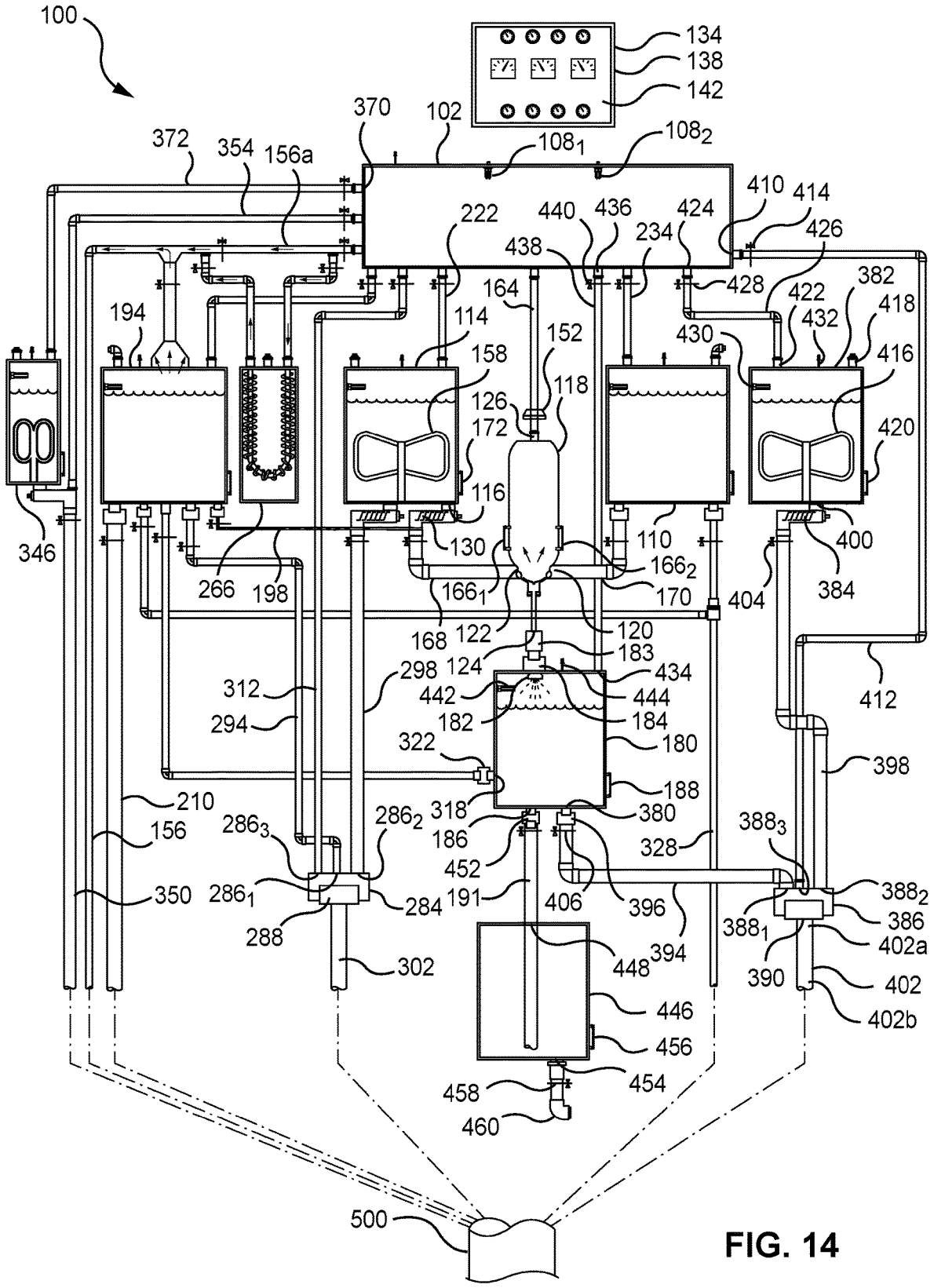
FIG. 14 is a schematic diagram illustrating a firefighting apparatus in accordance with an alternative embodiment.

Reference is now made to FIG. 14, which illustrates another apparatus 100 for fighting fires. Apparatus 100 illustrated in FIG. 14 is analogous to apparatus 100 illustrated in FIG. 13, except for the additional elements and/or features described below. Unless otherwise noted, elements having the same reference numeral have similar structure and/or perform similar function as those in apparatus 100 illustrated in FIG. 13.

As shown, apparatus 100 includes a supplemental liquid byproduct tank 446 that collects liquid byproduct discharged from liquid byproduct tank 180. Supplemental liquid byproduct tank 446 includes a liquid byproduct inlet 448 fluidly connected to liquid byproduct discharge outlet 186 of liquid byproduct tank 180 through liquid byproduct discharge conduit 191. In the illustrated example, delivery end 191*b* of liquid byproduct discharge conduit 191 extends into supplemental liquid byproduct tank 446 through liquid byproduct inlet 448. In this way, liquid byproduct may exit liquid byproduct tank 180 at liquid byproduct discharge outlet 186, flow through liquid byproduct discharge conduit 191, and collect within supplemental discharge tank 446. Supplemental liquid byproduct tank 446 is preferably constructed from high-strength, non-corrosive materials (e.g. stainless steel, aluminum alloy etc.) so that it can withstand acid corrosion and other operational stress.

Apparatus 100 includes a reversible liquid byproduct pump 452 that may act to regulate flow of liquid byproduct between liquid byproduct tank 180 and supplemental liquid byproduct tank 446. In the illustrated example, tank end

191*a* of liquid byproduct discharge conduit 191 is connected to reversible liquid byproduct pump 452 which is connected to liquid byproduct discharge outlet 186 of liquid byproduct tank 180. However, alternative configurations are possible. For example, reversible liquid byproduct pump 452 may be connected to liquid byproduct inlet 448 of supplemental liquid byproduct tank 446 while liquid byproduct discharge conduit 191 connects reversible liquid byproduct pump 452 to liquid byproduct discharge outlet 186 of liquid byproduct tank 180.

Referring still to FIG. 14, liquid byproduct discharge control valve 190 is positioned along liquid byproduct discharge conduit 191 (between reversible liquid byproduct pump 452 and supplemental liquid byproduct tank 446). Such an arrangement may provide one or more advantages. For example, while reversible liquid byproduct pump 452 is not operating (i.e. off), controller 134 may instruct liquid byproduct discharge control valve 190 to operate in the closed position. This may effectively seal liquid byproduct discharge conduit 191, thereby preventing liquid byproduct from inadvertently moving between liquid byproduct tank 180 and supplemental liquid byproduct tank 446.

Reversible liquid byproduct pump 452 may act in in one of i) a forward direction to regulate flow of liquid byproduct from liquid byproduct tank 180, through liquid byproduct discharge conduit 191, to supplemental liquid byproduct tank 446 and ii) a backward direction to regulate flow of liquid byproduct from supplemental liquid byproduct tank 446, through liquid byproduct discharge conduit 191, to the liquid byproduct tank 180. In these embodiments, reversible liquid byproduct pump 452 may be one of many currently available "two-way" pumps that are that are suited for pumping corrosive liquids. As an example, an XR331—SAE B type Pump ø101.6 Flange manufactured by Vivoil may be used.

Processor 136 may be further configured to:

transmit a control signal to reversible liquid byproduct pump 452 instructing it to act according to the liquid byproduct level within liquid byproduct tank 180.

The control signal transmitted to reversible liquid byproduct pump 452 may instruct it to act in the forward direction while the liquid byproduct level within liquid byproduct tank 180 exceeds the liquid byproduct high level limit. As described above, the liquid byproduct high level limit may be set slightly below the maximum capacity of liquid byproduct tank 180. Controller 134 may instruct reversible liquid byproduct pump 452 to operate in the forward direction (i.e. pump liquid byproduct to supplemental liquid byproduct tank 446) when liquid byproduct tank 180 is near maximum capacity.

On the other hand, the control signal transmitted to reversible liquid byproduct pump 452 may instruct it to act in the backward direction while the liquid byproduct level within liquid byproduct tank 180 is below the liquid byproduct low level limit. As described above, the liquid byproduct low level limit may be set just above 0 litres (i.e. before liquid byproduct tank 180 is empty). Controller 134 may instruct reversible liquid byproduct pump 452 to operate in the backward direction (i.e. pump liquid byproduct to liquid byproduct tank 180) when liquid byproduct tank 180 is almost empty. Accordingly, supplemental liquid byproduct tank 446 may provide extra capacity for liquid byproduct and may limit the amount of liquid byproduct that goes to waste. For example, when liquid byproduct tank 180 has capacity for additional liquid byproduct, controller 134 may instruct reversible liquid byproduct pump 452 to pump liquid byproduct from supplemental liquid byproduct tank 446 to liquid byproduct tank 180.

Referring still to FIG. 14, apparatus 100 includes a liquid byproduct disposal conduit 460 for releasing liquid byproduct from supplemental liquid byproduct tank 446. As shown, supplemental liquid byproduct tank 446 includes a liquid byproduct disposal outlet 454. Liquid byproduct disposal conduit 460 is fluidly connected to liquid byproduct disposal outlet 454 so that liquid byproduct released from liquid byproduct disposal outlet 454 of supplemental liquid byproduct tank 446 flows through liquid byproduct disposal conduit 460.

Apparatus 100 also includes a liquid byproduct disposal control valve 458 that may act to regulate flow of liquid byproduct through liquid byproduct disposal conduit 460. Liquid byproduct disposal control valve 458 may operate between an i) open position that allows passage of liquid byproduct through liquid byproduct disposal conduit 460 and ii) a closed position that blocks passage of liquid byproduct through liquid byproduct disposal conduit 460. Liquid byproduct disposal control valve 458 may be communicatively coupled to controller 134 (FIG. 2) so that its operation is controllable by controller 134.

Liquid byproduct disposal control valve 458 may be located at any suitable point along liquid byproduct disposal conduit 460. In the illustrated example, liquid byproduct discharge control valve 190 is located proximate to liquid byproduct disposal outlet 454 of supplemental liquid byproduct tank 446. Alternatively, liquid byproduct disposal control valve 458 may be directly connected to liquid byproduct disposal outlet 454 of supplemental liquid byproduct tank 446.

Referring still to FIG. 14, supplemental liquid byproduct tank 446 includes a level sensor 456 for measuring a liquid byproduct level within supplemental liquid byproduct tank 446. Level sensor 456 may be communicatively coupled to controller 134 (FIG. 2). Level sensor 456 may be one of many currently available level sensors. As an example, level sensor 456 may be a FL-LL—Ultrasonic Liquid Level Sensor manufactured by SMD Fluid Controls. As described above, ultrasonic liquid level sensors work by emitting and detecting the reverberations of high frequency sound waves. Although level sensor 456 is shown located on the side of supplemental liquid byproduct tank 446, an ultrasonic liquid sensor is preferably located at the top of supplemental liquid byproduct tank 446.

In alternative embodiments, supplemental liquid byproduct tank 446 may include multiple level sensors 456, e.g. 2 to 6, or more. The inclusion of multiple level sensors 456 within supplemental liquid byproduct tank 446 may provide one or more advantages. For example, if one or more malfunction, the remaining level sensor(s) 456 may still operate to measure the liquid byproduct level within supplemental liquid byproduct tank 446. Depending on the application of apparatus 100, supplemental liquid byproduct tank 446 may experience shifts in orientation. Supplemental liquid byproduct tank 446 is shown right-side up in FIG. 14. However, it may be oriented sideways (i.e. rotated 90° relative to FIG. 14) or in other orientations. Accordingly, the inclusion of level sensors 456 on multiple sides of supplemental liquid byproduct tank 446 may allow the liquid byproduct level to be reliably measured across a wide range of supplemental liquid byproduct tank 446 orientations. Alternatively, liquid supplemental byproduct tank 446 may not include level sensor(s) 456.

Processor 136 may be further configured to:

(i) receive, from level sensor(s) 456 of supplemental liquid byproduct tank 446, an input signal including the liquid byproduct level within supplemental liquid byproduct tank 446, and (ii) transmit a control signal to liquid byproduct disposal control valve 458 instructing it to act according to the liquid byproduct level within supplemental liquid byproduct tank 446.

The control signal transmitted to liquid byproduct disposal control valve 458 may instruct it to operate in the open position (i.e. to dispose liquid byproduct) while the liquid byproduct level within supplemental liquid byproduct tank 446 exceeds a supplemental liquid byproduct high level limit. For example, the supplemental liquid byproduct high level limit may be set slightly below the maximum capacity of supplemental liquid byproduct tank 446. Accordingly, as a safety measure, controller 134 may instruct liquid byproduct disposal control valve 458 to operate in the open position in order to keep the liquid byproduct level within supplemental liquid byproduct tank 446 below its maximum capacity. In at least one embodiment, the supplemental liquid byproduct high level limit may be stored in memory 140 of controller 134. In these embodiments, the supplemental liquid byproduct high level limit may be adjusted as desired (e.g. with user interface 142 and/or portable electronic device 148).

Referring still to FIG. 14, liquid byproduct tank 180 is fluidly connected to carbon dioxide tank 102. Accordingly, carbon dioxide gas from carbon dioxide tank 102 may be conveyed to liquid byproduct tank 180 to pressurize it. Since liquid byproduct tank 180 may be pressurized with carbon dioxide gas, it is preferably constructed of high-strength material(s) that can withstand elevated gas pressures. In some embodiments, supplemental liquid byproduct tank 180 may not be pressurized.

As shown, apparatus 100 includes a liquid byproduct tank pressurization control valve 440 that may act to regulate pressurization of liquid byproduct tank 180. Pressurization control valve 440 may be communicatively coupled to controller 134 (FIG. 2) so that its operation is controllable by controller 134. Controller 134 may control operation of pressurization control valve 440 in an automated fashion.

In the illustrated example, carbon dioxide tank 102 includes a pressurization outlet 436, and liquid byproduct tank 180 includes a pressurization inlet 434. As shown, pressurization outlet 436 of carbon dioxide tank 102 and pressurization inlet 434 of liquid byproduct tank 180 are fluidly connected by a pressurization line 438. Accordingly, carbon dioxide gas may exit carbon dioxide tank 102 at pressurization outlet 436, flow through pressurization line 438, and enter liquid byproduct tank 180 at pressurization inlet 434.

Pressurization line 438 may include one or more interconnected conduits, pipes, or the like. As shown, pressurization line 438 includes a single conduit. It will be appreciated that many alternative configurations of pressurization line 438 are possible. The one or more conduits, pipes, or the like included in pressurization line 438 are preferably constructed of high-strength material(s) that can withstand elevated gas pressure and other operational stress.

Pressurization control valve 440 may be located at any point along pressurization line 438. Pressurization control valve 440 may operate between (i) an open position that allows passage of carbon dioxide gas through pressurization line 438, and (ii) a closed position that blocks passage of carbon dioxide gas through pressurization line 438. In the illustrated example, pressurization control valve 440 is located proximate to pressurization outlet 436 of carbon dioxide tank 102. It may be differently located in alternative embodiments. For example, pressurization control valve 440 may be located proximate to pressurization inlet 434 of liquid byproduct tank 180. Alternatively, pressurization control valve 440 may be connected to pressurization outlet 436 of carbon dioxide tank 102.

Referring still to FIG. 14, liquid byproduct tank 180 include a pressure sensor 442 for measuring a liquid byproduct tank pressure. Pressure sensor 442 may be one of many currently available pressure sensors. As an example, pressure sensor 442 may be a DST P92C CAN pressure sensor manufactured by Danfoss Engineering. In alternative embodiments, liquid byproduct tank 180 may include additional pressure sensors 442, e.g. 3 to 6, or more. For example, in an alternative embodiment, liquid byproduct tank 180 may include five pressure sensors 442. The inclusion of multiple pressure sensors 442 may provide one or more advantages. For example, if one or more malfunction, the remaining pressure sensor(s) 442 may still operate to measure the liquid byproduct tank pressure.

Pressure sensor(s) 442 may be communicatively coupled to controller 134 (FIG. 2). Processor 136 may be further configured to:

(i) receive, from pressure sensor(s) 442 of liquid byproduct tank 180, an input signal including the liquid byproduct tank pressure, and (ii) transmit a control signal to liquid byproduct tank pressurization control valve 440 instructing it to act according to the liquid byproduct tank pressure.

Memory 140 of controller 134 may store a baseline liquid byproduct tank pressure for liquid byproduct tank 180. In some embodiments, the baseline liquid byproduct tank pressure may be a pressure at which liquid byproduct tank 180 is desirably maintained throughout operation. As an example, while the liquid byproduct tank pressure level is below the baseline liquid byproduct tank pressure, the control signal transmitted to liquid byproduct tank pressurization control valve 440 may instruct it to operate in the open position (i.e. until the liquid byproduct tank pressure returns to the baseline liquid byproduct tank pressure). In this way, when the liquid byproduct tank pressure is too low, controller 134 may instruct pressurization control valve 440 to operate in the open position (e.g. to re-pressurize liquid byproduct tank 180 to its desired operating pressure). In some embodiments, the baseline liquid byproduct tank pressure may be adjusted as desired (e.g. with user interface 142 and/or portable electronic device 148).

Referring still to FIG. 14, liquid byproduct tank 180 includes a pressure relief valve 444. Pressure relief valve 444 may act to regulate release of carbon dioxide gas from liquid byproduct tank 180. Pressure relief valve 444 may operate between i) an open position that allows carbon dioxide gas to escape and ii) a closed position that blocks escape of carbon dioxide gas. Pressure relief valve 444 may be communicatively coupled to the controller 134 (FIG. 2) so that its operation is controllable by controller 134. Controller 134 may control operation of pressure relief valve 444 in an automated fashion. Processor 136 may be further configured to:

transmit a control signal to pressure relief valve 444 of liquid byproduct tank 180 instructing it to act according to the liquid byproduct tank pressure.

As an example, the control signal transmitted to pressure relief valve 444 of liquid byproduct tank 180 may instruct it to operate in the open position (i.e. to release carbon dioxide gas) while the liquid byproduct tank pressure exceeds a liquid byproduct tank pressure threshold. The liquid byproduct tank pressure threshold may be the pressure rating of liquid byproduct tank 180 or another safety limit. Accordingly, as a safety measure, pressure relief valve 444 may act (i.e. open and close) to keep the pressure of liquid byproduct tank 180 below the liquid byproduct tank pressure threshold. In at least one embodiment, the liquid byproduct tank pressure threshold may be stored in memory 140 of controller 134. In these embodiments, the liquid byproduct tank pressure threshold may be adjusted as desired (e.g. with user interface 142 and/or portable electronic device 148). In the event pressure sensor(s) 442 malfunction (or become inoperable for any reason), pressure relief valve 444 may automatically open when the pressure inside liquid byproduct tank 180 surpasses an upper pressure limit (i.e. by shear mechanical force of the gas pressure).

Pressurizing liquid byproduct tank 180 may provide one or more advantages. For example, pressurization of liquid byproduct tank 180 may aid operation of exchange pump 322, liquid byproduct supply pump 396 and/or reversible liquid byproduct pump 352. A significant portion of the liquid byproduct's pumping force may be provided by the gas pressure within liquid byproduct tank 180. As a result, exchange pump 322, liquid byproduct supply pump 396 and/or reversible liquid byproduct pump 352 may not need to work as hard. For example, with the support of the gas pressure, liquid byproduct supply pump 396 may be able to operate at a lower speed to convey liquid byproduct to mixing chamber 386.

Alternatively, or in addition, pressurization of liquid byproduct tank 180 may facilitate the identification of leaks. In some embodiments, processor 136 may be configured to receive input signals from pressure sensor(s) 442 that include the liquid byproduct tank every minute (or another set time interval, e.g. every 5 seconds). Accordingly, processor 136 may be able to monitor the liquid byproduct tank pressure over time to identify abnormal drops in pressure. Abnormal drops in pressure over time may be the sign of a leak. In response to identifying an abnormal drop in pressure in liquid byproduct tank 180, processor 136 may be configured to transmit a signal that includes a pressure drop warning. This signal may be transmitted to user interface 142 in which case the pressure drop warning may take the form of a flashing light or an auditory alert, for example. Alternatively, or in addition, this signal may be transmitted to portable electronic device 148 in which case the pressure drop warning may take the form of a text message, for example. Liquid byproduct tank 180 may then be checked for leaks. In the event a leak is discovered, it may be repaired or liquid byproduct tank 180 may be replaced.

Referring still to FIG. 14, carbon dioxide gas delivery conduit 156, water delivery conduit 210, acid delivery conduit 328, mixing chamber delivery conduit 302, fire suppressant delivery conduit 350, and mixing chamber delivery conduit 402 may be routed (i.e. fed) through a delivery hose 500. Within delivery hose 500, each delivery conduit may extend parallel to one other. In this way, the material in each delivery conduit flows in the same direction (i.e. follows the direction of delivery hose 500). Although not shown, it will be appreciated that the delivery conduits of apparatuses 100 shown across FIGS. 4-8 and 10-13 may be similarly routed or fed through a delivery hose 500.

Figure 15:
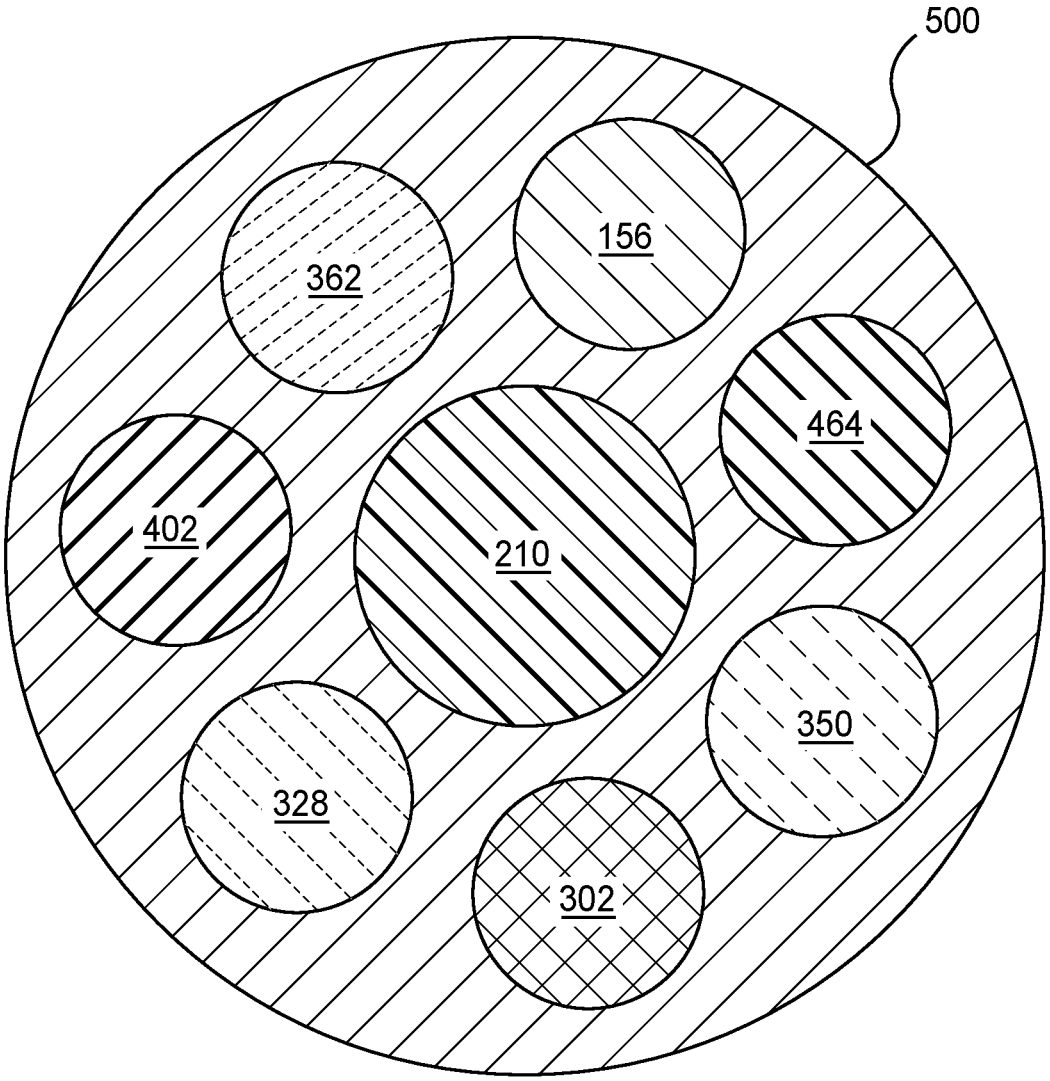
FIG. 15 is a schematic diagram illustrating a cross-section of an exemplary delivery hose usable in a firefighting apparatus.

Reference is now made to FIG. 15, which illustrates a cross-section of an example delivery hose 500. With delivery hose 500, a firefighter may quickly switch between various firefighting outputs (e.g. water, carbon dioxide gas, sandblasting, ice particles, chemical foam, etc.) based on the fire conditions. Furthermore, with delivery hose 500, a firefighter may use multiple outputs simultaneously or in quick succession (e.g. carbonate solution together with acid).

As shown, carbon dioxide gas delivery conduit 156, acid delivery conduit 328, mixing chamber delivery conduit 302, fire suppressant delivery conduit 350, and mixing chamber delivery conduit 402 are arranged circumferentially around water delivery conduit 210. It will be appreciated that many possible arrangements are possible. The diameters of each delivery conduit may vary based on the material it carries. In the example shown, water delivery conduit 210 has a larger diameter than the other delivery conduits. Delivery hose 500 may be expanded to include additional delivery conduits, e.g. delivery conduits 462 and 464. Delivery conduits 462 and 464 may be connected to duplicate tanks of apparatus 100. For example, apparatus 100 may include two acid tanks 110. In this example, delivery conduit 462 may be an acid delivery conduit for this additional acid tank 110. As another example, apparatus 100 may include two carbon dioxide delivery conduits. In this example, delivery conduit 464 may be the second carbon dioxide gas delivery conduit.

In alternative embodiments (not shown), delivery end **156*b* of carbon dioxide gas delivery conduit 156, delivery end 210*b* of water delivery conduit 210, delivery end 328*b* of acid delivery conduit 328, delivery end 302*b* of mixing chamber delivery conduit 302, delivery end 350*b* of fire suppressant delivery conduit 350, and/or delivery end 402*b* of mixing chamber delivery conduit 402 may be connected to a central delivery port. For example, the central delivery port may be located from the side of a firetruck and/or the side of a trailer on which apparatus 100 is mounted. A delivery hose (e.g. much like delivery hose 500) may be connected to the central delivery port. The delivery hose may be connected so that the individual conduits within the delivery hose are aligned and connected with their corresponding delivery end at the central outlet port (i.e. water conduit of hose 500 to water delivery end 210*b* of water delivery conduit 210**). The delivery hose, along with the individual conduits within, are preferably manufactured from a high-strength, non-corrosive and flexible material.

Those skilled in the art will appreciate that the various connections between the conduits, tanks, pumps, valves and/or mixing chambers of any apparatus 100 described herein may be made by any suitable manner of airtight connection.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the claimed subject matter as defined in the claims appended hereto. The scope of the claims should not be limited by the preferred embodiments and examples, but should be given the broadest interpretation consistent with the description as a whole.

The invention claimed is:

1. A firefighting apparatus comprising:

a carbon dioxide tank comprising at least one pressure sensor for measuring a carbon dioxide tank pressure;

an acid tank;

a carbonate tank;

a reaction chamber fluidly connected to the acid tank, the carbonate tank, and the carbon dioxide tank, the reaction chamber comprising a liquid byproduct release outlet;

an acid supply pump that acts to regulate flow of acid from the acid tank to the reaction chamber;

a carbonate supply pump that acts to regulate flow of carbonate from the carbonate tank to the reaction chamber; and a controller comprising a processor, the controller being communicatively coupled to the at least one pressure sensor, the carbonate supply pump and the acid supply pump, wherein acid and carbonate react within the reaction chamber to produce carbon dioxide gas which flows into the carbon dioxide tank and liquid byproduct which is releasable through the liquid byproduct release outlet, and in response to receiving a user command signal, the processor is configured to:

receive, from the at least one pressure sensor, an input signal comprising the carbon dioxide tank pressure;

transmit a control signal to the carbonate supply pump instructing it to act according to at least one of the carbon dioxide tank pressure and the user command signal; and transmit a control signal to the acid supply pump instructing it to act according to at least one of the carbon dioxide tank pressure and the user command signal.

2. The firefighting apparatus of claim 1, wherein the carbon dioxide tank comprises a carbon dioxide gas outlet and a carbon dioxide gas delivery control valve that acts to regulate release of carbon dioxide gas from the carbon dioxide tank at the carbon dioxide gas outlet, the carbon dioxide gas delivery valve being communicatively coupled to the controller, the user command signal comprises a carbon dioxide gas delivery pressure, and in response to receiving the user command signal, the processor is configured to transmit a control signal to the carbon dioxide gas delivery control valve instructing it to act according to the carbon dioxide gas delivery pressure.

3. The firefighting apparatus of claim 1, comprising a carbon dioxide gas delivery conduit for delivering carbon dioxide gas from the carbon dioxide tank to a fire, the carbon dioxide gas delivery conduit having a tank end fluidly connected to the carbon dioxide gas outlet so that carbon dioxide gas released from the carbon dioxide gas outlet flows through the carbon dioxide delivery conduit.

4. A firefighting apparatus comprising:

a carbon dioxide tank comprising at least one pressure sensor for measuring a carbon dioxide tank pressure;

an acid tank;

a carbonate tank;

a reaction chamber fluidly connected to the acid tank, the carbonate tank, and the carbon dioxide tank, the reaction chamber comprising a liquid byproduct release outlet;

an acid supply pump that acts to regulate flow of acid from the acid tank to the reaction chamber;

a carbonate supply pump that acts to regulate flow of carbonate from the carbonate tank to the reaction chamber; and a controller comprising a processor, the controller being communicatively coupled to the at least one pressure sensor, the carbonate supply pump and the acid supply pump, wherein acid and carbonate react within the reaction chamber to produce carbon dioxide gas which flows into the carbon dioxide tank and liquid byproduct which is releasable through the liquid byproduct release outlet, and the processor is configured to:

receive, from the at least one pressure sensor, an input signal comprising the carbon dioxide tank pressure;

transmit a control signal to the carbonate supply pump instructing it to act according to the carbon dioxide tank pressure; and transmit a control signal to the acid supply pump instructing it to act according to the carbon dioxide tank pressure.

5. The firefighting apparatus of claim 4, wherein the control signal transmitted to both the carbonate supply pump and the acid supply pump instructs each to operate while the carbon dioxide tank pressure is below a baseline carbon dioxide tank pressure.

6. The apparatus of claim 4, wherein the carbon dioxide tank comprises a carbon dioxide gas outlet and a carbon dioxide gas delivery control valve that acts to regulate release of carbon dioxide gas from the carbon dioxide tank at the carbon dioxide gas outlet, the carbon dioxide gas delivery valve being communicatively coupled to the controller, and in response to receiving a user command signal comprising a carbon dioxide gas delivery pressure, the processor is configured to transmit a control signal to the carbon dioxide gas delivery control valve instructing it to act according to the carbon dioxide delivery pressure.

7. The firefighting apparatus of claim 6, comprising a carbon dioxide gas delivery conduit for delivering carbon dioxide gas from the carbon dioxide tank to a fire, the carbon dioxide gas delivery conduit having a tank end fluidly connected to the carbon dioxide gas outlet so that carbon dioxide gas released from the carbon dioxide gas outlet flows through the carbon dioxide delivery conduit.

8. The firefighting apparatus of claim 7, wherein the reaction chamber and the carbonate tank are fluidly connected by the carbonate supply pump and a carbonate supply line, the apparatus comprises:

a water tank fluidly connected to the carbonate supply line so that water from the water tank is conveyable to the carbonate supply line to improve flow of carbonate therethrough; and a water supply pump that acts to regulate flow of water from the water tank to the carbonate supply line, the water supply pump being communicatively coupled to the controller, and the processor is configured to transmit a control signal to the water supply pump instructing it to act according to the carbonate supply pump.

9. The firefighting apparatus of claim 8, wherein the water tank comprises a water delivery outlet, the apparatus comprises:

a water delivery conduit for delivering water from the water tank to a fire, the water delivery conduit having a tank end fluidly connected to the water delivery outlet so that water released from the water delivery outlet flows through the water delivery conduit; and a water delivery pump that acts to regulate flow of water through the water delivery conduit, the water delivery pump being communicatively coupled to the controller, and in response to receiving a further user command signal comprising a water delivery pressure, the processor is configured to transmit a control signal to the water delivery pump instructing it to act according to the water delivery pressure.

10. The firefighting apparatus of claim 9, wherein the water tank is fluidly connected to the carbon dioxide tank so that carbon dioxide gas from the carbon dioxide tank is conveyable to pressurize the water tank, and the apparatus comprises a water tank pressurization control valve that acts to regulate pressurization of the water tank.

11. The firefighting apparatus of claim 10, wherein the water tank pressurization control valve is communicatively coupled to the controller, the water tank comprises at least one pressure sensor for measuring a water tank pressure, the at least one pressure sensor of the water tank being communicatively coupled to the controller, and the processor is configured to:

receive, from the at least one pressure sensor of the water tank, an input signal comprising the water tank pressure; and transmit a control signal to the water tank pressurization control valve instructing it to act according to the water tank pressure.

12. The firefighting apparatus of claim 11, wherein the water tank comprises a pressure relief valve that acts to regulate release of carbon dioxide gas from the water tank, the pressure relief valve of the water tank being communicatively coupled to the controller, and the processor is configured to transmit a control signal to the pressure relief valve of the water tank instructing it to release carbon dioxide gas while the water tank pressure exceeds a water tank pressure threshold.

13. The firefighting apparatus of claim 12, wherein the carbon dioxide gas delivery conduit comprises an evaporated water inlet, the water tank comprises an evaporated water outlet, and the apparatus comprises:

an evaporated water uptake conduit fluidly connecting the evaporated water outlet of the water tank to the evaporated water inlet of the carbon dioxide gas delivery conduit so that water vapor from the water tank is conveyable to the carbon dioxide gas delivery conduit to mix with carbon dioxide gas flowing therethrough; and an evaporation control valve that acts to regulate flow of water vapor through the evaporated water uptake line, the evaporation control valve being positioned along the evaporated water uptake line and communicatively coupled to the controller, the user command signal comprises a saturation level and, in response to receiving the user command signal, the processor is configured to:

transmit a control signal to the pressure relief valve of the water tank instructing it to release carbon dioxide gas until the water tank is depressurized; and transmit a control signal to the evaporation control valve instructing it to act according to the saturation level.

14. The firefighting apparatus of claim 13, comprising a thermal tank holding a heat exchange medium, and a portion of the carbon dioxide gas delivery conduit upstream of the evaporated water inlet passes through the thermal tank so that carbon dioxide gas flowing therethrough exchanges heat with the heat exchange medium.

15. The firefighting apparatus of claim 8, comprising:

a mixing chamber having an inlet port, an outlet port, and an internal passage between the inlet port and the outlet port, the mixing chamber comprising at least one mixing element located within the internal passage, the inlet port of the mixing chamber being fluidly connected to the water tank, the carbonate tank and the carbon dioxide tank, each mixing element acts to mix carbonate and at least one of carbon dioxide gas and water into a carbonate solution as they flow through the internal passage;

a mixing chamber delivery conduit for delivering the carbonate solution from the mixing chamber to a fire, the mixing chamber having a chamber end fluidly connected to the outlet port of the mixing chamber;

a water transfer pump that acts to regulate flow of water from the water tank to the mixing chamber;

a carbonate transfer pump that acts to regulate flow of carbonate from the carbonate tank to the mixing chamber; and a carbon dioxide gas transfer control valve that acts to regulate flow of carbon dioxide gas from the carbon dioxide tank to the mixing chamber, the water transfer pump, the carbonate transfer pump, the carbon dioxide gas transfer control valve and each mixing element being communicatively coupled to the controller, and in response to receiving an additional user command signal comprising a carbonate solution delivery pressure and a carbonate concentration, the processor is further configured to:

transmit a control signal to the water transfer pump instructing it to act according to at least one of the carbonate solution delivery pressure and the carbonate concentration;

transmit a control signal to the carbonate transfer pump instructing it to act according to at least one of the carbonate solution delivery pressure and the carbonate concentration;

transmit a control signal to the carbon dioxide gas transfer control valve instructing it to act according to at least one of the carbonate solution delivery pressure and the carbonate concentration; and transmit a control signal to each mixing element instructing that mixing element to act according to at least one of the carbonate solution delivery pressure and the carbonate concentration.

16. The firefighting apparatus of claim 8, wherein the acid tank comprises an acid delivery outlet, the apparatus comprises:

an acid delivery conduit for delivering acid from the acid tank to a fire, the acid delivery conduit having a tank end fluidly connected to the acid delivery outlet so that acid released from the acid delivery outlet flows through the acid delivery conduit; and an acid delivery pump that acts to regulate flow of acid through the acid delivery conduit, the acid delivery pump being communicatively coupled to the controller, and in response to receiving a further additional user command signal comprising an acid delivery pressure, the processor is configured to transmit a control signal to the acid delivery pump instructing it to act according to the acid delivery pressure.

17. The firefighting apparatus of claim 16, wherein the water tank is fluidly connected to the acid delivery conduit, the apparatus comprises an acid dilution pump that acts to regulate flow of water from the water tank to the acid delivery conduit, the acid dilution pump being communicatively coupled to the controller, the further additional user command signal comprises an acid concentration, and in response to receiving the further additional user command signal, the processor is configured to transmit a control signal to the acid dilution pump instructing it to act according to the acid concentration.

18. The firefighting apparatus of claim 8, wherein the water tank comprises at least one level sensor for measuring a water level within the water tank, the at least one level sensor of the water tank being communicatively coupled to the controller, the apparatus comprises:

a liquid byproduct tank comprising a liquid byproduct inlet fluidly connected to the liquid byproduct release outlet of the reaction chamber so that liquid byproduct released from the reaction chamber collects within the liquid byproduct tank, the liquid byproduct tank being fluidly connected to the water tank; and an exchange pump that acts to regulate flow of liquid byproduct from the liquid byproduct tank to the water tank, the exchange pump being communicatively coupled to the controller, and the processor is configured to:

receive, from the at least one level sensor of the water tank, an input signal comprising the water level; and transmit a control signal to the exchange pump instructing it to operate while the water level is below a water level threshold.

19. The firefighting apparatus of claim 18, comprising:

a supplemental tank for holding a fire suppressant;

a mixing chamber having an inlet port, an outlet port, and an internal passage extending between the inlet and the outlet port, the mixing chamber comprising at least one mixing element located in the internal passage, the inlet port of the mixing chamber being fluidly connected to the water tank, the supplemental tank, and the carbon dioxide tank, each mixing element acts to mix fire suppressant and at least one of liquid byproduct and carbon dioxide gas into a fire suppressing solution as they flow through the internal passage;

a mixing chamber delivery conduit for delivering the fire suppressing solution from the mixing chamber to a fire, the mixing chamber delivery conduit having a chamber end fluidly connected to the outlet port of the mixing chamber;

a liquid byproduct supply pump that acts to regulate flow of liquid byproduct from the liquid byproduct tank to the mixing chamber;

a fire suppressant supply pump that acts to regulate flow of fire suppressant from the supplemental tank to the mixing chamber; and a carbon dioxide gas supply control valve that acts to regulate flow of carbon dioxide gas from the carbon dioxide tank to the mixing chamber, the liquid byproduct supply pump, the fire suppressant supply pump, the carbon dioxide gas supply control valve, and each mixing element being communicatively coupled to the controller, and in response to receiving an additional user command signal comprising at least a fire suppressing solution delivery pressure and a fire suppressing material concentration, the processor is configured to:

transmit a control signal to the liquid byproduct supply pump instructing it to act according to at least one of the fire suppressing solution delivery pressure and the fire suppressant concentration;

transmit a control signal to the fire suppressant supply pump instructing it to act according to at least one of the fire suppressing solution delivery pressure and the fire suppressant concentration;

transmit a control signal to the carbon dioxide gas supply control valve instructing it to act according to at least one of the fire suppressing solution delivery pressure and the fire suppressant concentration; and transmit a control signal to each mixing element instructing that mixing element to act according to at least one of the fire suppressing solution delivery pressure and the fire suppressant concentration.

20. The firefighting apparatus of claim 4, wherein the reaction chamber comprises at least one level sensor for measuring a liquid byproduct level within the reaction chamber, the at least one level sensor being communicatively coupled to the controller, the apparatus comprises a liquid byproduct pump that acts to regulate release of liquid byproduct from the reaction chamber at the liquid byproduct release outlet, the liquid byproduct pump being communicatively coupled to the controller, and the processor is configured to:

receive, from the at least one level sensor of the reaction chamber, an input signal comprising the liquid byproduct level within the reaction chamber; and transmit a control signal to the liquid byproduct pump instructing it to act according to the liquid byproduct level within the reaction chamber.

21. The firefighting apparatus of claim 4, wherein both the carbonate tank and the acid tank are fluidly connected to the carbon dioxide tank so that carbon dioxide gas from the carbon dioxide tank is conveyable to pressurize each of the carbonate tank and the acid tank, and the apparatus comprises:

a carbonate tank pressurization control valve that acts to regulate pressurization of the carbonate tank; and an acid tank pressurization control valve that acts to regulate pressurization of the acid tank.

22. The firefighting apparatus of claim 21, wherein both the carbonate tank pressurization control valve and the acid tank pressurization control valve are communicatively coupled to the controller, the carbonate tank comprises at least one pressure sensor for measuring a carbonate tank pressure, the acid tank comprises at least one pressure sensor for measuring an acid tank pressure, the at least one pressure sensor of both the carbonate tank and acid tank being communicatively coupled to the controller, and the processor is configured to:

receive, from the at least one pressure sensor of the carbonate tank, an input signal comprising the carbonate tank pressure;

transmit a control signal to the carbonate tank pressurization control valve instructing it to act according to the carbonate tank pressure;

receive, from the at least one pressure sensor of the acid tank, an input signal comprising the acid tank pressure; and transmit a control signal to the acid tank pressurization control valve instructing it to act according to the acid tank pressure.

23. The firefighting apparatus of claim 4, comprising:

an additional tank for holding a fire suppressant, the additional tank comprising a fire suppressant outlet;

a fire suppressant delivery conduit for delivering fire suppressant from the additional tank to a fire, the fire suppressant delivery conduit having a tank end fluidly connected to the fire suppressant outlet so that fire suppressant released from the fire suppressant outlet flows through the fire suppressant delivery conduit, the fire suppressant delivery conduit being fluidly connected to the carbon dioxide tank so that carbon dioxide gas from the carbon dioxide tank is able to propel fire suppressing material through the fire suppressant delivery conduit;

a fire suppressant pump that acts to regulate release of fire suppressant from the fire suppressant outlet, the fire suppressant pump being communicatively coupled to the controller; and a propulsion control valve that acts to regulate propulsion of fire suppressant through the fire suppressant delivery conduit, the propulsion control valve being communicatively coupled to the controller, and in response to receiving a user command signal comprising a fire suppressant delivery pressure, the processor is configured to:

transmit a control signal to the fire suppressant pump instructing it to act according to the fire suppressant delivery pressure; and transmit a control signal to the propulsion control valve instructing it to act according to the fire suppressant delivery pressure.

24. The firefighting apparatus of claim 23, wherein the additional tank is fluidly connected to the carbon dioxide tank so that carbon dioxide gas from the carbon dioxide tank is conveyable to pressurize the additional tank, and the apparatus comprises an additional tank pressurization control valve that acts to regulate pressurization of the additional tank.

25. The firefighting apparatus of claim 24, wherein the additional tank pressurization control valve is communicatively coupled to the controller, the additional tank comprises at least one pressure sensor for measuring an additional tank pressure, the at least one pressure sensor of the additional tank being communicatively coupled to the controller, and the processor is configured to:

receive, from the at least one pressure sensor of the additional tank, an input signal comprising the additional tank pressure; and transmit a control signal to the additional tank pressurization control valve instructing it to act according to the additional tank pressure.

* * * * *